US011867045B2

(12) United States Patent
Yeung

(10) Patent No.: US 11,867,045 B2
(45) **Date of Patent: *Jan. 9, 2024**

(54) HYDRAULIC FRACTURING PUMPS TO ENHANCE FLOW OF FRACTURING FLUID INTO WELLHEADS AND RELATED METHODS

(71) Applicant: BJ Energy Solutions, LLC, Houston, TX (US)

(72) Inventor: Tony Yeung, Houston, TX (US)

(73) Assignee: BJ Energy Solutions, LLC, The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/901,112

(22) Filed: Sep. 1, 2022

(65) Prior Publication Data

US 2022/0412201 A1 Dec. 29, 2022

Related U.S. Application Data

(62) Division of application No. 17/664,578, filed on May 23, 2022.

(Continued)

(51) Int. Cl.
*E21B 43/26* (2006.01)
*F04B 53/00* (2006.01)

(Continued)

(52) U.S. Cl.
CPC ..... *E21B 43/2607* (2020.05); *F04B 1/04* (2013.01); *F04B 1/0404* (2013.01);

(Continued)

(58) Field of Classification Search
CPC ..... F04B 1/0412; F04B 1/04; F04B 1/0404; F04B 53/006; F04B 13/02; F04B 39/14; F04B 1/0413; E21B 43/2607
See application file for complete search history.

(56) References Cited

U.S. PATENT DOCUMENTS 1,716,049 A * 6/1929 Greve ..... F01B 1/04 91/188
1,726,633 A * 9/1929 Smith ..... F04B 1/00 74/44

(Continued)

FOREIGN PATENT DOCUMENTS

AU 9609498 7/1999
AU 737970 9/2001

(Continued)

OTHER PUBLICATIONS

US 11,459,865 B2, 10/2022, Cui et al. (withdrawn)

(Continued)

*Primary Examiner* — Christopher S Bobish
(74) *Attorney, Agent, or Firm* — Norton Rose Fulbright US LLP

(57) ABSTRACT

Systems and methods to enhance the flow of fracturing fluid into a wellhead during a high-pressure fracturing operation may include providing a pump frame and a crankshaft. A plurality of first plungers may be connected to the crankshaft and may reciprocate in a first plane. The hydraulic fracturing pump also may include a plurality of second plungers connected to the crankshaft and positioned to reciprocate in a second plane. The first plane and the second plane may define a non-zero offset angle between the first plane and the second plane. The crankshaft may include a plurality of crankpins, and each of the crankpins may be connected to one of the first plungers and one of the second plungers. The first plungers may pump a first fracturing fluid and the second plungers may pump a second fracturing fluid different from the first fracturing fluid.

20 Claims, 21 Drawing Sheets

Related U.S. Application Data

(60) Provisional application No. 63/202,031, filed on May 24, 2021.

(51) Int. Cl.

| | |
|---|---|
| ***F04B 19/04*** | (2006.01) |
| ***F04B 1/04*** | (2020.01) |
| ***F04B 1/0404*** | (2020.01) |
| ***F04B 1/0413*** | (2020.01) |
| ***F04B 39/14*** | (2006.01) |
| ***F04B 13/02*** | (2006.01) |

(52) U.S. Cl.

CPC ..... *F04B 1/0413* (2013.01); *F04B 19/04* (2013.01); *F04B 39/14* (2013.01); *F04B 53/006* (2013.01); *F04B 13/02* (2013.01)

(56) References Cited

U.S. PATENT DOCUMENTS 2,178,662 A * 11/1939 Hanson ..... F04B 39/16 92/73
2,427,638 A * 9/1947 Vilter ..... F04B 27/053 417/281
2,498,229 A 2/1950 Adler
2,535,703 A 12/1950 Smith et al.
2,572,711 A * 10/1951 William, V ..... F04B 49/126 417/273
2,820,341 A 1/1958 Amann
2,868,004 A 1/1959 Runde
2,940,377 A 6/1960 Darnell et al.
2,947,141 A 8/1960 Russ
2,956,738 A * 10/1960 Mun ..... F04B 27/053 92/144
3,068,796 A 12/1962 Pfluger et al.
3,191,517 A 6/1965 Solzman
3,257,031 A 6/1966 Dietz
3,274,768 A 9/1966 Klein
3,378,074 A 4/1968 Kiel
3,382,671 A 5/1968 Ehni, III
3,401,873 A * 9/1968 Privon ..... F25B 31/02 417/415
3,463,612 A 8/1969 Whitsel
3,496,880 A * 2/1970 Wolff ..... F02M 59/06 92/72
3,550,696 A 12/1970 Kenneday
3,560,053 A 2/1971 Ortloff
3,586,459 A 6/1971 Zerlauth
3,632,222 A 1/1972 Cronstedt
3,656,582 A 4/1972 Alcock
3,667,868 A * 6/1972 Brunner ..... F04B 1/0536 417/273
3,692,434 A * 9/1972 Schnear ..... F04B 39/128 417/273
3,739,872 A 6/1973 McNair
3,757,581 A * 9/1973 Mankin ..... G01F 3/18 92/72
3,759,063 A 9/1973 Bendall
3,765,173 A 10/1973 Harris
3,771,916 A 11/1973 Flanigan et al.
3,773,438 A 11/1973 Hall et al.
3,781,135 A 12/1973 Nickell
3,786,835 A 1/1974 Finger
3,791,682 A 2/1974 Mitchell
3,796,045 A 3/1974 Foster
3,814,549 A 6/1974 Cronstedt
3,820,922 A 6/1974 Buse et al.
3,847,511 A * 11/1974 Cole ..... F04B 1/02 417/342
3,866,108 A 2/1975 Yannone
3,875,380 A 4/1975 Rankin
3,963,372 A 6/1976 McLain et al.
4,010,613 A 3/1977 McInerney
4,019,477 A 4/1977 Overton
4,031,407 A 6/1977 Reed
4,050,862 A * 9/1977 Buse ..... F04B 1/00 417/454
4,059,045 A 11/1977 McClain
4,086,976 A 5/1978 Holm et al.
4,117,342 A 9/1978 Melley, Jr.
4,173,121 A 11/1979 Yu
4,204,808 A 5/1980 Reese et al.
4,209,079 A 6/1980 Marchal et al.
4,209,979 A 7/1980 Woodhouse et al.
4,222,229 A 9/1980 Uram
4,239,396 A 12/1980 Arribau et al.
4,269,569 A 5/1981 Hoover
4,311,395 A 1/1982 Douthitt et al.
4,330,237 A 5/1982 Battah
4,341,508 A 7/1982 Rambin, Jr.
4,357,027 A 11/1982 Zeitlow
4,383,478 A 5/1983 Jones
4,402,504 A 9/1983 Christian
4,430,047 A * 2/1984 Ilg ..... F04B 1/0404 417/273
4,442,665 A 4/1984 Fick
4,457,325 A 7/1984 Green
4,470,771 A 9/1984 Hall et al.
4,483,684 A 11/1984 Black
4,505,650 A 3/1985 Hannett et al.
4,574,880 A 3/1986 Handke
4,584,654 A 4/1986 Crane
4,620,330 A 11/1986 Izzi, Sr.
4,672,813 A 6/1987 David
4,754,607 A 7/1988 Mackay
4,782,244 A 11/1988 Wakimoto
4,796,777 A 1/1989 Keller
4,869,209 A 9/1989 Young
4,913,625 A 4/1990 Gerlowski
4,983,259 A 1/1991 Duncan
4,990,058 A 2/1991 Eslinger
5,032,065 A * 7/1991 Yamamuro ..... F04B 23/06 60/413
5,135,361 A 8/1992 Dion
5,167,493 A * 12/1992 Kobari ..... F04B 1/0536 417/427
5,245,970 A 9/1993 Iwaszkiewicz et al.
5,291,842 A 3/1994 Sallstrom et al.
5,326,231 A * 7/1994 Pandeya ..... F04B 39/14 92/72
5,362,219 A 11/1994 Paul et al.
5,511,956 A * 4/1996 Hasegawa ..... F02M 59/08 417/364
5,537,813 A 7/1996 Davis et al.
5,553,514 A 9/1996 Walkowc
5,560,195 A 10/1996 Anderson et al.
5,586,444 A 12/1996 Fung
5,622,245 A 4/1997 Reik
5,626,103 A 5/1997 Haws et al.
5,634,777 A * 6/1997 Albertin ..... F04B 1/0421 74/570.21
5,651,400 A 7/1997 Corts et al.
5,678,460 A 10/1997 Walkowc
5,717,172 A 2/1998 Griffin, Jr. et al.
5,720,598 A 2/1998 de Chizzelle
5,761,084 A 6/1998 Edwards
5,811,676 A 9/1998 Spalding et al.
5,839,888 A 11/1998 Harrison
5,846,062 A 12/1998 Yanagisawa et al.
5,875,744 A * 3/1999 Vallejos ..... F02B 57/08 123/190.17
5,983,962 A 11/1999 Gerardot
5,992,944 A * 11/1999 Hara ..... F04B 1/0536 303/10
6,041,856 A 3/2000 Thrasher et al.
6,050,080 A 4/2000 Horner
6,067,962 A 5/2000 Bartley et al.
6,071,188 A 6/2000 O'Neill et al.
6,074,170 A 6/2000 Bert et al.
6,123,751 A 9/2000 Nelson et al.
6,129,335 A 10/2000 Yokogi
6,145,318 A 11/2000 Kaplan et al.

(56) References Cited

U.S. PATENT DOCUMENTS 6,230,481 B1 5/2001 Jahr
6,279,309 B1 8/2001 Lawlor et al.
6,321,860 B1 11/2001 Reddoch
6,334,746 B1 1/2002 Nguyen et al.
6,401,472 B2 * 6/2002 Pollrich ..... F04B 27/0414 62/196.2
6,530,224 B1 3/2003 Conchieri
6,543,395 B2 4/2003 Green
6,655,922 B1 12/2003 Flek
6,669,453 B1 * 12/2003 Breeden ..... F04B 1/0456 184/26
6,765,304 B2 7/2004 Baten et al.
6,786,051 B2 9/2004 Kristich et al.
6,832,900 B2 * 12/2004 Leu ..... F04B 39/0094 417/523
6,851,514 B2 2/2005 Han et al.
6,859,740 B2 2/2005 Stephenson et al.
6,901,735 B2 6/2005 Lohn
6,962,057 B2 11/2005 Kurokawa et al.
7,007,966 B2 3/2006 Campion
7,047,747 B2 5/2006 Tanaka
7,065,953 B1 6/2006 Kopko
7,143,016 B1 11/2006 Discenzo et al.
7,222,015 B2 5/2007 Davis et al.
7,281,519 B2 * 10/2007 Schroeder ..... F04B 53/22 123/445
7,388,303 B2 6/2008 Seiver
7,404,294 B2 7/2008 Sundin
7,442,239 B2 10/2008 Armstrong et al.
7,524,173 B2 4/2009 Cummins
7,545,130 B2 6/2009 Latham
7,552,903 B2 6/2009 Dunn et al.
7,563,076 B2 7/2009 Brunet et al.
7,563,413 B2 7/2009 Naets et al.
7,574,325 B2 8/2009 Dykstra
7,581,379 B2 9/2009 Yoshida et al.
7,594,424 B2 9/2009 Fazekas
7,614,239 B2 11/2009 Herzog et al.
7,627,416 B2 12/2009 Batenburg et al.
7,677,316 B2 3/2010 Butler et al.
7,721,521 B2 5/2010 Kunkle et al.
7,730,711 B2 6/2010 Kunkle et al.
7,779,961 B2 8/2010 Matte
7,789,452 B2 9/2010 Dempsey et al.
7,836,949 B2 11/2010 Dykstra
7,841,394 B2 11/2010 McNeel et al.
7,845,413 B2 12/2010 Shampine et al.
7,861,679 B2 1/2011 Lemke et al.
7,886,702 B2 2/2011 Jerrell et al.
7,900,724 B2 3/2011 Promersberger et al.
7,921,914 B2 4/2011 Bruins et al.
7,938,151 B2 5/2011 Höckner
7,955,056 B2 6/2011 Pettersson
7,980,357 B2 7/2011 Edwards
8,056,635 B2 11/2011 Shampine et al.
8,083,504 B2 12/2011 Williams et al.
8,099,942 B2 1/2012 Alexander
8,186,334 B2 5/2012 Ooyama
8,196,555 B2 6/2012 Ikeda et al.
8,202,354 B2 6/2012 Iijima
8,316,936 B2 11/2012 Roddy et al.
8,336,631 B2 12/2012 Shampine et al.
8,388,317 B2 * 3/2013 Sung ..... F04B 27/0414 417/273
8,414,673 B2 4/2013 Raje et al.
8,469,826 B2 6/2013 Brosowske
8,500,215 B2 * 8/2013 Gastauer ..... B60T 8/4031 303/DIG. 10
8,506,267 B2 8/2013 Gambier et al.
8,575,873 B2 11/2013 Peterson et al.
8,616,005 B1 12/2013 Cousino, Sr. et al.
8,621,873 B2 1/2014 Robertson et al.
8,641,399 B2 * 2/2014 Mucibabic ..... B29C 45/82 425/166
8,656,990 B2 2/2014 Kajaria et al.
8,672,606 B2 3/2014 Glynn et al.
8,707,853 B1 4/2014 Dille et al.
8,708,667 B2 * 4/2014 Collingborn ..... F04B 1/0421 92/148
8,714,253 B2 5/2014 Sherwood et al.
8,757,918 B2 6/2014 Ramnarain et al.
8,763,583 B2 7/2014 Hofbauer et al.
8,770,329 B2 7/2014 Spitler
8,784,081 B1 7/2014 Blume
8,789,601 B2 7/2014 Broussard et al.
8,794,307 B2 8/2014 Coquilleau et al.
8,801,394 B2 8/2014 Anderson
8,851,186 B2 10/2014 Shampine et al.
8,851,441 B2 10/2014 Acuna et al.
8,894,356 B2 11/2014 Lafontaine et al.
8,905,056 B2 12/2014 Kendrick
8,951,019 B2 2/2015 Hains et al.
8,973,560 B2 3/2015 Krug
8,997,904 B2 4/2015 Cryer et al.
9,011,111 B2 4/2015 Lesko
9,016,383 B2 4/2015 Shampine et al.
9,032,620 B2 5/2015 Frassinelli et al.
9,057,247 B2 6/2015 Kumar et al.
9,097,249 B2 * 8/2015 Petersen ..... F04B 1/0408
9,103,193 B2 8/2015 Coli et al.
9,121,257 B2 9/2015 Coli et al.
9,140,110 B2 9/2015 Coli et al.
9,175,810 B2 11/2015 Hains
9,187,982 B2 11/2015 Dehring et al.
9,206,667 B2 12/2015 Khvoshchev et al.
9,212,643 B2 12/2015 Deliyski
9,222,346 B1 12/2015 Walls
9,324,049 B2 4/2016 Thomeer et al.
9,341,055 B2 5/2016 Weightman et al.
9,346,662 B2 5/2016 Van Vliet et al.
9,366,114 B2 6/2016 Coli et al.
9,376,786 B2 6/2016 Numasawa
9,394,829 B2 7/2016 Cabeen et al.
9,395,049 B2 7/2016 Vicknair et al.
9,401,670 B2 7/2016 Minato et al.
9,410,410 B2 8/2016 Broussard et al.
9,410,546 B2 8/2016 Jaeger et al.
9,429,078 B1 8/2016 Crowe et al.
9,435,333 B2 9/2016 McCoy et al.
9,488,169 B2 11/2016 Cochran et al.
9,493,997 B2 11/2016 Liu et al.
9,512,783 B2 12/2016 Veilleux et al.
9,534,473 B2 1/2017 Morris et al.
9,546,652 B2 1/2017 Yin
9,550,501 B2 1/2017 Ledbetter
9,556,721 B2 1/2017 Jang et al.
9,562,420 B2 2/2017 Morris et al.
9,570,945 B2 2/2017 Fischer
9,579,980 B2 2/2017 Cryer et al.
9,587,649 B2 3/2017 Oehring
9,593,710 B2 3/2017 Laimboeck et al.
9,611,728 B2 4/2017 Oehring
9,617,808 B2 4/2017 Liu et al.
9,638,101 B1 5/2017 Crowe et al.
9,638,194 B2 5/2017 Wiegman et al.
9,650,871 B2 5/2017 Oehring et al.
9,656,762 B2 5/2017 Kamath et al.
9,689,316 B1 6/2017 Crom
9,695,808 B2 * 7/2017 Giessbach ..... F04B 27/08
9,739,130 B2 8/2017 Young
9,764,266 B1 9/2017 Carter
9,777,748 B2 10/2017 Lu et al.
9,803,467 B2 10/2017 Tang et al.
9,803,793 B2 10/2017 Davi et al.
9,809,308 B2 11/2017 Aguilar et al.
9,829,002 B2 11/2017 Crom
9,840,897 B2 12/2017 Larson
9,840,901 B2 12/2017 Oehring et al.
9,845,730 B2 12/2017 Betti et al.
9,850,422 B2 12/2017 Lestz et al.
9,856,131 B1 1/2018 Moffitt
9,863,279 B2 1/2018 Laing et al.
9,869,305 B1 1/2018 Crowe et al.

(56) References Cited

U.S. PATENT DOCUMENTS 9,871,406 B1 1/2018 Churnock et al.
9,879,609 B1 1/2018 Crowe et al.
RE46,725 E 2/2018 Case et al.
9,893,500 B2 2/2018 Oehring et al.
9,893,660 B2 2/2018 Peterson et al.
9,897,003 B2 2/2018 Motakef et al.
9,920,615 B2 3/2018 Zhang et al.
9,945,365 B2 4/2018 Hernandez et al.
9,964,052 B2 5/2018 Millican et al.
9,970,278 B2 5/2018 Broussard et al.
9,981,840 B2 5/2018 Shock
9,995,102 B2 6/2018 Dillie et al.
9,995,218 B2 6/2018 Oehring et al.
10,008,880 B2 6/2018 Vicknair et al.
10,008,912 B2 6/2018 Davey et al.
10,018,096 B2 7/2018 Wallimann et al.
10,020,711 B2 7/2018 Oehring et al.
10,024,123 B2 7/2018 Steffenhagen et al.
10,029,289 B2 7/2018 Wendorski et al.
10,030,579 B2 7/2018 Austin et al.
10,036,238 B2 7/2018 Oehring
10,040,541 B2 8/2018 Wilson et al.
10,060,293 B2 8/2018 Del Bono
10,060,349 B2 8/2018 Álvarez et al.
10,077,933 B2 9/2018 Nelson et al.
10,082,137 B2 9/2018 Graham et al.
10,094,366 B2 10/2018 Marica
10,100,827 B2 10/2018 Devan et al.
10,107,084 B2 10/2018 Coli et al.
10,107,085 B2 10/2018 Coli et al.
10,114,061 B2 10/2018 Frampton et al.
10,119,381 B2 11/2018 Oehring et al.
10,125,750 B2 * 11/2018 Pfaff ..... F04B 1/04
10,134,257 B2 11/2018 Zhang et al.
10,138,098 B2 11/2018 Sorensen et al.
10,151,244 B2 12/2018 Giancotti et al.
10,161,423 B2 * 12/2018 Rampen ..... F15B 11/162
10,174,599 B2 1/2019 Shampine et al.
10,184,397 B2 1/2019 Austin et al.
10,196,258 B2 2/2019 Kalala et al.
10,221,856 B2 3/2019 Hernandez et al.
10,227,854 B2 3/2019 Glass
10,227,855 B2 3/2019 Coli et al.
10,246,984 B2 4/2019 Payne et al.
10,247,182 B2 4/2019 Zhang et al.
10,254,732 B2 4/2019 Oehring et al.
10,267,439 B2 4/2019 Pryce et al.
10,280,724 B2 5/2019 Hinderliter
10,287,943 B1 5/2019 Schiltz
10,288,519 B2 5/2019 De La Cruz
10,303,190 B2 5/2019 Shock
10,305,350 B2 5/2019 Johnson et al.
10,316,832 B2 6/2019 Byrne
10,317,875 B2 6/2019 Pandurangan
10,337,402 B2 7/2019 Austin et al.
10,358,035 B2 7/2019 Cryer
10,371,012 B2 8/2019 Davis et al.
10,374,485 B2 8/2019 Morris et al.
10,378,326 B2 8/2019 Morris et al.
10,393,108 B2 8/2019 Chong et al.
10,407,990 B2 9/2019 Oehring et al.
10,408,031 B2 9/2019 Oehring et al.
10,415,348 B2 9/2019 Zhang et al.
10,415,557 B1 9/2019 Crowe et al.
10,415,562 B2 9/2019 Kajita et al.
RE47,695 E 11/2019 Case et al.
10,465,689 B2 11/2019 Crom
10,478,753 B1 11/2019 Elms et al.
10,526,882 B2 1/2020 Oehring et al.
10,563,649 B2 2/2020 Zhang et al.
10,577,910 B2 3/2020 Stephenson
10,584,645 B2 3/2020 Nakagawa et al.
10,590,867 B2 3/2020 Thomassin et al.
10,598,258 B2 3/2020 Oehring et al.
10,610,842 B2 4/2020 Chong
10,662,749 B1 5/2020 Hill et al.
10,711,787 B1 7/2020 Darley
10,738,580 B1 8/2020 Fischer et al.
10,753,153 B1 8/2020 Fischer et al.
10,753,165 B1 8/2020 Fischer et al.
10,760,556 B1 9/2020 Crom et al.
10,794,165 B2 10/2020 Fischer et al.
10,794,166 B2 10/2020 Reckels et al.
10,801,311 B1 10/2020 Cui et al.
10,815,764 B1 10/2020 Yeung et al.
10,815,978 B2 10/2020 Glass
10,830,032 B1 11/2020 Zhang et al.
10,830,225 B2 * 11/2020 Repaci ..... F04B 39/066
10,859,203 B1 12/2020 Cui et al.
10,864,487 B1 12/2020 Han et al.
10,865,624 B1 12/2020 Cui et al.
10,865,631 B1 12/2020 Zhang et al.
10,870,093 B1 12/2020 Zhong et al.
10,871,045 B2 12/2020 Fischer et al.
10,900,475 B2 1/2021 Weightman et al.
10,907,459 B1 2/2021 Yeung et al.
10,927,774 B2 2/2021 Cai et al.
10,927,802 B2 2/2021 Oehring
10,954,770 B1 3/2021 Yeung et al.
10,954,855 B1 3/2021 Ji et al.
10,961,614 B1 3/2021 Yeung et al.
10,961,908 B1 3/2021 Yeung et al.
10,961,912 B1 3/2021 Yeung et al.
10,961,914 B1 3/2021 Yeung et al.
10,961,993 B1 3/2021 Ji et al.
10,961,995 B2 * 3/2021 Mayorca ..... F04B 39/0094
10,892,596 B2 4/2021 Yeung et al.
10,968,837 B1 4/2021 Yeung et al.
10,982,523 B1 4/2021 Hill et al.
10,989,019 B2 4/2021 Cai et al.
10,989,180 B2 4/2021 Yeung et al.
10,995,564 B2 5/2021 Miller et al.
11,002,189 B2 5/2021 Yeung et al.
11,008,950 B2 5/2021 Ethier et al.
11,015,423 B1 5/2021 Yeung et al.
11,015,536 B2 5/2021 Yeung et al.
11,015,594 B2 5/2021 Yeung et al.
11,022,526 B1 6/2021 Yeung et al.
11,028,677 B1 6/2021 Yeung et al.
11,035,213 B2 6/2021 Dusterhoft et al.
11,035,214 B2 6/2021 Cui et al.
11,047,379 B1 6/2021 Li et al.
10,895,202 B1 7/2021 Yeung et al.
11,053,853 B2 7/2021 Li et al.
11,060,455 B1 7/2021 Yeung et al.
11,066,915 B1 7/2021 Yeung et al.
11,068,455 B2 7/2021 Shabi et al.
11,085,281 B1 8/2021 Yeung et al.
11,085,282 B2 8/2021 Mazrooee et al.
11,092,152 B2 8/2021 Yeung et al.
11,098,651 B1 8/2021 Yeung et al.
11,105,250 B1 8/2021 Zhang et al.
11,105,266 B2 8/2021 Zhou et al.
11,109,508 B1 8/2021 Yeung et al.
11,111,768 B1 9/2021 Yeung et al.
11,125,066 B1 9/2021 Yeung et al.
11,125,156 B2 9/2021 Zhang et al.
11,129,295 B1 9/2021 Yeung et al.
11,143,000 B2 10/2021 Li et al.
11,143,005 B2 10/2021 Dusterhoft et al.
11,143,006 B1 10/2021 Zhang et al.
11,149,533 B1 10/2021 Yeung et al.
11,149,726 B1 10/2021 Yeung et al.
11,156,159 B1 10/2021 Yeung et al.
11,168,681 B2 * 11/2021 Boguski ..... F04B 53/006
11,174,716 B1 11/2021 Yeung et al.
11,193,360 B1 12/2021 Yeung et al.
11,193,361 B1 12/2021 Yeung et al.
11,205,880 B1 12/2021 Yeung et al.
11,205,881 B2 12/2021 Yeung et al.
11,208,879 B1 12/2021 Yeung et al.
11,208,953 B1 12/2021 Yeung et al.
11,220,895 B1 1/2022 Yeung et al.
11,236,739 B2 2/2022 Yeung et al.

(56) References Cited

U.S. PATENT DOCUMENTS 11,242,737 B2 2/2022 Zhang et al.
11,243,509 B2 2/2022 Cai et al.
11,251,650 B1 2/2022 Liu et al.
11,261,717 B2 3/2022 Yeung et al.
11,268,346 B2 3/2022 Yeung et al.
11,280,266 B2 3/2022 Yeung et al.
11,306,835 B1 4/2022 Dille et al.
RE49,083 E 5/2022 Case et al.
11,339,638 B1 5/2022 Yeung et al.
11,346,200 B2 5/2022 Cai et al.
11,373,058 B2 6/2022 Jaaskelainen et al.
RE49,140 E 7/2022 Case et al.
11,377,943 B2 7/2022 Kriebel et al.
RE49,155 E 8/2022 Case et al.
RE49,156 E 8/2022 Case et al.
11,401,927 B2 8/2022 Li et al.
11,428,165 B2 8/2022 Yeung et al.
11,441,483 B2 9/2022 Li et al.
11,448,122 B2 9/2022 Feng et al.
11,466,680 B2 10/2022 Yeung et al.
11,480,040 B2 10/2022 Han et al.
11,492,887 B2 11/2022 Cui et al.
11,499,405 B2 11/2022 Zhang et al.
11,506,039 B2 11/2022 Zhang et al.
11,512,570 B2 11/2022 Yeung
11,519,395 B2 12/2022 Zhang et al.
11,519,405 B2 12/2022 Deng et al.
11,530,602 B2 12/2022 Yeung et al.
11,549,349 B2 1/2023 Wang et al.
11,555,390 B2 1/2023 Cui et al.
11,555,756 B2 1/2023 Yeung et al.
11,557,887 B2 1/2023 Ji et al.
11,560,779 B2 1/2023 Mao et al.
11,560,845 B2 1/2023 Yeung et al.
11,572,775 B2 2/2023 Mao et al.
11,575,249 B2 2/2023 Ji et al.
11,592,020 B2 2/2023 Chang et al.
11,596,047 B2 2/2023 Liu et al.
11,598,263 B2 3/2023 Yeung et al.
11,603,797 B2 3/2023 Zhang et al.
11,607,982 B2 3/2023 Tian et al.
11,608,726 B2 3/2023 Zhang et al.
11,624,326 B2 4/2023 Yeung et al.
11,629,583 B2 4/2023 Yeung et al.
11,629,589 B2 4/2023 Lin et al.
11,649,766 B1 5/2023 Yeung et al.
11,662,384 B2 5/2023 Liu et al.
11,668,173 B2 6/2023 Zhang et al.
11,668,289 B2 6/2023 Chang et al.
11,677,238 B2 6/2023 Liu et al.
2002/0126922 A1 9/2002 Cheng et al.
2002/0197176 A1* 12/2002 Kondo ..... F04B 1/0413 417/470
2003/0031568 A1* 2/2003 Stiefel ..... F04B 1/07 417/221
2003/0061819 A1 4/2003 Kuroki et al.
2003/0161212 A1 8/2003 Neal et al.
2004/0016245 A1 1/2004 Pierson
2004/0074238 A1 4/2004 Wantanabe et al.
2004/0076526 A1 4/2004 Fukano et al.
2004/0187950 A1 9/2004 Cohen et al.
2004/0219040 A1 11/2004 Kugelev et al.
2005/0051322 A1 3/2005 Speer
2005/0056081 A1 3/2005 Gocho
2005/0139286 A1 6/2005 Poulter
2005/0196298 A1 9/2005 Manning
2005/0226754 A1 10/2005 Orr et al.
2005/0274134 A1 12/2005 Ryu et al.
2006/0061091 A1 3/2006 Osterloh
2006/0062914 A1 3/2006 Garg et al.
2006/0196251 A1 9/2006 Richey
2006/0211356 A1 9/2006 Grassman
2006/0228225 A1 10/2006 Rogers
2006/0260331 A1 11/2006 Andreychuk
2006/0272333 A1 12/2006 Sundin
2007/0029090 A1 2/2007 Andreychuk et al.
2007/0041848 A1 2/2007 Wood et al.
2007/0066406 A1 3/2007 Keller et al.
2007/0098580 A1* 5/2007 Petersen ..... F04B 1/0408 417/491
2007/0107981 A1 5/2007 Sicotte
2007/0125544 A1 6/2007 Robinson et al.
2007/0169543 A1 7/2007 Fazekas
2007/0181212 A1 8/2007 Fell
2007/0277982 A1 12/2007 Shampine et al.
2007/0295569 A1 12/2007 Manzoor et al.
2008/0006089 A1 1/2008 Adnan et al.
2008/0098891 A1 5/2008 Feher
2008/0161974 A1 7/2008 Alston
2008/0212275 A1 9/2008 Waryck et al.
2008/0229757 A1 9/2008 Alexander et al.
2008/0264625 A1 10/2008 Ochoa
2008/0264649 A1 10/2008 Crawford
2008/0298982 A1* 12/2008 Pabst ..... B60T 8/368 417/273
2009/0064685 A1 3/2009 Busekros et al.
2009/0068031 A1 3/2009 Gambier et al.
2009/0092510 A1 4/2009 Williams et al.
2009/0124191 A1 5/2009 Van Becelaere et al.
2009/0178412 A1 7/2009 Spytek
2009/0212630 A1 8/2009 Flegel et al.
2009/0249794 A1 10/2009 Wilkes et al.
2009/0252616 A1 10/2009 Brunet et al.
2009/0308602 A1 12/2009 Bruins et al.
2010/0019626 A1 1/2010 Stout et al.
2010/0071899 A1 3/2010 Coquilleau et al.
2010/0218508 A1 9/2010 Brown et al.
2010/0300683 A1 12/2010 Looper et al.
2010/0310384 A1 12/2010 Stephenson et al.
2011/0041681 A1* 2/2011 Duerr ..... F04B 1/063 91/472
2011/0052423 A1 3/2011 Gambier et al.
2011/0054704 A1 3/2011 Karpman et al.
2011/0085924 A1 4/2011 Shampine et al.
2011/0146244 A1 6/2011 Farman et al.
2011/0146246 A1 6/2011 Farman et al.
2011/0173991 A1 7/2011 Dean
2011/0197988 A1 8/2011 Van Vliet et al.
2011/0241888 A1 10/2011 Lu et al.
2011/0265443 A1 11/2011 Ansari
2011/0272158 A1 11/2011 Neal
2012/0023973 A1* 2/2012 Mayorca ..... F04B 39/0022 92/61
2012/0048242 A1 3/2012 Sumilla et al.
2012/0085541 A1 4/2012 Love et al.
2012/0137699 A1 6/2012 Montagne et al.
2012/0179444 A1 7/2012 Ganguly et al.
2012/0192542 A1 8/2012 Chillar et al.
2012/0199001 A1 8/2012 Chillar et al.
2012/0204627 A1 8/2012 Anderl et al.
2012/0255734 A1 10/2012 Coli et al.
2012/0310509 A1 12/2012 Pardo et al.
2012/0324903 A1 12/2012 Dewis et al.
2013/0068307 A1 3/2013 Hains et al.
2013/0087045 A1 4/2013 Sullivan et al.
2013/0087945 A1 4/2013 Kusters et al.
2013/0134702 A1 5/2013 Boraas et al.
2013/0189915 A1 7/2013 Hazard
2013/0205798 A1 8/2013 Kwok et al.
2013/0233165 A1 9/2013 Matzner et al.
2013/0255953 A1 10/2013 Tudor
2013/0259707 A1 10/2013 Yin
2013/0284455 A1 10/2013 Kajaria et al.
2013/0300341 A1 11/2013 Gillette
2013/0306322 A1 11/2013 Sanborn
2014/0000668 A1 1/2014 Essard
2014/0010671 A1 1/2014 Cryer et al.
2014/0013768 A1 1/2014 Laing et al.
2014/0032082 A1 1/2014 Gehrke et al.
2014/0044517 A1 2/2014 Saha et al.
2014/0048253 A1 2/2014 Andreychuk
2014/0090729 A1 4/2014 Coulter et al.
2014/0090742 A1 4/2014 Coskrey et al.
2014/0094105 A1 4/2014 Lundh et al.

(56) References Cited

U.S. PATENT DOCUMENTS

2014/0095114 A1 4/2014 Thomeer et al.
2014/0095554 A1 4/2014 Thomeer et al.
2014/0123621 A1 5/2014 Driessens et al.
2014/0130422 A1 5/2014 Laing et al.
2014/0138079 A1 5/2014 Broussard et al.
2014/0144641 A1 5/2014 Chandler
2014/0147291 A1 5/2014 Burnette
2014/0158345 A1 6/2014 Jang et al.
2014/0174097 A1 6/2014 Hammer et al.
2014/0196459 A1 7/2014 Futa et al.
2014/0216736 A1 8/2014 Eugemors et al.
2014/0219824 A1 8/2014 Burnette
2014/0250845 A1 9/2014 Jackson et al.
2014/0251623 A1 9/2014 Lestz et al.
2014/0277772 A1 9/2014 Lopez et al.
2014/0290266 A1 10/2014 Veilleux, Jr. et al.
2014/0318638 A1 10/2014 Harwood et al.
2014/0322050 A1 10/2014 Marette et al.
2015/0027730 A1 1/2015 Hall et al.
2015/0078924 A1 3/2015 Zhang et al.
2015/0101344 A1 4/2015 Jarrier et al.
2015/0114652 A1 4/2015 Lestz et al.
2015/0129210 A1 5/2015 Chong et al.
2015/0135659 A1 5/2015 Jarrier et al.
2015/0159553 A1 6/2015 Kippel et al.
2015/0192117 A1 7/2015 Bridges
2015/0204148 A1 7/2015 Liu et al.
2015/0204322 A1 7/2015 Iund et al.
2015/0211512 A1 7/2015 Wiegman et al.
2015/0214816 A1 7/2015 Raad
2015/0217672 A1 8/2015 Shampine et al.
2015/0226140 A1 8/2015 Zhang et al.
2015/0252661 A1 9/2015 Glass
2015/0275891 A1 10/2015 Chong et al.
2015/0337730 A1 11/2015 Kupiszewski et al.
2015/0340864 A1 11/2015 Compton
2015/0345385 A1 12/2015 Santini
2015/0369351 A1 12/2015 Hermann et al.
2016/0032703 A1 2/2016 Broussard et al.
2016/0032836 A1 2/2016 Hawkinson et al.
2016/0076447 A1 3/2016 Merlo et al.
2016/0102581 A1 4/2016 Del Bono
2016/0105022 A1 4/2016 Oehring et al.
2016/0108713 A1 4/2016 Dunaeva et al.
2016/0123185 A1 5/2016 Le Pache et al.
2016/0168979 A1 6/2016 Zhang et al.
2016/0177675 A1 6/2016 Morris et al.
2016/0177945 A1* 6/2016 Byrne ..... F04B 53/18 184/6
2016/0186671 A1 6/2016 Austin et al.
2016/0195082 A1 7/2016 Wiegman et al.
2016/0215774 A1 7/2016 Oklejas et al.
2016/0230525 A1 8/2016 Lestz et al.
2016/0244314 A1 8/2016 Van Vliet et al.
2016/0248230 A1 8/2016 Tawy et al.
2016/0253634 A1 9/2016 Thomeer et al.
2016/0258267 A1 9/2016 Payne et al.
2016/0273328 A1 9/2016 Oehring
2016/0273346 A1 9/2016 Tang et al.
2016/0290114 A1 10/2016 Oehring et al.
2016/0319650 A1 11/2016 Oehring et al.
2016/0326845 A1 11/2016 Djikpesse et al.
2016/0348479 A1 12/2016 Oehring et al.
2016/0369609 A1 12/2016 Morris et al.
2017/0009905 A1 1/2017 Arnold
2017/0016433 A1 1/2017 Chong et al.
2017/0030177 A1 2/2017 Oehring et al.
2017/0038137 A1 2/2017 Turney
2017/0045055 A1 2/2017 Hoefel et al.
2017/0052087 A1 2/2017 Faqihi et al.
2017/0074074 A1 3/2017 Joseph et al.
2017/0074076 A1 3/2017 Joseph et al.
2017/0074089 A1 3/2017 Agarwal et al.
2017/0082110 A1 3/2017 Lammers
2017/0089189 A1 3/2017 Norris et al.
2017/0114613 A1 4/2017 Lecerf et al.
2017/0114625 A1 4/2017 Norris et al.
2017/0122310 A1 5/2017 Ladron de Guevara
2017/0131174 A1 5/2017 Enev et al.
2017/0145918 A1 5/2017 Oehring et al.
2017/0191350 A1 7/2017 Johns et al.
2017/0218727 A1 8/2017 Oehring et al.
2017/0226839 A1 8/2017 Broussard et al.
2017/0226842 A1 8/2017 Omont et al.
2017/0226998 A1 8/2017 Zhang et al.
2017/0227002 A1 8/2017 Mikulski et al.
2017/0233103 A1 8/2017 Teicholz et al.
2017/0234165 A1 8/2017 Kersey et al.
2017/0234308 A1 8/2017 Buckley
2017/0241336 A1 8/2017 Jones et al.
2017/0241671 A1 8/2017 Ahmad
2017/0248034 A1 8/2017 Dzieciol et al.
2017/0248208 A1 8/2017 Tamura
2017/0248308 A1 8/2017 Makarychev-Mikhailov et al.
2017/0275149 A1 9/2017 Schmidt
2017/0288400 A1 10/2017 Williams
2017/0292409 A1 10/2017 Aguilar et al.
2017/0302135 A1 10/2017 Cory
2017/0305736 A1 10/2017 Haile et al.
2017/0306847 A1 10/2017 Suciu et al.
2017/0306936 A1* 10/2017 Dole ..... F04B 1/0536
2017/0322086 A1 11/2017 Luharuka et al.
2017/0333086 A1 11/2017 Jackson
2017/0334448 A1 11/2017 Schwunk
2017/0335842 A1 11/2017 Robinson et al.
2017/0350471 A1 12/2017 Steidl et al.
2017/0356470 A1 12/2017 Jaffrey
2017/0370199 A1 12/2017 Witkowski et al.
2017/0370480 A1 12/2017 Witkowski et al.
2018/0034280 A1 2/2018 Pedersen
2018/0038328 A1 2/2018 Louven et al.
2018/0041093 A1 2/2018 Miranda
2018/0045202 A1 2/2018 Crom
2018/0038216 A1 3/2018 Zhang et al.
2018/0058171 A1 3/2018 Roesner et al.
2018/0087499 A1 3/2018 Zhang et al.
2018/0087996 A1 3/2018 De La Cruz
2018/0156210 A1 6/2018 Oehring et al.
2018/0172294 A1 6/2018 Owen
2018/0183219 A1 6/2018 Oehring et al.
2018/0186442 A1 7/2018 Maier
2018/0187662 A1 7/2018 Hill et al.
2018/0209415 A1 7/2018 Zhang et al.
2018/0223640 A1 8/2018 Keihany et al.
2018/0224044 A1 8/2018 Penney
2018/0229998 A1 8/2018 Shock
2018/0258746 A1 9/2018 Broussard et al.
2018/0266412 A1 9/2018 Stokkevag et al.
2018/0278124 A1 9/2018 Oehring et al.
2018/0283102 A1 10/2018 Cook
2018/0283618 A1 10/2018 Cook
2018/0284817 A1 10/2018 Cook et al.
2018/0290877 A1 10/2018 Shock
2018/0291781 A1 10/2018 Pedrini
2018/0298731 A1 10/2018 Bishop
2018/0298735 A1 10/2018 Conrad
2018/0307255 A1 10/2018 Bishop
2018/0313456 A1 11/2018 Bayyouk et al.
2018/0328157 A1 11/2018 Bishop
2018/0334893 A1 11/2018 Oehring
2018/0363435 A1 12/2018 Coli et al.
2018/0363436 A1 12/2018 Coli et al.
2018/0363437 A1 12/2018 Coli et al.
2018/0363438 A1 12/2018 Coli et al.
2019/0003272 A1 1/2019 Morris et al.
2019/0003329 A1 1/2019 Morris et al.
2019/0010793 A1 1/2019 Hinderliter
2019/0011051 A1 1/2019 Yeung
2019/0048993 A1 2/2019 Akiyama et al.
2019/0063263 A1 2/2019 Davis et al.
2019/0063341 A1 2/2019 Davis
2019/0067991 A1 2/2019 Davis et al.
2019/0071992 A1 3/2019 Feng
2019/0072005 A1 3/2019 Fisher et al.

(56) References Cited

U.S. PATENT DOCUMENTS

2019/0078471 A1 3/2019 Braglia et al.
2019/0088845 A1 3/2019 Sugi et al.
2019/0091619 A1 3/2019 Huang
2019/0106316 A1 4/2019 Van Vliet et al.
2019/0106970 A1 4/2019 Oehring
2019/0112908 A1 4/2019 Coli et al.
2019/0112910 A1 4/2019 Oehring et al.
2019/0119096 A1 4/2019 Haile et al.
2019/0120024 A1 4/2019 Oehring et al.
2019/0120031 A1 4/2019 Gilje
2019/0120134 A1 4/2019 Goleczka et al.
2019/0128247 A1 5/2019 Douglas, III
2019/0128288 A1 5/2019 Konada et al.
2019/0131607 A1 5/2019 Gillette
2019/0136677 A1 5/2019 Shampine et al.
2019/0153843 A1 5/2019 Headrick
2019/0153938 A1 5/2019 Hammoud
2019/0154020 A1 5/2019 Glass
2019/0155318 A1 5/2019 Meunier
2019/0264667 A1 5/2019 Byrne
2019/0178234 A1 6/2019 Beisel
2019/0178235 A1 6/2019 Coskrey et al.
2019/0185312 A1 6/2019 Bush et al.
2019/0203572 A1 7/2019 Morris et al.
2019/0204021 A1 7/2019 Morris et al.
2019/0211661 A1 7/2019 Reckles et al.
2019/0211814 A1 7/2019 Weightman et al.
2019/0217258 A1 7/2019 Bishop
2019/0226317 A1 7/2019 Payne et al.
2019/0245348 A1 8/2019 Hinderliter et al.
2019/0249652 A1 8/2019 Stephenson et al.
2019/0249754 A1 8/2019 Oehring et al.
2019/0257297 A1 8/2019 Botting et al.
2019/0277279 A1 9/2019 Byrne et al.
2019/0277295 A1 9/2019 Clyburn et al.
2019/0309585 A1 10/2019 Miller et al.
2019/0316447 A1 10/2019 Oehring et al.
2019/0316456 A1 10/2019 Beisel et al.
2019/0323337 A1 10/2019 Glass et al.
2019/0330923 A1 10/2019 Gable et al.
2019/0331117 A1 10/2019 Gable et al.
2019/0337392 A1 11/2019 Joshi et al.
2019/0338762 A1 11/2019 Curry et al.
2019/0345920 A1 11/2019 Surjaatmadja et al.
2019/0353103 A1 11/2019 Roberge
2019/0356199 A1 11/2019 Morris et al.
2019/0376449 A1 12/2019 Carrell
2019/0383123 A1 12/2019 Hinderliter
2020/0003205 A1 1/2020 Stokkevåg et al.
2020/0011165 A1 1/2020 George et al.
2020/0040878 A1 2/2020 Morris
2020/0049136 A1 2/2020 Stephenson
2020/0049153 A1 2/2020 Headrick et al.
2020/0071998 A1 3/2020 Oehring et al.
2020/0072201 A1 3/2020 Marica
2020/0088202 A1 3/2020 Sigmar et al.
2020/0095854 A1 3/2020 Hinderliter
2020/0109610 A1 4/2020 Husoy et al.
2020/0109616 A1 4/2020 Oehring et al.
2020/0132058 A1 4/2020 Mollatt
2020/0141219 A1 5/2020 Oehring et al.
2020/0141326 A1 5/2020 Redford et al.
2020/0141907 A1 5/2020 Meck et al.
2020/0166026 A1 5/2020 Marica
2020/0206704 A1 7/2020 Chong
2020/0208733 A1 7/2020 Kim
2020/0223648 A1 7/2020 Herman et al.
2020/0224645 A1 7/2020 Buckley
2020/0232454 A1 7/2020 Chretien et al.
2020/0256333 A1 8/2020 Surjaatmadja
2020/0263498 A1 8/2020 Fischer et al.
2020/0263525 A1 8/2020 Reid
2020/0263526 A1 8/2020 Fischer et al.
2020/0263527 A1 8/2020 Fischer et al.
2020/0263528 A1 8/2020 Fischer et al.
2020/0267888 A1 8/2020 Putz
2020/0291731 A1 9/2020 Haiderer et al.
2020/0295574 A1 9/2020 Batsch-Smith
2020/0300050 A1 9/2020 Oehring et al.
2020/0309027 A1 10/2020 Rytkonen
2020/0309113 A1 10/2020 Hunter et al.
2020/0325752 A1 10/2020 Clark et al.
2020/0325760 A1 10/2020 Markham
2020/0325761 A1 10/2020 Williams
2020/0325791 A1 10/2020 Himmelmann
2020/0325893 A1 10/2020 Kraige et al.
2020/0332784 A1 10/2020 Zhang et al.
2020/0332788 A1 10/2020 Cui et al.
2020/0340313 A1 10/2020 Fischer et al.
2020/0340340 A1 10/2020 Oehring et al.
2020/0340344 A1 10/2020 Reckels et al.
2020/0340404 A1 10/2020 Stockstill
2020/0347725 A1 11/2020 Morris et al.
2020/0354928 A1 11/2020 Wehler et al.
2020/0355055 A1 11/2020 Dusterhoft et al.
2020/0362760 A1 11/2020 Morenko et al.
2020/0362764 A1 11/2020 Saintignan et al.
2020/0370394 A1 11/2020 Cai et al.
2020/0370408 A1 11/2020 Cai et al.
2020/0370429 A1 11/2020 Cai et al.
2020/0371490 A1 11/2020 Cai et al.
2020/0340322 A1 12/2020 Sizemore et al.
2020/0386169 A1 12/2020 Hinderliter et al.
2020/0386222 A1 12/2020 Pham et al.
2020/0388140 A1 12/2020 Gomez et al.
2020/0392826 A1 12/2020 Cui et al.
2020/0392827 A1 12/2020 George et al.
2020/0393088 A1 12/2020 Sizemore et al.
2020/0398238 A1 12/2020 Zhong et al.
2020/0400000 A1 12/2020 Ghasripoor et al.
2020/0400005 A1 12/2020 Han et al.
2020/0407625 A1 12/2020 Stephenson
2020/0408071 A1 12/2020 Li et al.
2020/0408144 A1 12/2020 Feng et al.
2020/0408147 A1 12/2020 Zhang et al.
2020/0408149 A1 12/2020 Li et al.
2021/0025324 A1 1/2021 Morris et al.
2021/0025383 A1 1/2021 Bodishbaugh et al.
2021/0032961 A1 2/2021 Hinderliter et al.
2021/0054727 A1 2/2021 Floyd
2021/0071503 A1 3/2021 Ogg et al.
2021/0071574 A1 3/2021 Feng et al.
2021/0071579 A1 3/2021 Li et al.
2021/0071654 A1 3/2021 Brunson
2021/0071752 A1 3/2021 Cui et al.
2021/0079758 A1 3/2021 Yeung et al.
2021/0079851 A1 3/2021 Yeung et al.
2021/0086851 A1 3/2021 Zhang et al.
2021/0087883 A1 3/2021 Zhang et al.
2021/0087916 A1 3/2021 Zhang et al.
2021/0087925 A1 3/2021 Heidari et al.
2021/0087943 A1 3/2021 Cui et al.
2021/0088042 A1 3/2021 Zhang et al.
2021/0123425 A1 4/2021 Cui et al.
2021/0123434 A1* 4/2021 Cui ..... F04B 9/045
2021/0123435 A1 4/2021 Cui et al.
2021/0131409 A1 5/2021 Cui et al.
2021/0140416 A1 5/2021 Buckley
2021/0148208 A1 5/2021 Thomas et al.
2021/0156240 A1 5/2021 Cicci et al.
2021/0156241 A1 5/2021 Cook
2021/0172282 A1 6/2021 Wang et al.
2021/0180517 A1 6/2021 Zhou et al.
2021/0190045 A1 6/2021 Zhang et al.
2021/0199110 A1 7/2021 Albert et al.
2021/0222690 A1 7/2021 Beisel
2021/0239112 A1* 8/2021 Buckley ..... F04B 1/22
2021/0246774 A1 8/2021 Cui et al.
2021/0270261 A1 9/2021 Zhang et al.
2021/0270264 A1* 9/2021 Byrne ..... F16C 43/04
2021/0285311 A1 9/2021 Ji et al.
2021/0285432 A1 9/2021 Ji et al.
2021/0301807 A1* 9/2021 Cui ..... F04B 9/045
2021/0306720 A1 9/2021 Sandoval et al.

(56) References Cited

U.S. PATENT DOCUMENTS

| | | | |
|---|---|---|---|
| 2021/0308638 | A1 | 10/2021 | Zhong et al. |
| 2021/0324718 | A1 | 10/2021 | Anders |
| 2021/0348475 | A1 | 11/2021 | Yeung et al. |
| 2021/0348476 | A1 | 11/2021 | Yeung et al. |
| 2021/0348477 | A1 | 11/2021 | Yeung et al. |
| 2021/0355927 | A1 | 11/2021 | Jian et al. |
| 2021/0372394 | A1 | 12/2021 | Bagulayan et al. |
| 2021/0372395 | A1 | 12/2021 | Li et al. |
| 2021/0376413 | A1 | 12/2021 | Asfha |
| 2021/0388760 | A1 | 12/2021 | Feng et al. |
| 2022/0082007 | A1 | 3/2022 | Zhang et al. |
| 2022/0090476 | A1 | 3/2022 | Zhang et al. |
| 2022/0090477 | A1 | 3/2022 | Zhang et al. |
| 2022/0090478 | A1 | 3/2022 | Zhang et al. |
| 2022/0112892 | A1 | 4/2022 | Cui et al. |
| 2022/0120262 | A1 | 4/2022 | Ji et al. |
| 2022/0145740 | A1 | 5/2022 | Yuan et al. |
| 2022/0154775 | A1 | 5/2022 | Liu et al. |
| 2022/0155373 | A1 | 5/2022 | Liu et al. |
| 2022/0162931 | A1 | 5/2022 | Zhong et al. |
| 2022/0162991 | A1 | 5/2022 | Zhang et al. |
| 2022/0181859 | A1 | 6/2022 | Ji et al. |
| 2022/0186724 | A1 | 6/2022 | Chang et al. |
| 2022/0213777 | A1 | 7/2022 | Cui et al. |
| 2022/0220836 | A1 | 7/2022 | Zhang et al. |
| 2022/0224087 | A1 | 7/2022 | Ji et al. |
| 2022/0228468 | A1 | 7/2022 | Cui et al. |
| 2022/0228469 | A1 | 7/2022 | Zhang et al. |
| 2022/0235639 | A1 | 7/2022 | Zhang et al. |
| 2022/0235640 | A1 | 7/2022 | Mao et al. |
| 2022/0235641 | A1 | 7/2022 | Zhang et al. |
| 2022/0235642 | A1 | 7/2022 | Zhang et al. |
| 2022/0235802 | A1 | 7/2022 | Jiang et al. |
| 2022/0242297 | A1 | 8/2022 | Tian et al. |
| 2022/0243613 | A1 | 8/2022 | Ji et al. |
| 2022/0243724 | A1 | 8/2022 | Li et al. |
| 2022/0250000 | A1 | 8/2022 | Zhang et al. |
| 2022/0255319 | A1 | 8/2022 | Liu et al. |
| 2022/0258659 | A1 | 8/2022 | Cui et al. |
| 2022/0259947 | A1 | 8/2022 | Li et al. |
| 2022/0259964 | A1 | 8/2022 | Zhang et al. |
| 2022/0268201 | A1 | 8/2022 | Feng et al. |
| 2022/0282606 | A1 | 9/2022 | Zhong et al. |
| 2022/0282726 | A1 | 9/2022 | Zhang et al. |
| 2022/0290549 | A1 | 9/2022 | Zhang et al. |
| 2022/0294194 | A1 | 9/2022 | Cao et al. |
| 2022/0298906 | A1 | 9/2022 | Zhong et al. |
| 2022/0307359 | A1 | 9/2022 | Liu et al. |
| 2022/0307424 | A1 | 9/2022 | Wang et al. |
| 2022/0314248 | A1 | 10/2022 | Ge et al. |
| 2022/0315347 | A1 | 10/2022 | Liu et al. |
| 2022/0316306 | A1 | 10/2022 | Liu et al. |
| 2022/0316362 | A1 | 10/2022 | Zhang et al. |
| 2022/0316461 | A1 | 10/2022 | Wang et al. |
| 2022/0325608 | A1 | 10/2022 | Zhang et al. |
| 2022/0330411 | A1 | 10/2022 | Liu et al. |
| 2022/0333471 | A1 | 10/2022 | Zhong et al. |
| 2022/0339646 | A1 | 10/2022 | Yu et al. |
| 2022/0341358 | A1 | 10/2022 | Ji et al. |
| 2022/0341362 | A1 | 10/2022 | Feng et al. |
| 2022/0341415 | A1 | 10/2022 | Deng et al. |
| 2022/0345007 | A1 | 10/2022 | Liu et al. |
| 2022/0349345 | A1 | 11/2022 | Zhang et al. |
| 2022/0353980 | A1 | 11/2022 | Liu et al. |
| 2022/0361309 | A1 | 11/2022 | Liu et al. |
| 2022/0364452 | A1 | 11/2022 | Wang et al. |
| 2022/0364453 | A1 | 11/2022 | Chang et al. |
| 2022/0372865 | A1 | 11/2022 | Lin et al. |
| 2022/0376280 | A1 | 11/2022 | Shao et al. |
| 2022/0381126 | A1 | 12/2022 | Cui et al. |
| 2022/0389799 | A1 | 12/2022 | Mao |
| 2022/0389803 | A1 | 12/2022 | Zhang et al. |
| 2022/0389804 | A1 | 12/2022 | Cui et al. |
| 2022/0389865 | A1 | 12/2022 | Feng et al. |
| 2022/0389867 | A1 | 12/2022 | Li et al. |
| 2022/0412196 | A1 | 12/2022 | Cui et al. |
| 2022/0412199 | A1 | 12/2022 | Mao et al. |
| 2022/0412200 | A1 | 12/2022 | Zhang et al. |
| 2022/0412258 | A1 | 12/2022 | Li et al. |
| 2022/0412379 | A1 | 12/2022 | Wang et al. |
| 2023/0001524 | A1 | 1/2023 | Jiang et al. |
| 2023/0003238 | A1 | 1/2023 | Du et al. |
| 2023/0015132 | A1 | 1/2023 | Feng et al. |
| 2023/0015529 | A1 | 1/2023 | Zhang et al. |
| 2023/0015581 | A1 | 1/2023 | Ji et al. |
| 2023/0017968 | A1 | 1/2023 | Deng et al. |
| 2023/0029574 | A1 | 2/2023 | Zhang et al. |
| 2023/0029671 | A1 | 2/2023 | Han et al. |
| 2023/0036118 | A1 | 2/2023 | Xing et al. |
| 2023/0040970 | A1 | 2/2023 | Liu et al. |
| 2023/0042379 | A1 | 2/2023 | Zhang et al. |
| 2023/0047033 | A1 | 2/2023 | Fu et al. |
| 2023/0048551 | A1 | 2/2023 | Feng et al. |
| 2023/0049462 | A1 | 2/2023 | Zhang et al. |
| 2023/0064964 | A1 | 3/2023 | Wang et al. |
| 2023/0074794 | A1 | 3/2023 | Liu et al. |
| 2023/0085124 | A1 | 3/2023 | Zhong et al. |
| 2023/0092506 | A1 | 3/2023 | Zhong et al. |
| 2023/0092705 | A1 | 3/2023 | Liu et al. |
| 2023/0106683 | A1 | 4/2023 | Zhang et al. |
| 2023/0107300 | A1 | 4/2023 | Huang et al. |
| 2023/0107791 | A1 | 4/2023 | Zhang et al. |
| 2023/0109018 | A1 | 4/2023 | Du et al. |
| 2023/0116458 | A1 | 4/2023 | Liu et al. |
| 2023/0117362 | A1 | 4/2023 | Zhang et al. |
| 2023/0119725 | A1 | 4/2023 | Wang et al. |
| 2023/0119876 | A1 | 4/2023 | Mao et al. |
| 2023/0119896 | A1 | 4/2023 | Zhang et al. |
| 2023/0120810 | A1 | 4/2023 | Fu et al. |
| 2023/0121251 | A1 | 4/2023 | Cui et al. |
| 2023/0124444 | A1 | 4/2023 | Chang et al. |
| 2023/0138582 | A1 | 5/2023 | Li et al. |
| 2023/0144116 | A1 | 5/2023 | Li et al. |
| 2023/0145963 | A1 | 5/2023 | Zhang et al. |
| 2023/0151722 | A1 | 5/2023 | Cui et al. |
| 2023/0151723 | A1 | 5/2023 | Ji et al. |
| 2023/0152793 | A1 | 5/2023 | Wang et al. |
| 2023/0160289 | A1 | 5/2023 | Cui et al. |
| 2023/0160510 | A1 | 5/2023 | Bao et al. |
| 2023/0163580 | A1 | 5/2023 | Ji et al. |
| 2023/0167776 | A1 | 6/2023 | Cui et al. |

FOREIGN PATENT DOCUMENTS

| | | | |
|---|---|---|---|
| CA | 2043184 | | 8/1994 |
| CA | 2829762 | | 9/2012 |
| CA | 2737321 | | 9/2013 |
| CA | 2876687 | A1 | 5/2014 |
| CA | 2693567 | | 9/2014 |
| CA | 2964597 | | 10/2017 |
| CA | 2876687 | C | 4/2019 |
| CA | 3138533 | | 11/2020 |
| CA | 2919175 | | 3/2021 |
| CN | 2622404 | | 6/2004 |
| CN | 2779054 | | 5/2006 |
| CN | 2890325 | | 4/2007 |
| CN | 200964929 | Y | 10/2007 |
| CN | 101323151 | A | 12/2008 |
| CN | 201190660 | Y | 2/2009 |
| CN | 201190892 | Y | 2/2009 |
| CN | 201190893 | Y | 2/2009 |
| CN | 101414171 | A | 4/2009 |
| CN | 201215073 | Y | 4/2009 |
| CN | 201236650 | Y | 5/2009 |
| CN | 201275542 | Y | 7/2009 |
| CN | 201275801 | Y | 7/2009 |
| CN | 201333385 | Y | 10/2009 |
| CN | 201443300 | U | 4/2010 |
| CN | 201496415 | U | 6/2010 |
| CN | 201501365 | U | 6/2010 |
| CN | 201507271 | U | 6/2010 |
| CN | 101323151 | B | 7/2010 |
| CN | 201560210 | U | 8/2010 |
| CN | 201581862 | U | 9/2010 |

(56) References Cited

FOREIGN PATENT DOCUMENTS

| | | | |
|---|---|---|---|
| CN | 201610728 | U | 10/2010 |
| CN | 201610751 | U | 10/2010 |
| CN | 201618530 | U | 11/2010 |
| CN | 201661255 | U | 12/2010 |
| CN | 101949382 | | 1/2011 |
| CN | 201756927 | U | 3/2011 |
| CN | 101414171 | B | 5/2011 |
| CN | 102128011 | A | 7/2011 |
| CN | 102140898 | A | 8/2011 |
| CN | 102155172 | A | 8/2011 |
| CN | 102182904 | | 9/2011 |
| CN | 202000930 | U | 10/2011 |
| CN | 202055781 | U | 11/2011 |
| CN | 202082265 | U | 12/2011 |
| CN | 202100216 | U | 1/2012 |
| CN | 202100217 | U | 1/2012 |
| CN | 202100815 | U | 1/2012 |
| CN | 202124340 | U | 1/2012 |
| CN | 202140051 | U | 2/2012 |
| CN | 202140080 | U | 2/2012 |
| CN | 202144789 | U | 2/2012 |
| CN | 202144943 | U | 2/2012 |
| CN | 202149354 | U | 2/2012 |
| CN | 102383748 | A | 3/2012 |
| CN | 202156297 | U | 3/2012 |
| CN | 202158355 | U | 3/2012 |
| CN | 202163504 | U | 3/2012 |
| CN | 202165236 | U | 3/2012 |
| CN | 202180866 | U | 4/2012 |
| CN | 202181875 | U | 4/2012 |
| CN | 202187744 | U | 4/2012 |
| CN | 202191854 | U | 4/2012 |
| CN | 202250008 | U | 5/2012 |
| CN | 101885307 | | 7/2012 |
| CN | 102562020 | A | 7/2012 |
| CN | 202326156 | U | 7/2012 |
| CN | 202370773 | U | 8/2012 |
| CN | 202417397 | U | 9/2012 |
| CN | 202417461 | U | 9/2012 |
| CN | 102729335 | A | 10/2012 |
| CN | 202463955 | U | 10/2012 |
| CN | 202463957 | U | 10/2012 |
| CN | 202467739 | U | 10/2012 |
| CN | 202467801 | U | 10/2012 |
| CN | 202531016 | U | 11/2012 |
| CN | 202544794 | U | 11/2012 |
| CN | 102825039 | A | 12/2012 |
| CN | 202578592 | U | 12/2012 |
| CN | 202579164 | U | 12/2012 |
| CN | 202594808 | U | 12/2012 |
| CN | 202594928 | U | 12/2012 |
| CN | 202596615 | U | 12/2012 |
| CN | 202596616 | U | 12/2012 |
| CN | 102849880 | A | 1/2013 |
| CN | 102889191 | A | 1/2013 |
| CN | 202641535 | U | 1/2013 |
| CN | 202645475 | U | 1/2013 |
| CN | 202666716 | U | 1/2013 |
| CN | 202669645 | U | 1/2013 |
| CN | 202669944 | U | 1/2013 |
| CN | 202671336 | U | 1/2013 |
| CN | 202673269 | U | 1/2013 |
| CN | 202751982 | U | 2/2013 |
| CN | 102963629 | A | 3/2013 |
| CN | 202767964 | U | 3/2013 |
| CN | 202789791 | U | 3/2013 |
| CN | 202789792 | U | 3/2013 |
| CN | 202810717 | U | 3/2013 |
| CN | 202827276 | U | 3/2013 |
| CN | 202833093 | U | 3/2013 |
| CN | 202833370 | U | 3/2013 |
| CN | 102140898 | B | 4/2013 |
| CN | 202895467 | U | 4/2013 |
| CN | 202926404 | U | 5/2013 |
| CN | 202935216 | U | 5/2013 |
| CN | 202935798 | U | 5/2013 |
| CN | 202935816 | U | 5/2013 |
| CN | 202970631 | U | 6/2013 |
| CN | 103223315 | A | 7/2013 |
| CN | 203050598 | U | 7/2013 |
| CN | 103233714 | A | 8/2013 |
| CN | 103233715 | A | 8/2013 |
| CN | 103245523 | A | 8/2013 |
| CN | 103247220 | A | 8/2013 |
| CN | 103253839 | A | 8/2013 |
| CN | 103277290 | A | 9/2013 |
| CN | 103321782 | A | 9/2013 |
| CN | 203170270 | U | 9/2013 |
| CN | 203172509 | U | 9/2013 |
| CN | 203175778 | U | 9/2013 |
| CN | 203175787 | U | 9/2013 |
| CN | 102849880 | B | 10/2013 |
| CN | 203241231 | U | 10/2013 |
| CN | 203244941 | U | 10/2013 |
| CN | 203244942 | U | 10/2013 |
| CN | 203303798 | U | 11/2013 |
| CN | 102155172 | B | 12/2013 |
| CN | 102729335 | B | 12/2013 |
| CN | 103420532 | A | 12/2013 |
| CN | 203321792 | U | 12/2013 |
| CN | 203412658 | | 1/2014 |
| CN | 203420697 | U | 2/2014 |
| CN | 203480755 | U | 3/2014 |
| CN | 103711437 | A | 4/2014 |
| CN | 203531815 | U | 4/2014 |
| CN | 203531871 | U | 4/2014 |
| CN | 203531883 | U | 4/2014 |
| CN | 203556164 | U | 4/2014 |
| CN | 203558809 | U | 4/2014 |
| CN | 203559861 | U | 4/2014 |
| CN | 203559893 | U | 4/2014 |
| CN | 203560189 | U | 4/2014 |
| CN | 102704870 | B | 5/2014 |
| CN | 203611843 | U | 5/2014 |
| CN | 203612531 | U | 5/2014 |
| CN | 203612843 | U | 5/2014 |
| CN | 203614062 | U | 5/2014 |
| CN | 203614388 | U | 5/2014 |
| CN | 203621045 | U | 6/2014 |
| CN | 203621046 | U | 6/2014 |
| CN | 203621051 | U | 6/2014 |
| CN | 203640993 | U | 6/2014 |
| CN | 203655221 | U | 6/2014 |
| CN | 103899280 | A | 7/2014 |
| CN | 103923670 | A | 7/2014 |
| CN | 203685052 | U | 7/2014 |
| CN | 203716936 | U | 7/2014 |
| CN | 103990410 | A | 8/2014 |
| CN | 103993869 | A | 8/2014 |
| CN | 203754009 | U | 8/2014 |
| CN | 203754025 | U | 8/2014 |
| CN | 203754341 | U | 8/2014 |
| CN | 203756614 | U | 8/2014 |
| CN | 203770264 | U | 8/2014 |
| CN | 203784519 | U | 8/2014 |
| CN | 203784520 | U | 8/2014 |
| CN | 104057864 | A | 9/2014 |
| CN | 203819819 | U | 9/2014 |
| CN | 203823431 | U | 9/2014 |
| CN | 203835337 | U | 9/2014 |
| CN | 104074500 | A | 10/2014 |
| CN | 203876633 | U | 10/2014 |
| CN | 203876636 | U | 10/2014 |
| CN | 203877364 | U | 10/2014 |
| CN | 203877365 | U | 10/2014 |
| CN | 203877375 | U | 10/2014 |
| CN | 203877424 | U | 10/2014 |
| CN | 203879476 | U | 10/2014 |
| CN | 203879479 | U | 10/2014 |
| CN | 203890292 | U | 10/2014 |
| CN | 203899476 | U | 10/2014 |
| CN | 203906206 | U | 10/2014 |
| CN | 104150728 | A | 11/2014 |
| CN | 104176522 | A | 12/2014 |

(56) References Cited

FOREIGN PATENT DOCUMENTS

| | | | |
|---|---|---|---|
| CN | 104196464 | A | 12/2014 |
| CN | 203971841 | U | 12/2014 |
| CN | 203975450 | U | 12/2014 |
| CN | 204020788 | U | 12/2014 |
| CN | 204021980 | U | 12/2014 |
| CN | 204024625 | U | 12/2014 |
| CN | 204051401 | U | 12/2014 |
| CN | 204060661 | U | 12/2014 |
| CN | 1104234651 | A | 12/2014 |
| CN | 104260672 | A | 1/2015 |
| CN | 104314512 | A | 1/2015 |
| CN | 204077478 | U | 1/2015 |
| CN | 204077526 | U | 1/2015 |
| CN | 204078307 | U | 1/2015 |
| CN | 204083051 | U | 1/2015 |
| CN | 204113168 | U | 1/2015 |
| CN | 104340682 | A | 2/2015 |
| CN | 104358536 | A | 2/2015 |
| CN | 104369687 | A | 2/2015 |
| CN | 104402178 | A | 3/2015 |
| CN | 104402185 | A | 3/2015 |
| CN | 104402186 | A | 3/2015 |
| CN | 204209819 | U | 3/2015 |
| CN | 204224560 | U | 3/2015 |
| CN | 204225813 | U | 3/2015 |
| CN | 204225839 | U | 3/2015 |
| CN | 104533392 | A | 4/2015 |
| CN | 104563938 | A | 4/2015 |
| CN | 104563994 | A | 4/2015 |
| CN | 104563995 | A | 4/2015 |
| CN | 104563998 | A | 4/2015 |
| CN | 104564033 | A | 4/2015 |
| CN | 204257122 | U | 4/2015 |
| CN | 204283610 | U | 4/2015 |
| CN | 204283782 | U | 4/2015 |
| CN | 204297682 | U | 4/2015 |
| CN | 204299810 | U | 4/2015 |
| CN | 103223315 | B | 5/2015 |
| CN | 104594857 | A | 5/2015 |
| CN | 104595493 | A | 5/2015 |
| CN | 104612647 | A | 5/2015 |
| CN | 104612928 | A | 5/2015 |
| CN | 104632126 | A | 5/2015 |
| CN | 204325094 | U | 5/2015 |
| CN | 204325098 | U | 5/2015 |
| CN | 204326983 | U | 5/2015 |
| CN | 204326985 | U | 5/2015 |
| CN | 204344040 | U | 5/2015 |
| CN | 204344095 | U | 5/2015 |
| CN | 104727797 | A | 6/2015 |
| CN | 204402414 | U | 6/2015 |
| CN | 204402423 | U | 6/2015 |
| CN | 204402450 | U | 6/2015 |
| CN | 103247220 | B | 7/2015 |
| CN | 104803568 | A | 7/2015 |
| CN | 204436360 | U | 7/2015 |
| CN | 204457524 | U | 7/2015 |
| CN | 204472485 | U | 7/2015 |
| CN | 204473625 | U | 7/2015 |
| CN | 204477303 | U | 7/2015 |
| CN | 204493095 | U | 7/2015 |
| CN | 204493309 | U | 7/2015 |
| CN | 103253839 | B | 8/2015 |
| CN | 104820372 | A | 8/2015 |
| CN | 104832093 | A | 8/2015 |
| CN | 104863523 | A | 8/2015 |
| CN | 204552723 | U | 8/2015 |
| CN | 204553866 | U | 8/2015 |
| CN | 204571831 | U | 8/2015 |
| CN | 204703814 | U | 10/2015 |
| CN | 204703833 | U | 10/2015 |
| CN | 204703834 | U | 10/2015 |
| CN | 105092401 | A | 11/2015 |
| CN | 103233715 | B | 12/2015 |
| CN | 103790927 | | 12/2015 |
| CN | 105207097 | | 12/2015 |
| CN | 204831952 | U | 12/2015 |
| CN | 204899777 | U | 12/2015 |
| CN | 102602323 | | 1/2016 |
| CN | 105240064 | A | 1/2016 |
| CN | 204944834 | | 1/2016 |
| CN | 205042127 | U | 2/2016 |
| CN | 205172478 | U | 4/2016 |
| CN | 103993869 | B | 5/2016 |
| CN | 105536299 | A | 5/2016 |
| CN | 105545207 | A | 5/2016 |
| CN | 205260249 | | 5/2016 |
| CN | 103233714 | B | 6/2016 |
| CN | 104340682 | B | 6/2016 |
| CN | 205297518 | U | 6/2016 |
| CN | 205298447 | U | 6/2016 |
| CN | 205391821 | U | 7/2016 |
| CN | 205400701 | U | 7/2016 |
| CN | 103277290 | B | 8/2016 |
| CN | 104260672 | B | 8/2016 |
| CN | 205477370 | U | 8/2016 |
| CN | 205479153 | U | 8/2016 |
| CN | 205503058 | U | 8/2016 |
| CN | 205503068 | U | 8/2016 |
| CN | 205503089 | U | 8/2016 |
| CN | 105958098 | A | 9/2016 |
| CN | 205599180 | | 9/2016 |
| CN | 205599180 | U | 9/2016 |
| CN | 106121577 | A | 11/2016 |
| CN | 205709587 | | 11/2016 |
| CN | 104612928 | B | 12/2016 |
| CN | 106246120 | A | 12/2016 |
| CN | 205805471 | | 12/2016 |
| CN | 106321045 | A | 1/2017 |
| CN | 205858306 | | 1/2017 |
| CN | 106438310 | A | 2/2017 |
| CN | 205937833 | | 2/2017 |
| CN | 104563994 | B | 3/2017 |
| CN | 206129196 | | 4/2017 |
| CN | 104369687 | B | 5/2017 |
| CN | 106715165 | | 5/2017 |
| CN | 106761561 | A | 5/2017 |
| CN | 105240064 | B | 6/2017 |
| CN | 206237147 | | 6/2017 |
| CN | 206287832 | | 6/2017 |
| CN | 206346711 | | 7/2017 |
| CN | 104563995 | B | 9/2017 |
| CN | 107120822 | | 9/2017 |
| CN | 107143298 | A | 9/2017 |
| CN | 107159046 | A | 9/2017 |
| CN | 107188018 | A | 9/2017 |
| CN | 206496016 | | 9/2017 |
| CN | 104564033 | B | 10/2017 |
| CN | 107234358 | A | 10/2017 |
| CN | 107261975 | A | 10/2017 |
| CN | 206581929 | | 10/2017 |
| CN | 104820372 | B | 12/2017 |
| CN | 105092401 | B | 12/2017 |
| CN | 107476769 | A | 12/2017 |
| CN | 107520526 | A | 12/2017 |
| CN | 206754664 | | 12/2017 |
| CN | 107605427 | A | 1/2018 |
| CN | 106438310 | B | 2/2018 |
| CN | 107654196 | A | 2/2018 |
| CN | 107656499 | A | 2/2018 |
| CN | 107728657 | A | 2/2018 |
| CN | 206985503 | | 2/2018 |
| CN | 207017968 | | 2/2018 |
| CN | 107859053 | A | 3/2018 |
| CN | 207057867 | | 3/2018 |
| CN | 207085817 | | 3/2018 |
| CN | 105545207 | B | 4/2018 |
| CN | 107883091 | A | 4/2018 |
| CN | 107902427 | A | 4/2018 |
| CN | 107939290 | A | 4/2018 |
| CN | 107956708 | | 4/2018 |
| CN | 207169595 | | 4/2018 |
| CN | 207194873 | | 4/2018 |
| CN | 207245674 | | 4/2018 |

(56) References Cited

FOREIGN PATENT DOCUMENTS

| | | | |
|---|---|---|---|
| CN | 108034466 | A | 5/2018 |
| CN | 108036071 | A | 5/2018 |
| CN | 108087050 | A | 5/2018 |
| CN | 207380566 | | 5/2018 |
| CN | 108103483 | A | 6/2018 |
| CN | 108179046 | A | 6/2018 |
| CN | 108254276 | A | 7/2018 |
| CN | 108311535 | A | 7/2018 |
| CN | 207583576 | | 7/2018 |
| CN | 207634064 | | 7/2018 |
| CN | 207648054 | | 7/2018 |
| CN | 207650621 | | 7/2018 |
| CN | 108371894 | A | 8/2018 |
| CN | 207777153 | | 8/2018 |
| CN | 108547601 | A | 9/2018 |
| CN | 108547766 | A | 9/2018 |
| CN | 108555826 | A | 9/2018 |
| CN | 108561098 | A | 9/2018 |
| CN | 108561750 | A | 9/2018 |
| CN | 108590617 | A | 9/2018 |
| CN | 207813495 | | 9/2018 |
| CN | 207814698 | | 9/2018 |
| CN | 207862275 | | 9/2018 |
| CN | 108687954 | A | 10/2018 |
| CN | 207935270 | | 10/2018 |
| CN | 207961582 | | 10/2018 |
| CN | 207964530 | | 10/2018 |
| CN | 108789848 | A | 11/2018 |
| CN | 108799473 | | 11/2018 |
| CN | 108868675 | A | 11/2018 |
| CN | 208086829 | | 11/2018 |
| CN | 208089263 | | 11/2018 |
| CN | 208169068 | | 11/2018 |
| CN | 108979569 | A | 12/2018 |
| CN | 109027662 | A | 12/2018 |
| CN | 109058092 | A | 12/2018 |
| CN | 208179454 | | 12/2018 |
| CN | 208179502 | | 12/2018 |
| CN | 208253147 | | 12/2018 |
| CN | 208260574 | | 12/2018 |
| CN | 109114418 | A | 1/2019 |
| CN | 109141990 | A | 1/2019 |
| CN | 208313120 | | 1/2019 |
| CN | 208330319 | | 1/2019 |
| CN | 208342730 | | 1/2019 |
| CN | 208430982 | | 1/2019 |
| CN | 208430986 | | 1/2019 |
| CN | 109404274 | A | 3/2019 |
| CN | 109429610 | A | 3/2019 |
| CN | 109491318 | | 3/2019 |
| CN | 109515177 | A | 3/2019 |
| CN | 109526523 | A | 3/2019 |
| CN | 208564504 | | 3/2019 |
| CN | 208564516 | | 3/2019 |
| CN | 208564525 | | 3/2019 |
| CN | 208564918 | | 3/2019 |
| CN | 208576026 | | 3/2019 |
| CN | 208576042 | | 3/2019 |
| CN | 208650818 | | 3/2019 |
| CN | 208669244 | | 3/2019 |
| CN | 1109534737 | A | 3/2019 |
| CN | 109555484 | A | 4/2019 |
| CN | 109682881 | A | 4/2019 |
| CN | 208730959 | | 4/2019 |
| CN | 208735264 | | 4/2019 |
| CN | 208746733 | | 4/2019 |
| CN | 208749529 | | 4/2019 |
| CN | 208750405 | | 4/2019 |
| CN | 208764658 | | 4/2019 |
| CN | 109736740 | A | 5/2019 |
| CN | 109751007 | A | 5/2019 |
| CN | 208868428 | | 5/2019 |
| CN | 208870761 | | 5/2019 |
| CN | 109869294 | A | 6/2019 |
| CN | 109882144 | A | 6/2019 |
| CN | 109882372 | A | 6/2019 |
| CN | 209012047 | | 6/2019 |
| CN | 209100025 | | 7/2019 |
| CN | 110080707 | A | 8/2019 |
| CN | 110118127 | A | 8/2019 |
| CN | 110124574 | A | 8/2019 |
| CN | 110145277 | A | 8/2019 |
| CN | 110145399 | A | 8/2019 |
| CN | 110152552 | A | 8/2019 |
| CN | 110155193 | A | 8/2019 |
| CN | 110159225 | A | 8/2019 |
| CN | 110159432 | | 8/2019 |
| CN | 110159432 | A | 8/2019 |
| CN | 110159433 | A | 8/2019 |
| CN | 110208100 | A | 9/2019 |
| CN | 110252191 | A | 9/2019 |
| CN | 110284854 | A | 9/2019 |
| CN | 110284972 | A | 9/2019 |
| CN | 209387358 | | 9/2019 |
| CN | 110374745 | A | 10/2019 |
| CN | 209534736 | | 10/2019 |
| CN | 110425105 | A | 11/2019 |
| CN | 110439779 | A | 11/2019 |
| CN | 110454285 | A | 11/2019 |
| CN | 110454352 | A | 11/2019 |
| CN | 110467298 | A | 11/2019 |
| CN | 110469312 | A | 11/2019 |
| CN | 110469314 | A | 11/2019 |
| CN | 110469405 | A | 11/2019 |
| CN | 110469654 | A | 11/2019 |
| CN | 110485982 | A | 11/2019 |
| CN | 110485983 | A | 11/2019 |
| CN | 110485984 | A | 11/2019 |
| CN | 110486249 | A | 11/2019 |
| CN | 110500255 | A | 11/2019 |
| CN | 110510771 | A | 11/2019 |
| CN | 110513097 | A | 11/2019 |
| CN | 209650738 | | 11/2019 |
| CN | 209653968 | | 11/2019 |
| CN | 209654004 | | 11/2019 |
| CN | 209654022 | | 11/2019 |
| CN | 209654128 | | 11/2019 |
| CN | 209656622 | | 11/2019 |
| CN | 107849130 | B | 12/2019 |
| CN | 108087050 | B | 12/2019 |
| CN | 110566173 | A | 12/2019 |
| CN | 110608030 | A | 12/2019 |
| CN | 110617187 | A | 12/2019 |
| CN | 110617188 | A | 12/2019 |
| CN | 110617318 | A | 12/2019 |
| CN | 209740823 | | 12/2019 |
| CN | 209780827 | | 12/2019 |
| CN | 209798631 | | 12/2019 |
| CN | 209799942 | | 12/2019 |
| CN | 209800178 | | 12/2019 |
| CN | 209855723 | | 12/2019 |
| CN | 209855742 | | 12/2019 |
| CN | 209875063 | | 12/2019 |
| CN | 110656919 | A | 1/2020 |
| CN | 10848028 | A | 2/2020 |
| CN | 107520526 | B | 2/2020 |
| CN | 110787667 | A | 2/2020 |
| CN | 110821464 | A | 2/2020 |
| CN | 110833665 | A | 2/2020 |
| CN | 210049880 | | 2/2020 |
| CN | 210049882 | | 2/2020 |
| CN | 210097596 | | 2/2020 |
| CN | 210105817 | | 2/2020 |
| CN | 210105818 | | 2/2020 |
| CN | 210105993 | | 2/2020 |
| CN | 110873093 | A | 3/2020 |
| CN | 210139911 | | 3/2020 |
| CN | 110947681 | A | 4/2020 |
| CN | 111058810 | A | 4/2020 |
| CN | 111075391 | A | 4/2020 |
| CN | 210289931 | | 4/2020 |
| CN | 210289932 | | 4/2020 |
| CN | 210289933 | | 4/2020 |
| CN | 210303516 | | 4/2020 |

(56) References Cited

FOREIGN PATENT DOCUMENTS

| | | | |
|---|---|---|---|
| CN | 211412945 | | 4/2020 |
| CN | 111089003 | A | 5/2020 |
| CN | 111151186 | A | 5/2020 |
| CN | 111167769 | A | 5/2020 |
| CN | 111169833 | A | 5/2020 |
| CN | 111173476 | A | 5/2020 |
| CN | 111185460 | A | 5/2020 |
| CN | 111185461 | A | 5/2020 |
| CN | 111188763 | A | 5/2020 |
| CN | 111206901 | A | 5/2020 |
| CN | 111206992 | A | 5/2020 |
| CN | 111206994 | A | 5/2020 |
| CN | 210449044 | | 5/2020 |
| CN | 210460875 | | 5/2020 |
| CN | 210522432 | | 5/2020 |
| CN | 210598943 | | 5/2020 |
| CN | 210598945 | | 5/2020 |
| CN | 210598946 | | 5/2020 |
| CN | 210599194 | | 5/2020 |
| CN | 210599303 | | 5/2020 |
| CN | 210600110 | | 5/2020 |
| CN | 111219326 | A | 6/2020 |
| CN | 111350595 | A | 6/2020 |
| CN | 210660319 | | 6/2020 |
| CN | 210714569 | | 6/2020 |
| CN | 210769168 | | 6/2020 |
| CN | 210769169 | | 6/2020 |
| CN | 210769170 | | 6/2020 |
| CN | 210770133 | | 6/2020 |
| CN | 210825844 | | 6/2020 |
| CN | 210888904 | | 6/2020 |
| CN | 210888905 | | 6/2020 |
| CN | 210889242 | | 6/2020 |
| CN | 111397474 | A | 7/2020 |
| CN | 111412064 | A | 7/2020 |
| CN | 111441923 | A | 7/2020 |
| CN | 111441925 | A | 7/2020 |
| CN | 111503517 | A | 8/2020 |
| CN | 111515898 | A | 8/2020 |
| CN | 111594059 | A | 8/2020 |
| CN | 111594062 | A | 8/2020 |
| CN | 111594144 | A | 8/2020 |
| CN | 211201919 | | 8/2020 |
| CN | 211201920 | | 8/2020 |
| CN | 211202218 | | 8/2020 |
| CN | 111608965 | A | 9/2020 |
| CN | 111664087 | A | 9/2020 |
| CN | 111677476 | A | 9/2020 |
| CN | 111677647 | A | 9/2020 |
| CN | 111692064 | A | 9/2020 |
| CN | 111692065 | A | 9/2020 |
| CN | 211384571 | | 9/2020 |
| CN | 211397553 | | 9/2020 |
| CN | 211397677 | | 9/2020 |
| CN | 211500955 | | 9/2020 |
| CN | 211524765 | | 9/2020 |
| DE | 4004854 | | 8/1991 |
| DE | 4241614 | | 6/1994 |
| DE | 102009022859 | | 12/2010 |
| DE | 102012018825 | | 3/2014 |
| DE | 102013111655 | | 12/2014 |
| DE | 102015103872 | | 10/2015 |
| DE | 102013114335 | | 12/2020 |
| EP | 0835983 | | 4/1998 |
| EP | 1378683 | | 1/2004 |
| EP | 2143916 | | 1/2010 |
| EP | 2613023 | | 7/2013 |
| EP | 3095989 | | 11/2016 |
| EP | 3211766 | | 8/2017 |
| EP | 3049642 | | 4/2018 |
| EP | 3354866 | | 8/2018 |
| EP | 3075946 | | 5/2019 |
| FR | 2795774 | | 6/1999 |
| GB | 474072 | | 10/1937 |
| GB | 1438172 | | 6/1976 |
| JP | S57135212 | | 2/1984 |
| KR | 20020026398 | | 4/2002 |
| RU | 13562 | | 4/2000 |
| WO | 1993020328 | | 10/1993 |
| WO | 2006025886 | | 3/2006 |
| WO | 2009023042 | | 2/2009 |
| WO | 20110133821 | | 10/2011 |
| WO | 2012139380 | | 10/2012 |
| WO | 2013158822 | | 10/2013 |
| WO | PCT/CN2012/074945 | | 11/2013 |
| WO | 2013185399 | | 12/2013 |
| WO | 2015158020 | | 10/2015 |
| WO | 2016014476 | | 1/2016 |
| WO | 2016033983 | | 3/2016 |
| WO | 2016078181 | | 5/2016 |
| WO | 2016101374 | | 6/2016 |
| WO | 2016112590 | | 7/2016 |
| WO | 2016/186790 | | 11/2016 |
| WO | 2017123656 | A | 7/2017 |
| WO | 2017146279 | | 8/2017 |
| WO | 2017213848 | | 12/2017 |
| WO | 2018031029 | | 2/2018 |
| WO | 2018038710 | | 3/2018 |
| WO | 2018044293 | | 3/2018 |
| WO | 2018044307 | | 3/2018 |
| WO | 2018071738 | | 4/2018 |
| WO | 2018101909 | | 6/2018 |
| WO | 2018101912 | | 6/2018 |
| WO | 2018106210 | | 6/2018 |
| WO | 2018106225 | | 6/2018 |
| WO | 2018106252 | | 6/2018 |
| WO | 2018/132106 | | 7/2018 |
| WO | 2018156131 | | 8/2018 |
| WO | 2018075034 | | 10/2018 |
| WO | 2018187346 | | 10/2018 |
| WO | 2018031031 | | 2/2019 |
| WO | 2019045691 | | 3/2019 |
| WO | 2019046680 | | 3/2019 |
| WO | 2019060922 | | 3/2019 |
| WO | 2019117862 | | 6/2019 |
| WO | 2019126742 | | 6/2019 |
| WO | 2019147601 | | 8/2019 |
| WO | 2019169366 | | 9/2019 |
| WO | 2019195651 | | 10/2019 |
| WO | 2019200510 | | 10/2019 |
| WO | 2019210417 | | 11/2019 |
| WO | 2020018068 | | 1/2020 |
| WO | 2020046866 | | 3/2020 |
| WO | 2020072076 | | 4/2020 |
| WO | 2020076569 | | 4/2020 |
| WO | 2020097060 | | 5/2020 |
| WO | 2020104088 | | 5/2020 |
| WO | 2020131085 | | 6/2020 |
| WO | 2020211083 | | 10/2020 |
| WO | 2020211086 | | 10/2020 |
| WO | 2021/038604 | | 3/2021 |
| WO | 2021038604 | | 3/2021 |
| WO | 2021041783 | | 3/2021 |

OTHER PUBLICATIONS

US 11,555,493 B2, 01/2023, Chang et al. (withdrawn)

International Search Report and Written Opinion for PCT/US2022/030647, dated Oct. 7, 2022.

AFGlobal Corporation, Durastim Hydraulic Fracturing Pump, A Revolutionary Design for Continuous Duty Hydraulic Fracturing, 2018.

SPM@ QEM 5000 E-Frac Pump Specification Sheet, Weir Group (2019) ("Weir 5000").

Green Field Energy Services Natural Gas Driven Turbine Frac Pumps HHP Summit Presentation, Yumpu (Sep. 2012), https://www.yumpu.com/en/document/read/49685291/turbine-frac-pump-assembly-hhp ("Green Field").

Dowell B908 "Turbo-Jet" Operator's Manual.

Jereh Debut's Super-power Turbine Fracturing Pump, Leading the Industrial Revolution, Jereh Oilfield Services Group (Mar. 19, 2014), https://www.prnewswire.com/news-releases/jereh-debuts-

(56) References Cited

OTHER PUBLICATIONS super-power-turbine-fracturing-pump-leading-the-industrial-revolution-250992111.html.
Jereh Apollo 4500 Turbine Frac Pumper Finishes Successful Field Operation in China, Jereh Group (Feb. 13, 2015), as available on Apr. 20, 2015, https://web.archive.org/web/20150420220625/https://www. prnewswire.com/news-releases/jereh-apollo-4500-turbine-frac-pumper-finishes-successful-field-operation-in-china-300035829.html.
35% Economy Increase, Dual-fuel System Highlighting Jereh Apollo Frac Pumper, Jereh Group (Apr. 13, 2015), https://www.jereh.com/en/news/press-release/news-detail-7345.htm.
Hydraulic Fracturing: Gas turbine proves successful in shale gas field operations, Vericor (2017), https://www.vericor.com/wp-content/ uploads/2020/02/7.- Fracing-4500hp-Pump-China-En.pdf ("Vericor Case Study").
Jereh Apollo Turbine Fracturing Pumper Featured on China Central Television, Jereh Group (Mar. 9, 2018), https://www.jereh.com/en/news/press-release/news-detail-7267.htm.
Jereh Unveiled New Electric Fracturing Solution at OTC 2019, Jereh Group (May 7, 2019), as available on May 28, 2019, https://web.archive.org/web/20190528183906/https://www.prnewswire .com/news-releases/jereh-unveiled-new-electric-fracturing-solution-at-otc-2019-300845028.html.
Jereh Group, Jereh Fracturing Unit, Fracturing Spread, YouTube (Mar. 30, 2015), https://www.youtube.com/watch?v=PIkDbU5dE0o.
Transcript of Jereh Group, Jereh Fracturing Unit, Fracturing Spread, YouTube (Mar. 30, 2015).
Jereh Group, Jereh Fracturing Equipment. YouTube (Jun. 8, 2015), https://www.youtube.com/watch?v=m0vMiq84P4Q.
Transcript of Jereh Group, Jereh Fracturing Equipment, YouTube (Jun. 8, 2015), https://www.youtube.com/watch?v=m0vMiq84P4Q.
Ferdinand P. Beer et al., Mechanics of Materials (6th ed. 2012).
Weir Oil & Gas Introduces Industry's First Continuous Duty 5000-Horsepower Pump, Weir Group (Jul. 25, 2019), https://www.global. weir/newsroom/news-articles/weir-oil-and-gas-introduces-industrys-first-continuous-duty-5000-horsepower-pump/.
2012 High Horsepower Summit Agenda, Natural Gas for High Horsepower Applications (Sep. 5, 2012).
Review of HHP Summit 2012, Gladstein, Neandross & Associates https://www.gladstein.org/gna-conferences/high-horsepower-summit-2012/.
Green Field Energy Services Deploys Third New Hydraulic Fracturing System, Green Field Energy Services, Inc. (Jul. 11, 2012), https://www.prnewswire.com/news-releases/green-field-energy-services-deploys-third-new-hydraulic-fracturing-spread-162113425.
Karen Boman, Turbine Technology Powers Green Field Multi-Fuel Frack Pump, Rigzone (Mar. 7, 2015), as available on Mar. 14, 2015, https://web.archive.org/web/20150314203227/https://www.rigzone.co m/news/oil-gas/a/124883/ Turbine_Technology_Powers_Green_Field_MultiFuel_Frack_Pump.
"Turbine Frac Units," WMD Squared (2012), https://wmdsquared.com/ work/gfes-turbine-frac-units/.
Leslie Turj, Green Field asset sale called 'largest disposition industry has seen,' The INDsider Media (Mar. 19, 2014), http://theind.com/ article-16497-green-field-asset-sale-called-%E2%80%98largest-disposition-industry-has-seen%60.html.
"Honghua developing new-generation shale-drilling rig, plans testing of frac pump"; Katherine Scott; Drilling Contractor; May 23, 2013; accessed at https://www.drillingcontractor.org/honghua-developing-new-generation-shale-drilling-rig-plans-testing-of-frac-pump-23278.
Researchgate, Answer by Byron Woolridge, found at https://www.researchgate.net/post/How_can_we_improve_the_efficiency_of_the_gas_turbine_cycles, Jan. 1, 2013.
Filipović, Ivan, Preliminary Selection of Basic Parameters of Different Torsional Vibration Dampers Intended for use in Medium-Speed Diesel Engines, Transactions of Famena XXXVI-3 (2012).
Marine Turbine Technologies, 1 MW Power Generation Package, http://marineturbine.com/power-generation, 2017.
Business Week: Fiber-optic cables help fracking, cablinginstall.com. Jul. 12, 2013. https://www.cablinginstall.com/cable/article/16474208/businessweek-fiberoptic-cables-help-fracking.
Fracking companies switch to electric motors to power pumps, iadd-intl.org. Jun. 27, 2019. https://www.iadd-intl.org/articles/fracking-companies-switch-to-electric-motors-to-power-pumps/.
The Leader in Frac Fueling, suncoastresources.com. Jun. 29, 2015. https://web.archive.org/web/20150629220609/https://www.suncoastresources.com/oilfield/fueling-services/.
Mobile Fuel Delivery, atlasoil.com. Mar. 6, 2019. https://www.atlasoil.com/nationwide-fueling/onsite-and-mobile-fueling.
Frac Tank Hose (FRAC), 4starhose.com. Accessed: Nov. 10, 2019. http://www.4starhose.com/product/frac_tank_hose_frac.aspx.
PLOS ONE, Dynamic Behavior of Reciprocating Plunger Pump Discharge Valve Based on Fluid Structure Interaction and Experimental Analysis. Oct. 21, 2015.
FMC Technologies, Operation and Maintenance Manual, L06 Through L16 Triplex Pumps Doc No. OMM50000903 Rev: E p. 1 of 66. Aug. 27, 2009.
Gardner Denver Hydraulic Fracturing Pumps GD 3000 https://www.gardnerdenver.com/en-us/pumps/triplex-fracking-pump-gd-3000.
Lekontsev, Yu M., et al. "Two-side sealer operation." Journal of Mining Science 49.5 (2013): 757-762.
Tom Hausfeld, GE Power & Water, and Eldon Schelske, Evolution Well Services, TM2500+ Power for Hydraulic Fracturing.
FTS International's Dual Fuel Hydraulic Fracturing Equipment Increases Operational Efficiencies, Provides Cost Benefits, Jan. 3, 2018.
CNG Delivery, Fracturing with natural gas, dual-fuel drilling with CNG, Aug. 22, 2019.
PbNG, Natural Gas Fuel for Drilling and Hydraulic Fracturing, Diesel Displacement / Dual Fuel & Bi-Fuel, May 2014.
Integrated Flow, Skid-mounted Modular Process Systems, Jul. 15, 2017, https://ifsolutions.com/why-modular/.
Cameron, A Schlumberger Company, Frac Manifold Systems, 2016.
ZSi-Foster, Energy | Solar | Fracking | Oil and Gas, Aug. 2020, https://www.zsi-foster.com/energy-solar-fracking-oil-and-gas.html.
JBG Enterprises, Inc., WS-Series Blowout Prevention Safety Coupling—Quick Release Couplings, Sep. 11, 2015, http://www.jgbhose.com/products/WS-Series-Blowout-Prevention-Safety-Coupling.asp.
Halliburton, Vessel-based Modular Solution (VMS), 2015.
Chun, M. K., H. K. Song, and R. Lallemand. "Heavy duty gas turbines in petrochemical plants: Samsung's Daesan plant (Korea) beats fuel flexibility records with over 95% hydrogen in process gas." Proceedings of PowerGen Asia Conference, Singapore. 1999.
Wolf, Jürgen J., and Marko A. Perkavec. "Safety Aspects and Environmental Considerations for a 10 MW Cogeneration Heavy Duty Gas Turbine Burning Coke Oven Gas with 60% Hydrogen Content." ASME 1992 International Gas Turbine and Aeroengine Congress and Exposition. American Society of Mechanical Engineers Digital Collection, 1992.
Ginter, Timothy, and Thomas Bouvay. "Uprate options for the MS7001 heavy duty gas turbine." GE paper GER-3808C, GE Energy 12 (2006).
Chaichan, Miqdam Tariq. "The impact of equivalence ratio on performance and emissions of a hydrogen-diesel dual fuel engine with cooled exhaust gas recirculation." International Journal of Scientific & Engineering Research 6.6 (2015): 938-941.
Ecob, David J., et al. "Design and Development of a Landfill Gas Combustion System for the Typhoon Gas Turbine." ASME 1996 International Gas Turbine and Aeroengine Congress and Exhibition. American Society of Mechanical Engineers Digital Collection, 1996.
II-VI Marlow Industries, Thermoelectric Technologies in Oil, Gas, and Mining Industries, blog.marlow.com (Jul. 24, 2019).
B.M. Mahlalela, et al., .Electric Power Generation Potential Based on Waste Heat and Geothermal Resources in South Africa, pangea stanford.edu (Feb. 11, 2019).
Department of Energy, United States of America, The Water-Energy Nexus: Challenges and Opportunities ourenergypolicy.org (Jun. 2014).

(56) References Cited

OTHER PUBLICATIONS

Ankit Tiwari, Design of a Cooling System for a Hydraulic Fracturing Equipment, The Pennsylvania State University, The Graduate School, College of Engineering, 2015.
Jp Yadav et al., Power Enhancement of Gas Turbine Plant by Intake Air Fog Cooling, Jun. 2015.
Mee Industries: Inlet Air Fogging Systems for Oil, Gas and Petrochemical Processing, Verdict Media Limited Copyright 2020.
M. Ahmadzadehtalatapeh et al. Performance enhancement of gas turbine units by retrofitting with inlet air cooling technologies (IACTs): an hour-by-hour simulation study, Journal of the Brazilian Society of Mechanical Sciences and Engineering, Mar. 2020.
Advances in Popular Torque-Link Solution Offer OEMs Greater Benefit, Jun. 21, 2018.
Emmanuel Akita et al., Mewbourne College of Earth & Energy, Society of Petroleum Engineers; Drilling Systems Automation Technical Section (DSATS); 2019.
PowerShelter Kit II, nooutage.com, Sep. 6, 2019.
Empengineering.com, HEMP Resistant Electrical Generators / Hardened Structures HEMP/GMD Shielded Generators, Virginia, Nov. 3, 2012.
Blago Minovski, Coupled Simulations of Cooling and Engine Systems for Unsteady Analysis of the Benefits of Thermal Engine Encapsulation, Department of Applied Mechanics, Chalmers University of Technology Goteborg, Sweden 2015.
J. Porteiro et al., Feasibility of a new domestic CHP trigeneration with heat pump: II. Availability analysis. Design and development, Applied Thermal Engineering 24 (2004) 1421-1429.
ISM, What is Cracking Pressure, 2019.
Swagelok, The right valve for controlling flow direction? Check, 2016.
Technology.org, Check valves how do they work and what are the main type, 2018.
De Gevigney et al., "Analysis of no-load dependent power losses in a planetary gear train by using thermal network method", International Gear Conference 2014: 26-28, Aug. 2014, Lyon, pp. 615-624.
Special-Purpose Couplings for Petroleum, Chemical, and Gas Industry Services, API Standard 671 (4th Edition) (2010).
The Application of Flexible Couplings for Turbomachinery, Jon R. Mancuso et al., Proceedings of the Eighteenthturbomachinery Symposium (1989).
Pump Control With Variable Frequency Drives, Kevin Tory, PUMPS & Systems: Advances in Motors and Drives, Reprint from Jun. 2008.
Fracture Design and Stimulation, Mike Eberhard, P.E., Wellconstruction & Operations Technical Workshop Insupport of the EPA Hydraulic Fracturing Study, Mar. 10-11, 2011.
General Purpose vs. Special Purpose Couplings, Jon Mancuso, Proceedings of the Twenty-Third Turbomachinerysymposium (1994).
Overview of Industry Guidance/Best Practices on Hydraulic Fracturing (HF), American Petroleum Institute, © 2012.
API Member Companies, American Petroleum Institute, WaybackMachine Capture, https://web.archive.org/web/20130424080625/http://api.org/globalitems/globalheaderpages/membership/api-member-companies, accessed Jan. 4, 2021.
API's Global Industry Services, American Petroleum Institute, © Aug. 2020.
About API, American Petroleum Institute, https://www.api.org /about, accessed Dec. 30, 2021.
About API, American Petroleum Institute, WaybackMachine Capture, https://web.archive.org/web/20110422104346 / http://api.org/aboutapi/, captured Apr. 22, 2011.
Publications, American Petroleum Institute, WaybackMachine Capture, https://web.archive.org/web/20110427043936 / http://www.api.org:80/Publications/, captured Apr. 27, 2011.
Procedures for Standards Development, American Petroleum Institute, Third Edition (2006).
WorldCat Library Collections Database Records for API Standard 671 and API Standard 674, https://www.worldcat.org/title/positive-displacement-pumps-reciprocating/oclc/ 858692269&referer=brief_results, accessed Dec. 30, 2021; and https://www.worldcat.org/title/special-purpose-couplings-for-petroleum-chemical-and-gas-industry-services/oclc/871254217&referer=brief_results, accessed Dec. 22, 2021.
2011 Publications and Services, American Petroleum Institute (2011).
Standards, American Petroleum Institute, WaybackMachine Capture, https://web.archive.org/web/20110207195046/ http:/www.api.org/Standards/, captured Feb. 7, 2011; and https://web.archive.org/web/20110204112554/http://global.ihs.com/?RID=API1, captured Feb. 4, 2011.
IHS Markit Standards Store, https://global.ihs.com/doc_ detail.cfm?document_name=API%20STD%20674&item_s_key=00010672#doc-detail-history-anchor, accessed Dec. 30, 2021; and https://global.ihs.com/doc_detail.cfm?&input_do c_number=671&input_doc_title=&document_name=API%20STD%20671&item_s_key=00010669&item_key_date=890331&origin=DSSC, accessed Dec. 30, 2021.
Dziubak, Tadeusz, "Experimental Studies of Dust Suction Irregularity from Multi-Cyclone Dust Collector of Two-Stage Air Filter", Energies 2021, 14, 3577, 28 pages.
Europump and Hydrualic Institute, Variable Speed Pumping: A Guide to Successful Applications, Elsevier Ltd, 2004.
Capstone Turbine Corporation, Capstone Receives Three Megawatt Order from Large Independent Oil & Gas Company in Eagle Ford Shale Play, Dec. 7, 2010.
Wikipedia, Westinghouse Combustion Turbine Systems Division, https://en.wikipedia.org/wiki/Westinghouse_Combustion_Turbine_Systems_Division, circa 1960.
Wikipedia, Union Pacific GTELs, https://en.wikipedia.org/wiki/Union_Pacific_GTELs, circa 1950.
HCI JET Frac, Screenshots from YouTube, Dec. 11, 2010. https://www.youtube.com/watch?v=6HjXkdbFaFQ.
AFD Petroleum Ltd., Automated Hot Zone, Frac Refueling System, Dec. 2018.
Eygun, Christiane, et al., URTeC: 2687987, Mitigating Shale Gas Developments Carbon Footprint: Evaluating and Implementing Solutions in Argentina, Copyright 2017, Unconventional Resources Technology Conference.
Walzel, Brian, Hart Energy, Oil, Gas Industry Discovers Innovative Solutions to Environmental Concerns, Dec. 10, 2018.
Frac Shack, Bi-Fuel FracFueller brochure, 2011.
Pettigrew, Dana, et al., High Pressure Multi-Stage Centrifugal Pump for 10,000 psi Frac Pump—HPHPS FRAC Pump, Copyright 2013, Society of Petroleum Engineers, SPE 166191.
Elle Seybold, et al., Evolution of Dual Fuel Pressure Pumping for Fracturing: Methods, Economics, Field Trial Results and Improvements in Availability of Fuel, Copyright 2013, Society of Petroleum Engineers, SPE 166443.
Wallace, E.M., Associated Shale Gas: From Flares to Rig Power, Copyright 2015, Society of Petroleum Engineers, SPE-173491-MS.
Williams, C.W. (Gulf Oil Corp. Odessa Texas), The Use of Gas-turbine Engines in an Automated High-Pressure Water-Injection Stations; American Petroleum Institute; API-63-144 (Jan. 1, 1963).
Neal, J.C. (Gulf Oil Corp. Odessa Texas), Gas Turbine Driven Centrifugal Pumps for High Pressure Water Injection; American Institute of Mining, Metallurgical and Petroleum Engineers, Inc .; SPE-1888 (1967).
Porter, John A. (SOLAR Division International Harvester Co.), Modern Industrial Gas Turbines for the Oil Field; American Petroleum Institute; Drilling and Production Practice; API-67-243 (Jan. 1, 1967).
Cooper et al., Jet Frac Porta-Skid—A New Concept in Oil Field Service Pump Equipments[sic]; Halliburton Services; SPE-2706 (1969).
Ibragimov, É.S., Use of gas-turbine engines in oil field pumping units; Chem Petrol Eng; (1994) 30: 530. https://doi.org/10.1007/BF01154919. (Translated from Khimicheskaya i Neftyanoe Mashinostroenie, No. 11, pp. 24-26, Nov. 1994.).
Kas'yanov et al., Application of gas turbine engines in pumping units complexes of hydraulic fracturing of oil and gas reservoirs; Exposition Oil & Gas; (Oct. 2012) (published in Russian).
American Petroleum Institute. API 674: Positive Displacement Pumps—Reciprocating. 3rd ed. Washington, DC: API Publishing Services, 2010.

(56) References Cited

OTHER PUBLICATIONS

American Petroleum Institute. API 616: Gas Turbines for the Petroleum, Chemical, and Gas Industry Services. 5th ed. Washington, Dc: API Publishing Services, 2011.
Karassik, Igor, Joseph Messina, Paul Cooper, and Charles Heald. Pump Handbook. 4th ed. New York: McGraw-Hill Education, 2008.
Weir SPM. Weir SPM General Catalog: Well Service Pumps, Flow Control Products, Manifold Trailers, Safety Products, Post Sale Services. Ft. Worth, TX: Weir Oil & Gas. May 28, 2016. https://www.pumpfundamentals.com/pumpdatabase2/weir-spm-general.pdf.
The Weir Group, Inc. Weir SPM Pump Product Catalog. Ft. Worth, Tx: S.P.M. Flow Control, Inc. Oct. 30, 2017. https://manage.global.weir/assets/files/product%20brochures/SPM_2P140706_Pump_Product_Catalogue_View.pdf.
Shandong Saigao Group Corporation. Q4 (5W115) Quintuplex Plunger Pump. Jinan City, Shandong Province, China: Saigao. Oct. 20, 2014. https://www.saigaogroup.com/product/q400-5w115-quintuplex-plunger-pump.html.
Marine Turbine. Turbine Powered Frac Units. Franklin, Louisiana: Marine Turbine Technologies, 2020.
Rotating Right. Quintuplex Power Pump Model Q700. Edmonton, Alberta, Canada: Weatherford International Ltd. https://www.rotatingright.com/pdf/weatherford/RR%2026-Weatherford%20Model%20Q700.pdf, 2021.
CanDyne Pump Services, Inc. Weatherford Q700 Pump. Calgary, Alberta, Canada: CanDyne Pump Services. Aug. 15, 2015. http://candyne.com/wp-content/uploads/2014/10/181905-94921.q700-quintuplex-pump.pdf.
Arop, Julius Bankong. Geomechanical review of hydraulic fracturing technology. Thesis (M. Eng.). Cambridge, MA: Massachusetts Institute of Technology, Dept. of Civil and Environmental Engineering. Oct. 29, 2013. https://dspace.mit.edu/handle/1721.1/82176.
Final written decision of PGR2021-00102 dated Feb. 6, 2023.
Final written decision of PGR2021-00103 dated Feb. 6, 2023.
Rigmaster Machinery Ltd., Model: 2000 RMP-6-PLEX, brochure, downloaded at https://www.rigmastermachinery.com/_files/ugd/431e62_eaecd77c9fe54af8b13d08396072da67.pdf.

* cited by examiner

HYDRAULIC FRACTURING PUMPS TO ENHANCE FLOW OF FRACTURING FLUID INTO WELLHEADS AND RELATED METHODS

CROSS-REFERENCE TO RELATED APPLICATION

This application is a divisional of U.S. Non-Provisional application Ser. No. 17/664,578, filed May 23, 2022, titled "HYDRAULIC FRACTURING PUMPS TO ENHANCE FLOW OF FRACTURING FLUID INTO WELLHEADS AND RELATED METHODS," which claims the benefit of and priority to U.S. Provisional Application No. 63/202,031, filed May 24, 2021, titled "HYDRAULIC FRACTURING PUMPS TO ENHANCE FLOW OF FRACTURING FLUID INTO WELLHEADS AND RELATED METHODS," the entire disclosures of which are incorporated herein by reference.

TECHNICAL FIELD

The present disclosure relates to hydraulic fracturing pumps to enhance the flow of fracturing fluid into wellheads and related methods and, more particularly, to hydraulic fracturing pumps to provide increased flow of fracturing fluid into wellheads and related methods.

BACKGROUND

Hydraulic fracturing is an oilfield operation that stimulates the production of hydrocarbons, such that the hydrocarbons may more easily or readily flow from a subsurface formation to a well. For example, a hydraulic fracturing system may be configured to fracture a formation by pumping a fracturing fluid into a well at high pressure and high flow rates. Some fracturing fluids may take the form of a slurry including water, proppants, and/or other additives, such as thickening agents and gels. The slurry may be forced via operation of one or more pumps into the formation at rates faster than can be accepted by the existing pores, fractures, faults, or other spaces within the formation. As a result, pressure may build rapidly to the point where the formation may fail and may begin to fracture. By continuing to pump the fracturing fluid into the formation, existing fractures in the formation may be caused to expand and extend in directions away from a well bore, thereby creating additional flow paths for hydrocarbons to flow to the well bore. The proppants may serve to prevent the expanded fractures from closing or may reduce the extent to which the expanded fractures contract when pumping of the fracturing fluid is ceased. Once the formation is fractured, large quantities of the injected fracturing fluid are allowed to flow out of the well, and the production stream of hydrocarbons may be obtained from the formation.

To pump the fracturing fluid into the well bore, a hydraulic fracturing system may include a number of hydraulic fracturing units, each including a prime mover to supply mechanical power and a hydraulic fracturing pump driven by the prime mover. The hydraulic fracturing pump may be supplied with fracturing fluid, and the hydraulic fracturing pump, driven by the prime mover, may pump the fracturing fluid at high-pressure and high flow rates into the wellhead during a fracturing operation. In order to facilitate use of the hydraulic fracturing units and other equipment related to a fracturing operation at different locations, the hydraulic fracturing units may often include a mobile platform, such as a trailer, onto which the prime mover, hydraulic fracturing pump, and other components of the hydraulic fracturing unit may be mounted. The hydraulic fracturing unit may be transported to one wellhead location, set-up for operation, used during the fracturing operation, and once the fracturing operation is completed, it may be partially disassembled for transportation and transported to another wellhead location for use in another fracturing operation. Because the hydraulic fracturing units are often transported on public highways, the maximum dimensions of the hydraulic fracturing units may often be constrained by government regulations.

Although the maximum dimensions of the hydraulic fracturing units may be constrained, it may be desirable for the hydraulic fracturing units to be capable of increased pumping capacity. For example, by increasing the pumping capacity of the hydraulic fracturing units, it may be possible to successfully complete a fracturing operation using fewer hydraulic fracturing units, which may lead to reduced set-up and tear-down time, the need for fewer operators, more efficient operation, and more cost-effective completion of the fracturing operation. However, due at least in part to the constrained maximum dimensions of the hydraulic fracturing units, it may be difficult to increase the pumping capacity of a hydraulic fracturing unit.

In addition, larger hydraulic fracturing pumps driven by more powerful prime movers may develop relatively larger shock and vibration during operation, for example, due to torque loads generated by more powerful prime movers driving higher capacity hydraulic fracturing pumps. Such shock and vibration, if unmitigated, may result in premature wear or failure of components of the hydraulic fracturing unit and manifolds carrying the fracturing fluid to the wellhead. Thus, although hydraulic fracturing units having larger pumping capacities may be desirable, such larger capacities may result other possible drawbacks.

Accordingly, Applicant has recognized a need for hydraulic fracturing units and related methods for providing greater pumping capacity, while mitigating or eliminating possible drawbacks. The present disclosure may address one or more of the above-referenced drawbacks, as well as other possible drawbacks.

SUMMARY

As referenced above, it may be desirable to provide hydraulic fracturing units having higher pumping capacities, but achieving higher pumping capacities may be constrained by limited physical dimensions enabling transportation of hydraulic fracturing units between well sites. In addition, higher pumping capacities may require more powerful prime movers and higher capacity hydraulic fracturing pumps, and operation of such prime movers and hydraulic fracturing pumps may lead to premature wear or failure of components of the hydraulic fracturing units and the manifolds that carry the fracturing fluid to the wellhead due, for example, to increased shock and vibration during operation and proppant settling due to increased stroke lengths.

The present disclosure generally is directed to hydraulic fracturing pumps to enhance the flow of fracturing fluid into wellheads and related methods and, more particularly, to hydraulic fracturing pumps to provide increased flow of fracturing fluid into wellheads and related methods. For example, in some embodiments, a hydraulic fracturing pump may be configured to provided increased pumping capacity while retaining dimensions able to fit within physical dimension limitations for transportation between well sites. In addition, in some embodiments, the hydraulic fracturing pumps and related methods may provide higher pumping capacities while keeping shock and vibrations to relatively low levels, or in some instances, reducing shock and vibration levels. As a result, at least some embodiments may reduce the likelihood of, or prevent, premature component wear or failure in hydraulic fracturing systems.

According to some embodiments, a hydraulic fracturing pump to enhance flow of fracturing fluid into a wellhead during a high-pressure fracturing operation may include a pump frame at least partially defining a shaft aperture, and a crankshaft extending through the shaft aperture. The hydraulic fracturing pump further may include a plurality of first plungers connected to the crankshaft and positioned to reciprocate relative to the crankshaft as the crankshaft rotates. Each of the plurality of first plungers may reciprocate in a first plane and draw-in fracturing fluid at a first pressure and discharge the fracturing fluid at a second pressure greater than the first pressure. The hydraulic fracturing pump also may include a plurality of second plungers connected to the crankshaft and positioned to reciprocate relative to the crankshaft as the crankshaft rotates. Each of the plurality of second plungers may reciprocate in a second plane and draw-in fracturing fluid at a third pressure and discharge the fracturing fluid at a fourth pressure greater than the third pressure. The first plane and the second plane may define a non-zero offset angle between the first plane and the second plane.

In some embodiments, a hydraulic fracturing pump to enhance flow of fracturing fluid into a wellhead during a high-pressure fracturing operation may include a pump frame at least partially defining a shaft aperture, and a crankshaft extending through the shaft aperture. The crankshaft may include a plurality of crankpins, and each of the crankpins may be offset from a longitudinal rotation axis of the crankshaft. The hydraulic fracturing pump further may include a plurality of first plungers, and each of the plurality of first plungers may be connected to the crankshaft via a respective crankpin of the plurality of crankpins and be positioned to reciprocate relative to the crankshaft as the crankshaft rotates. The hydraulic fracturing pump also may include a plurality of second plungers. Each of the plurality of second plungers may be connected to the crankshaft via a respective crankpin of the plurality of crankpins and may be positioned to reciprocate relative to the crankshaft as the crankshaft rotates. Each of plurality of crankpins may be connected to one of the plurality of first plungers and one of the plurality of second plungers.

In some embodiments, a hydraulic fracturing pump to enhance flow of fracturing fluid into a wellhead during a high-pressure fracturing operation may include a pump frame at least partially defining a shaft aperture, and a crankshaft extending through the shaft aperture. The hydraulic fracturing pump further may include a plurality of first plungers, and each of the plurality of first plungers may be connected to the crankshaft and may be positioned to reciprocate relative to the crankshaft as the crankshaft rotates. The hydraulic fracturing pump also may include a plurality of second plungers, and each of the plurality of second plungers may be connected to the crankshaft and may be positioned to reciprocate relative to the crankshaft as the crankshaft rotates. The plurality of first plungers may be positioned to pump a first fracturing fluid including a first fracturing fluid composition while the plurality of second plungers pump a second fracturing fluid including a second fracturing fluid composition different from the first fracturing fluid composition.

In some embodiments, a hydraulic fracturing pump to enhance flow of fracturing fluid into a wellhead during a high-pressure fracturing operation may include a pump frame at least partially defining a shaft aperture, and a crankshaft extending through the shaft aperture. The hydraulic fracturing pump further may include a plurality of first plungers, and each of the plurality of first plungers may be connected to the crankshaft and may be positioned to reciprocate relative to the crankshaft as the crankshaft rotates. The hydraulic fracturing pump also may include a plurality of second plungers, and each of the plurality of second plungers may be connected to the crankshaft and many be positioned to reciprocate relative to the crankshaft as the crankshaft rotates. The hydraulic fracturing pump still further may include a first fluid end connected to the pump frame such that the plurality of first plungers draw fracturing fluid into the first fluid end at a first pressure and discharge the fracturing fluid from the first fluid end at a second pressure greater than the first pressure. The hydraulic fracturing pump also may include a second fluid end connected to the pump frame such that the plurality of second plungers draw fracturing fluid into the second fluid end at a third pressure and discharge the fracturing fluid from the second fluid end at a fourth pressure greater than the third pressure.

In some embodiments, a hydraulic fracturing pump to enhance flow of fracturing fluid into a wellhead during a high-pressure fracturing operation may include a pump frame at least partially defining a shaft aperture, and a crankshaft extending through the shaft aperture. The hydraulic fracturing pump further may include a plunger connected to the crankshaft and may be positioned to reciprocate relative to the crankshaft as the crankshaft rotates. The hydraulic fracturing pump also may include a fluid end connected to the pump frame. One or more of the fluid end or the plunger may be positioned such that as the plunger travels in a first direction, fracturing fluid is drawn into the fluid end and fracturing fluid is discharged from the fluid end, and as the plunger travels in a second direction opposite the first direction, fracturing fluid is drawn into the fluid end and fracturing fluid is discharged from the fluid end.

In some embodiments, a hydraulic fracturing pump to enhance flow of fracturing fluid into a wellhead during a high-pressure fracturing operation may include a pump frame at least partially defining a shaft aperture, and a crankshaft extending through the shaft aperture. The hydraulic fracturing pump further may include at least one plunger connected to the crankshaft and may be positioned to reciprocate relative to the crankshaft as the crankshaft rotates. The hydraulic fracturing pump also may include a drive assembly configured for transferring power from the prime mover to the hydraulic fracturing pump. In one embodiment, the drive assembly may include a first pinion gear engaged with the crankshaft at a first end of the pump frame, and a connector shaft connected to the first pinion gear. The hydraulic fracturing pump still further may include a second pinion gear connected to the hydraulic fracturing pump at a second end of the pump frame and connected to the first pinion gear via the connector shaft, such that the first pinion gear drives the connector shaft and the crankshaft at the first end of the pump frame, the connector shaft drives the second pinion gear at the second end of the pump frame, and the second pinion gear drives the crankshaft at the second end of the pump frame.

In other embodiments, the drive assembly can include a planetary gear train including at least one planetary gearbox positioned at the first end of the pump frame. In some embodiments, an additional planetary gearbox also can be provided at the second end of the pump frame. The at least one planetary gearbox may include a first drive gear, which can be configured as a ring gear having a first series of gear teeth formed about an inner circumference thereof, and a second series of gear teeth formed about an outer circumference thereof. A sun gear can be positioned within the first drive gear, generally being arranged approximately in the center thereof and aligned with the longitudinal axis of the crankshaft. The sun gear can engage with the crankshaft, and further can be connected to a prime mover of the hydraulic fracturing unit; for example, such as by being coupled to a transmission arranged between the prime mover and the hydraulic fracturing pump. A series of planet gears may be positioned about the sun gear, each of the planet gears including a series of gear teeth configured to engage gear teeth of the sun gear, and engage with the first series of teeth formed about the inner circumference of the first drive gear. A first pinon gear can be arranged below the first drive gear and can be engaged with a first end of a connector shaft that extends through the pump frame. The first pinion gear further may have a series of gear teeth formed about its circumference, which gear teeth are configured to engage with the second series of gear teeth formed about the outer circumference of the first drive gear.

As the sun gear is driven by operation of the prime mover, the crankshaft is rotated, and at substantially the same time, the engagement of the gear teeth of the planet gears with the gear teeth of the sun gear and with the first series of gear teeth formed about the inner circumference of the first drive gear will correspondingly drive rotation of the first drive gear. As the first drive gear is rotated, the engagement of its second series of teeth arranged about its outer circumference with the teeth of the first pinion gear turn drives rotation of the first pinion gear, which in turn drives rotation of the connector shaft coupled at its first end to the first pinion gear. The connector shaft further can be coupled at a second, opposite end to a second pinion gear located at the second end of the pump frame. The second pinion gear may have a series of gear teeth configured to engage with the gear teeth of a second drive gear located at the second end of the pump frame such that as the connector shaft is rotated, this rotation is translated to the second drive gear by the second pinion gear for additionally driving rotation of the crankshaft by the second drive gear. The second drive gear thus can engage with the crankshaft so as to support and drive rotation of the crankshaft from the second end of the crankshaft, to help reduce torque therealong.

In embodiments, a second planetary gearbox such as utilized at the first end of the pump frame can be used at the second end of the pump frame. In such embodiments, the second drive gear can be configured as a ring gear having gear teeth along an inner and an outer circumference thereof, with a sun gear and a series of planet gears arranged approximately in the center of the second drive gear. The sun gear can be connected to or engaged with the second end of the crankshaft so as to support and drive rotation of the crankshaft so that the crankshaft is driven from both sides of the pump frame. Alternatively, the second drive gear can comprise a single gear engaged with the second end of the crankshaft and driven by the rotation of the second pinion gear by the connector shaft.

In some embodiments, a hydraulic fracturing pump to enhance flow of fracturing fluid into a wellhead during a high-pressure fracturing operation may include a pump frame including a plurality of pump frame sections, and one or more of the plurality of pump frame sections may at least partially define a shaft aperture. The hydraulic fracturing pump further may include a crankshaft extending through the shaft aperture, and one or more of the plurality of pump frame sections may have an inverted V-shaped cross-section as viewed in a direction substantially parallel to a longitudinal axis of the crankshaft. The hydraulic fracturing pump also may include a plunger connected to the crankshaft and positioned to reciprocate relative to the crankshaft as the crankshaft rotates.

In some embodiments, a hydraulic fracturing unit to enhance flow of fracturing fluid into a wellhead during a high-pressure fracturing operation may include a platform having a longitudinal platform axis and a width perpendicular to the longitudinal platform axis. The hydraulic fracturing unit further may include a prime mover supported by the platform, and the prime mover may include an output shaft. The hydraulic fracturing unit also may include a transmission including an input shaft and a transmission output shaft, and the transmission may be supported by the platform and connected to the output shaft of the prime mover via the input shaft. The hydraulic fracturing unit still further may include a hydraulic fracturing pump supported by the platform at a longitudinal position opposite the prime mover relative to the transmission. The hydraulic fracturing pump may include a pump frame at least partially defining a shaft aperture, and a crankshaft extending through the shaft aperture. The crankshaft may have a longitudinal axis of rotation substantially parallel to the longitudinal platform axis. The hydraulic fracturing pump further may include a plurality of first plungers connected to the crankshaft and positioned to reciprocate relative to the crankshaft as the crankshaft rotates. Each of the plurality of first plungers may reciprocate in a first plane and may draw-in fracturing fluid at a first pressure and discharge the fracturing fluid at a second pressure greater than the first pressure. The hydraulic fracturing pump also may include a plurality of second plungers connected to the crankshaft and positioned to reciprocate relative to the crankshaft as the crankshaft rotates. Each of the plurality of second plungers may reciprocate in a second plane and may draw-in fracturing fluid at a third pressure and discharge the fracturing fluid at a fourth pressure greater than the third pressure. The first plane and the second plane may define a non-zero offset angle between the first plane and the second plane.

In some embodiments, a method to enhance output of a hydraulic fracturing unit associated with a high-pressure fracturing operation may include connecting a plurality of first plungers to a crankshaft of a hydraulic fracturing pump. Each of the plurality of first plungers may be positioned to reciprocate relative to the crankshaft as the crankshaft rotates, and each of the plurality of first plungers may reciprocate in a first plane and may draw-in fracturing fluid at a first pressure and discharge the fracturing fluid at a second pressure greater than the first pressure. The method further may include connecting a plurality of second plungers to the crankshaft of the hydraulic fracturing pump. Each of the plurality of second plungers may be positioned to reciprocate relative to the crankshaft as the crankshaft rotates, and each of the plurality of second plungers may reciprocate in a second plane and may draw-in fracturing fluid at a third pressure and discharge the fracturing fluid at a fourth pressure greater than the third pressure. The first plane and the second plane may define a non-zero offset angle between the first plane and the second plane.

In some embodiments, a method to increase a service interval of a hydraulic fracturing pump associated with a high-pressure fracturing operation may include pumping a first fracturing fluid including a first fracturing fluid composition via a plurality of first plungers of a hydraulic fracturing pump. The method further may include, while pumping the first fracturing fluid, pumping a second fracturing fluid including a second fracturing fluid composition via a plurality of second plungers of the hydraulic fracturing pump. The first fracturing fluid composition may be different than the second fracturing fluid composition.

In some embodiments, a method to reduce torque shock magnitude generated during operation of a hydraulic fracturing pump associated with a high-pressure fracturing operation may include connecting a plurality of first plungers to a crankshaft of the hydraulic fracturing pump. Each of the plurality of first plungers may be positioned to reciprocate relative to the crankshaft as the crankshaft rotates. Each of the plurality of first plungers may reciprocate in a first plane and draw-in fracturing fluid at a first pressure and discharge the fracturing fluid at a second pressure greater than the first pressure. The method also may include connecting a plurality of second plungers to the crankshaft of the hydraulic fracturing pump. Each of the plurality of second plungers may be positioned to reciprocate relative to the crankshaft as the crankshaft rotates. Each of the plurality of second plungers may reciprocate in a second plane and draw-in fracturing fluid at a third pressure and discharge the fracturing fluid at a fourth pressure greater than the third pressure. The first plane and the second plane may define a non-zero offset angle between the first plane and the second plane.

According to one aspect, a pump comprises: a pump frame at least partially defining a shaft aperture; a crankshaft extending through the shaft aperture; a plurality of first plungers connected to the crankshaft and configured to reciprocate relative to the crankshaft as the crankshaft rotates, each of the plurality of first plungers configured to reciprocate in a first plane; and a plurality of second plungers connected to the crankshaft and configured to reciprocate relative to the crankshaft as the crankshaft rotates, each of the plurality of second plungers configured to reciprocate in a second plane; wherein a non-zero offset angle is defined between the first plane and the second plane.

In one embodiment of the pump, the non-zero offset angle ranges from about forty-five degrees to about one-hundred-eighty degrees.

In one embodiment, the pump further comprises a plurality of crankpins mounted along the crankshaft, wherein each of the plurality of crankpins being offset from a longitudinal rotation axis of the crankshaft, and each of the plurality of crankpins being connected to one of the plurality of first plungers and one of the plurality of second plungers; wherein the first and second plungers are configured to move in opposite directions to draw fluid and to discharge fluid; wherein each of the plurality of first plungers configured to draw in fluid at a first pressure and discharge fluid at a second pressure greater than the first pressure, and each of the plurality of second plungers configured to draw in fluid at a third pressure and discharge fluid at a fourth pressure greater than the third pressure.

In embodiments, the pump can include a first pair of plungers comprising a first one of the plurality of first plungers and a first one of the plurality of second plungers, and a second pair of plungers comprising a second one of the plurality of first plungers and a second one of the plurality of second plungers; and wherein the first pair of plungers is offset from the second pair of plungers such that the firs pair of plungers and the second pair of plungers are engaged in a non-consecutive firing sequence sufficient to provide at least partial cancellation of forces generated by the first and second pairs of plungers.

In embodiments, the pump further comprises a plurality of connector rods, each of the connector rods configured to connect one of the plurality first plungers to one of a plurality of crankpins or one of the plurality of second plungers to one of the plurality of crankpins; each of the connector rods comprising a plunger end connected to one of the plurality first plungers or one of the plurality of second plungers; and a crank end connected to one of the plurality of crankpins, each of the crank ends comprising at least one crank end connector.

In embodiments, the pump further comprises a drive assembly configured to be driven by one or more prime movers. In some embodiments of the pump, the one or more prime movers comprise one or more gas turbine engines, electric motors, or combinations thereof.

In embodiments of the pump, the drive assembly comprises: a first pinion gear engaged with the crankshaft at a first end of the pump frame; a connector shaft having a first end connected to the first pinion gear; and a second pinion gear connected to a second end of the connector shaft at a second end of the pump frame, and engaged with the crankshaft at the second end of the pump frame; wherein the first pinion gear is configured to drive the crankshaft at the first end of the pump frame upon rotation of the crankshaft, such that the connector shaft drives the second pinion gear at the second end of the pump frame, and the second pinion gear drives the crankshaft at the second end of the pump frame.

In embodiments of the pump, the drive assembly comprises: at least one planetary gearbox connected to the pump at a first end of the pump frame, at a second end of the pump frame, or at both the first and the second end of the pump frame, the planetary gearbox comprising: a sun gear engaged with the crankshaft at the first end of the pump frame; a ring gear surrounding the sun gear; and a plurality of planetary gears disposed between the ring gear and the sun gear and configured to engage with the ring gear, and sun gear such that rotation of the sun gear is translated to the ring gear.

In embodiments of the pump, one or more of: the plurality of first plungers reciprocate in a first direction away from the crankshaft and a second direction opposite the first direction and toward the crankshaft, the first direction and the second direction lie in the first plane, the first direction having a downward component and an outward component, and the second direction having an upward component and an inward component; or the plurality of second plungers reciprocate in a third direction away from the crankshaft and a fourth direction opposite the third direction and toward the crankshaft, the third direction and the fourth direction lying in the second plane, the third direction having a downward component and an outward component, and the fourth direction having an upward component and an inward component.

In embodiments of the pump, the plurality of first plungers comprises at least three plungers, and the plurality of second plungers comprises at least three plungers.

In embodiments of the pump, the pump frame comprises a plurality of pump frame sections, each of the plurality of pump frame sections at least partially defining the shaft aperture; and wherein at least one of the plurality of pump frame sections has an inverted V-shaped cross-section as viewed in a direction substantially parallel to a longitudinal axis of the crankshaft.

In another aspect, a hydraulic fracturing pump is provided to enhance flow of fracturing fluid into a wellhead during a high-pressure fracturing operation, the hydraulic fracturing pump comprising: a pump frame at least partially defining a shaft aperture; a crankshaft extending through the shaft aperture, the crankshaft comprising a plurality of crankpins, each of the crankpins being offset from a longitudinal rotation axis of the crankshaft; a plurality of first plungers, each of the plurality of first plungers being connected to the crankshaft via a respective crankpin of the plurality of crankpins and configured to reciprocate relative to the crankshaft as the crankshaft rotates; and a plurality of second plungers, each of the plurality of second plungers being connected to the crankshaft via a respective crankpin of the plurality of crankpins and configured to reciprocate relative to the crankshaft as the crankshaft rotates, each of the plurality of crankpins being connected to one of the plurality of first plungers and one of the plurality of second plungers.

In embodiments, the hydraulic fracturing pump further comprises a plurality of connector rods, each of the connector rods connecting one of the plurality first plungers to one of the plurality of crankpins or one of the plurality of second plungers to one of the plurality of crankpins.

In embodiments of the hydraulic fracturing pump, each of the plurality of connector rods comprises: a plunger end connected to one of the plurality first plungers or one of the plurality of second plungers; and a crank end connected to one of the plurality of crankpins, each of the crank ends comprising two crank end connectors separated by a crank end space.

In embodiments of the hydraulic fracturing pump, the plurality of connector rods comprises: a plurality of first connector rods, each of the plurality of first connector rods being connected to one of the plurality of first plungers; and a plurality of second connector rods, each of the plurality of second connector rods being connected to one of the plurality of second plungers, wherein a crank end connector of each of the plurality of first connector rods is positioned at least partially in a crank end space of one of the plurality of second connector rods and a crank end connector of each of the plurality of second connector rods is positioned at least partially in a crank end space of one of the plurality of first connector rods.

In embodiments of the hydraulic fracturing pump each of the plurality of first plungers reciprocates in a first plane, and each of the plurality of second plungers reciprocates in a second plane, the first plane and the second plane defining a non-zero offset angle between the first plane and the second plane.

In embodiments of the hydraulic fracturing pump the plurality of first plungers is positioned to pump a first fracturing fluid comprising a first fracturing fluid composition while the plurality of second plungers to pumps a second fracturing fluid comprising a second fracturing fluid composition different than the first fracturing fluid composition, and wherein the first fracturing fluid composition comprises proppants, and the second fracturing fluid composition comprises water and is devoid of proppants.

In embodiments, the hydraulic fracturing pump further comprises: a first fluid end connected to the pump frame such that the plurality of first plungers draw fracturing fluid into the first fluid end at a first pressure and discharge the fracturing fluid from the first fluid end at a second pressure greater than the first pressure; and a second fluid end connected to the pump frame such that the plurality of second plungers draw fracturing fluid into the second fluid end at a third pressure and discharge the fracturing fluid from the second fluid end at a fourth pressure greater than the third pressure.

In embodiments of the hydraulic fracturing pump, one or more of: one or more of the plurality of first plungers or the first fluid end are configured such that as each of the plurality of first plungers travels in a first direction, fracturing fluid is drawn into the first fluid end and fracturing fluid is discharged from the first fluid end, and as each of the plurality of first plungers travels in a second direction opposite the first direction, fracturing fluid is drawn into the first fluid end and fracturing fluid is discharged from the first fluid end; or one or more of the plurality of second plungers or the second fluid end are configured such that as each of the plurality of second plungers travels in a third direction, fracturing fluid is drawn into the second fluid end and fracturing fluid is discharged from the second fluid end, and as each of the plurality of second plungers travels in a fourth direction opposite the third direction, fracturing fluid is drawn into the second fluid end and fracturing fluid is discharged from the second fluid end.

In embodiments of the hydraulic fracturing pump, the pump frame comprises a plurality of pump frame sections and at least one of the plurality of pump frame sections has an upright or inverted V-shaped cross-section as viewed in a direction substantially parallel to a longitudinal axis of the crankshaft.

According to another aspect, a method of assembling a hydraulic fracturing unit is provided, the method comprising: connecting a plurality of first plungers to a crankshaft of a hydraulic fracturing pump, each of the plurality of first plungers positioned to reciprocate relative to the crankshaft as the crankshaft rotates and each of the plurality of first plungers configured to reciprocate in a first plane and draw in fracturing fluid at a first pressure and discharge the fracturing fluid at a second pressure greater than the first pressure; and connecting a plurality of second plungers to the crankshaft of the hydraulic fracturing pump, each of the plurality of second plungers positioned to reciprocate relative to the crankshaft as the crankshaft rotates and each of the plurality of second plungers configured to reciprocate in a second plane and draw in fracturing fluid at a third pressure and discharge the fracturing fluid at a fourth pressure greater than the third pressure, the first plane and the second plane defining a non-zero offset angle between the first plane and the second plane.

In embodiments of the method, the crankshaft comprises a plurality of crankpins each offset from a longitudinal rotation axis of the crankshaft; and connecting the plurality of first plungers to the crankshaft and connecting the plurality of second plungers to the crankshaft comprises connecting one of the plurality of first plungers and one of the plurality of second plungers to each of the plurality of crankpins.

In embodiments of the method, each of the plurality of first plungers has a first diameter and each of the plurality of second plungers has a second diameter, and connecting one of the plurality of first plungers and one of the plurality of second plungers to each of the plurality of crankpins comprises connecting the one of the plurality of first plungers and the one of the plurality of second plungers to each of the plurality of crankpins such that a longitudinal distance occupied by the one of the plurality of first plungers and the one of the plurality of second plungers is less than a sum of the first diameter and the second diameter.

In embodiments of the method, the hydraulic fracturing unit comprises a platform having a longitudinal platform axis and a width perpendicular to the longitudinal platform axis, the method further comprising connecting the hydraulic fracturing pump to the platform, such that a longitudinal axis of the crankshaft is parallel to the longitudinal platform axis. In some embodiments, connecting the hydraulic fracturing pump to the platform comprises connecting the hydraulic fracturing pump to the platform, such that one or more of the plurality of first plungers or the plurality of second plungers are closer to the platform than the crankshaft.

In embodiments, connecting the plurality of first plungers to the crankshaft of the hydraulic fracturing pump and connecting the plurality of second plungers to the crankshaft of the hydraulic fracturing pump comprises arranging first and second plungers of each of the plurality of first plungers and the plurality of second plungers in plunger groups with adjacent groups of plungers offset by between about 45 degrees to about 90 degrees; wherein during pumping of the fracturing fluid, the plunger groups are engaged in a non-consecutive sequence to provide at least partial force cancellation of forces generated by the plunger groups.

In embodiments, the method comprises connecting a first fluid end to the hydraulic fracturing pump, such that the plurality of first plungers reciprocate in the first fluid end; and connecting a second fluid end to the hydraulic fracturing pump, such that the plurality of second plungers reciprocate in the second fluid end.

In another aspect, a method to increase a service interval of a hydraulic fracturing pump associated with a high-pressure fracturing operation is provided, the method comprising: pumping a first fracturing fluid comprising a first fracturing fluid composition via a plurality of first plungers of a hydraulic fracturing pump; and while pumping the first fracturing fluid, pumping a second fracturing fluid comprising a second fracturing fluid composition via a plurality of second plungers of the hydraulic fracturing pump, the first fracturing fluid composition being different than the second fracturing fluid composition.

In embodiments, the first and second plungers of each of the plurality of first plungers and the plurality of second plungers are arranged in plunger groups; and wherein pumping the first fracturing fluid and pumping the second fracturing fluid comprises engaging plunger groups in a non-consecutive sequence sufficient to provide at least partial force cancellation of forces generated by the plunger groups.

In embodiments of the method, pumping the first fracturing fluid and pumping the second fracturing fluid comprise driving opposite ends of a crankshaft of the hydraulic fracturing pump from opposite ends thereof.

In embodiments of the method, the hydraulic fracturing pump comprises a drive assembly including at least one planetary gearbox arranged at an end of the hydraulic fracturing pump; and wherein driving the crankshaft comprises: rotating a sun gear of the planetary gearbox coupled to a first one of the opposite ends of the crankshaft, the rotation of the sun gear being translated to a ring gear by a plurality of planetary ears arranged between the sun gear and the ring gear; driving a first pinion gear with the rotation of the ring gear, the first pinion gear engaged with a connector shaft at a first end thereof; and driving a second pinion gear engaged with the connector shaft at a second end thereof the second pinion configured to engage with and drive rotation of the crankshaft from a second one of the opposite ends of the crankshaft.

Still other aspects and advantages of these exemplary embodiments and other embodiments, are discussed in detail herein. Moreover, it is to be understood that both the foregoing information and the following detailed description provide merely illustrative examples of various aspects and embodiments, and are intended to provide an overview or framework for understanding the nature and character of the claimed aspects and embodiments. Accordingly, these and other objects, along with advantages and features of the present disclosure, will become apparent through reference to the following description and the accompanying drawings. Furthermore, it is to be understood that the features of the various embodiments described herein are not mutually exclusive and may exist in various combinations and permutations.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain principles of the embodiments discussed herein. No attempt is made to show structural details of this disclosure in more detail than can be necessary for a fundamental understanding of the embodiments discussed herein and the various ways in which they can be practiced. According to common practice, the various features of the drawings discussed below are not necessarily drawn to scale. Dimensions of various features and elements in the drawings can be expanded or reduced to more clearly illustrate embodiments of the disclosure.

DETAILED DESCRIPTION

The drawings include like numerals to indicate like parts throughout the several views, the following description is provided as an enabling teaching of exemplary embodiments, and those skilled in the relevant art will recognize that many changes may be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances. Thus, the following description is provided as illustrative of the principles of the embodiments and not in limitation thereof.

The phraseology and terminology used herein is for the purpose of description and should not be regarded as limiting. As used herein, the term "plurality" refers to two or more items or components. The terms "comprising," "including," "carrying," "having," "containing," and "involving," whether in the written description or the claims and the like, are open-ended terms, i.e., to mean "including but not limited to," unless otherwise stated. Thus, the use of such terms is meant to encompass the items listed thereafter, and equivalents thereof, as well as additional items. The transitional phrases "consisting of" and "consisting essentially of," are closed or semi-closed transitional phrases, respectively, with respect to any claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish claim elements.

Figure 1:
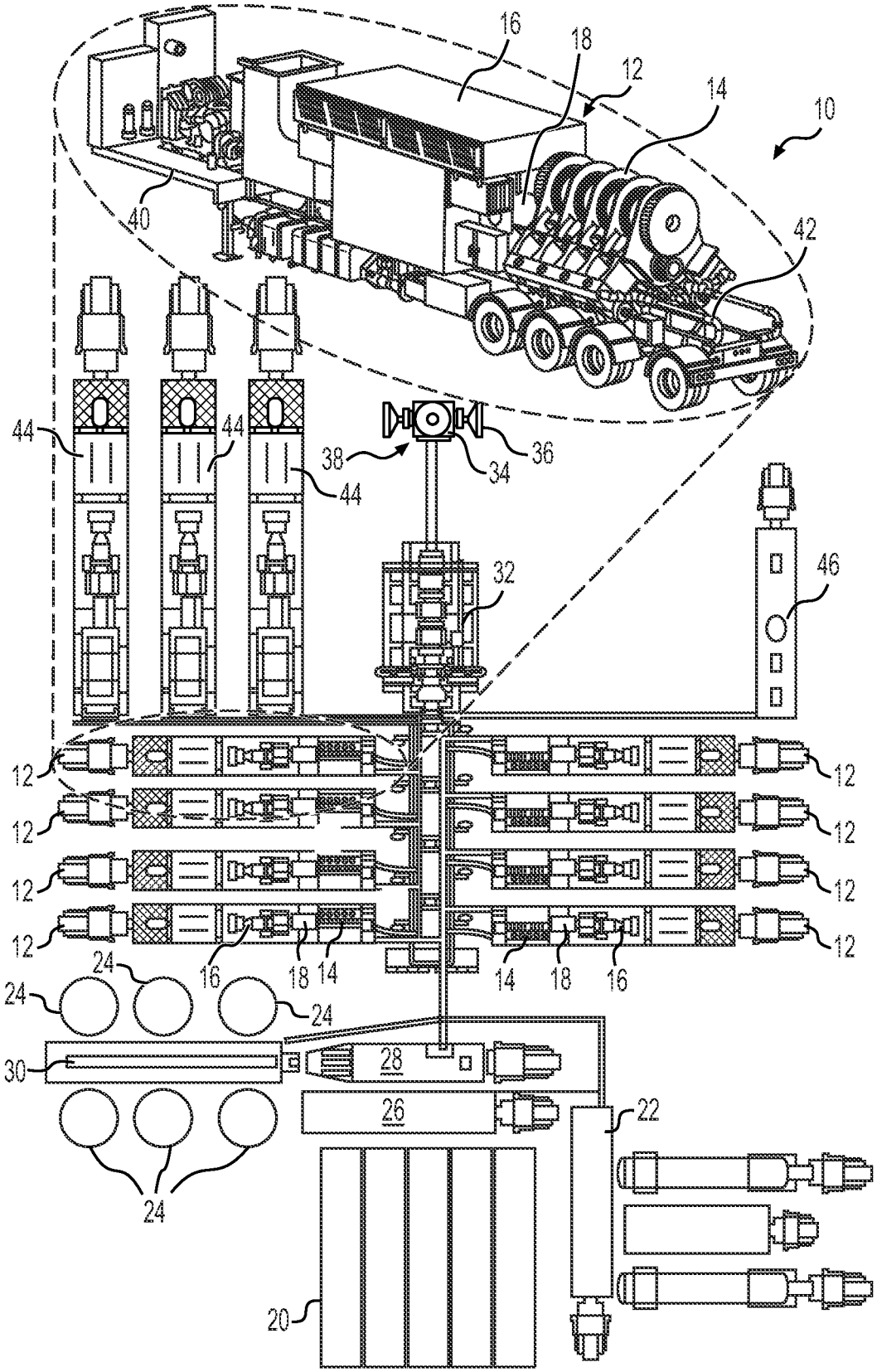
FIG. 1 schematically illustrates an example hydraulic fracturing system including a plurality of hydraulic fracturing units according to embodiments of the disclosure.

FIG. 1 schematically illustrates a top view of an example hydraulic fracturing system 10 including a plurality of hydraulic fracturing units 12 and showing an example pump 14 according to embodiments of the disclosure. The pump 14 may be suitable for pumping any one or more fluid(s). In some embodiments, the pump 14 may be a hydraulic fracturing pump. In some embodiments, the hydraulic fracturing pump 14 may be capable of providing a higher pumping capacity while still having physical dimensions enabling transportation of the hydraulic fracturing unit 12 including the hydraulic fracturing pump 14 on public highways, as explained in more detail herein. Alternatively, or in addition, some embodiments of the hydraulic fracturing pump 14 may operate with relatively low shock magnitude and/or or vibration magnitude resulting from, for example, torque pulses generated by the hydraulic fracturing pump 14.

In some embodiments, one or more of the hydraulic fracturing units 12 may include a hydraulic fracturing pump 14 driven by a prime mover 16, such as an internal combustion engine. For example, the prime movers 16 may include gas turbine engines (GTEs) or reciprocating-piston engines. In some embodiments, each of the hydraulic fracturing units 12 may include a directly-driven turbine (DDT) hydraulic fracturing pump 14, in which the hydraulic fracturing pump 14 is connected to one or more GTEs that supply power to the respective hydraulic fracturing pump 14 for supplying fracturing fluid at high pressure and high flow rates to a formation. For example, the GTE may be connected to a respective hydraulic fracturing pump 14 via a transmission 18 (e.g., a reduction transmission) connected to a drive shaft, which, in turn, is connected to a driveshaft or input flange of a respective hydraulic fracturing pump 14, which may be a reciprocating hydraulic fracturing pump. Other types of engine-to-pump arrangements are contemplated as will be understood by those skilled in the art.

In some embodiments, one or more of the GTEs may be a dual-fuel or bi-fuel GTE, for example, capable of being operated using of two or more different types of fuel, such as natural gas and diesel fuel, although other types of fuel are contemplated. For example, a dual-fuel or bi-fuel GTE may be capable of being operated using a first type of fuel, a second type of fuel, and/or a combination of the first type of fuel and the second type of fuel. For example, the fuel may include gaseous fuels, such as, for example, compressed natural gas (CNG), natural gas, field gas, pipeline gas, methane, propane, butane, and/or liquid fuels, such as, for example, diesel fuel (e.g., #2 diesel), bio-diesel fuel, bio-fuel, alcohol, gasoline, gasohol, aviation fuel, and other fuels as will be understood by those skilled in the art. Gaseous fuels may be supplied by CNG bulk vessels, a gas compressor, a liquid natural gas vaporizer, line gas, and/or well-gas produced natural gas. Other types and associated fuel supply sources are contemplated. The one or more prime movers 16 may be operated to provide horsepower to drive the transmission 18 connected to one or more of the hydraulic fracturing pumps 14 to safely and successfully fracture a formation during a well stimulation project or fracturing operation.

In some embodiments, the prime mover 16 may include one or more electric motors. The electric motor may be rated for over 2,000 hp over 5,000 hp, or over 10,000 hp, for example, for the hydraulic fracturing pump 14 to generate a desired pressure and flow rate. The electric motor may include a stator having stator windings for generating a rotating magnetic field at a synchronous speed corresponding to a frequency of a voltage applied to the stator windings. The motor may also include a rotor having rotor windings for interacting with the rotating magnetic field to rotate the rotor. The rotor windings may be configured to generate rotating magnetic poles for interacting with the rotating magnetic field. In one or more embodiments, the electric motor may be an induction electric motor in which the rotating magnetic poles in the rotor are induced by the rotating magnetic field in the stator. In one or more embodiments, the electric motor may be a multi-phase electric motor, such as a three-phase motor for example.

The electric motor may include a single shaft electric motor or a dual shaft electric motor. In one or more embodiments, the electric motor and two or more hydraulic fracturing pump 14 may be disposed upon a single chassis. For example, the electric a motor may be disposed on a single chassis and arranged between two hydraulic fracturing pumps 14 in manner similar to the pump arrangements described in U.S. Pat. No. 9,395,049, the disclosure of which is incorporated by reference herein in its entirety. In some embodiments, two or more electric motors and two or more hydraulic fracturing pumps 14 may be disposed upon a single chassis. For example, a first electric motor may be connected to or otherwise mechanically linked with a first hydraulic fracturing pump 14 and a second electric motor may be connected to or otherwise mechanically linked with a second hydraulic fracturing pump 14, each first and second electric motor and the first and second hydraulic fracturing pump 14 being disposed on a single chassis and may be arranged in a manner similar to the pump arrangements described in U.S. Pat. No. 11,118,438, the disclosure of which is incorporated by reference herein in its entirety. For example, each electric motor and corresponding hydraulic fracturing pump 14 may be contained as a single module and a plurality of such modules may be disposed on a single chassis.

In one or more embodiments, the electric motor may be supplied with a voltage having a fixed frequency or a voltage having a variable frequency. For example, a voltage with a fixed frequency may be applied to a stator of the electric motor and, hence, the electric motor may be referred to as a fixed-frequency motor. Electric power to a motor control center may be supplied by an on-site power source, such as on-site diesel generators, natural gas reciprocating engine generators, or turbine generators, or by an off-site power source, such as utility grid power. In some embodiments, the motor control center may be disposed with the electric motor and the hydraulic fracturing pump 14 on a single chassis. In other embodiments, a voltage with a variable frequency may be applied to a stator of the electric motor. In such embodiments, a remotely controllable variable frequency drive (VFD) may be disposed, along with the electric motor(s) and the hydraulic fracturing pump(s) 14, on a single chassis. The VFD may be coupled to or otherwise electrically linked with a power source as described herein. The VFD may be configured to provide electric power to the one or more electric motors.

In some embodiments, a plurality of electric motors may be connected to or otherwise mechanically linked with one hydraulic fracturing pump 14. For example, the plurality of electric motors may each be connected to a crankshaft of the hydraulic fracturing pump 14. The plurality of electric motors may include any suitable number of electric motors (e.g., from 2 electric motors to 7 electric motors or more). In some embodiments, at least five electric motors may be coupled to the crankshaft in a manner such that each electric motor may be positioned about the pump crankshaft axis so that an output shaft of each electric motor is spaced apart from a longitudinal rotation axis of the crankshaft. For example, the plurality of electric motors can be arranged on or connected to the hydraulic fracturing pump 14 in a manner similar to the electric motor arrangement(s) described in U.S. Pre-Grant Publication No. 2021/0095648, the disclosure of which is incorporated by reference herein in its entirety.

In some embodiments, the fracturing fluid may include, for example, water, proppants, and/or other additives, such as thickening agents and/or gels. For example, proppants may include grains of sand, ceramic beads or spheres, shells, and/or other particulates, and may be added to the fracturing fluid, along with gelling agents to create a slurry as will be understood by those skilled in the art. The slurry may be forced via the hydraulic fracturing pumps 14 into the formation at rates faster than can be accepted by the existing pores, fractures, faults, or other spaces within the formation. As a result, pressure in the formation may build rapidly to the point where the formation fails and begins to fracture. By continuing to pump the fracturing fluid into the formation, existing fractures in the formation may be caused to expand and extend in directions away from a well bore, thereby creating additional flow paths for hydrocarbons to flow to the well. The proppants may serve to prevent the expanded fractures from closing or may reduce the extent to which the expanded fractures contract when pumping of the fracturing fluid is ceased. Once the well is fractured, large quantities of the injected fracturing fluid may be allowed to flow out of the well, and the water and any proppants not remaining in the expanded fractures may be separated from hydrocarbons produced by the well to protect downstream equipment from damage and corrosion. In some instances, the production stream of hydrocarbons may be processed to neutralize corrosive agents in the production stream resulting from the fracturing process.

In the example shown in FIG. 1, the hydraulic fracturing system 10 may include one or more water tanks 20 for supplying water for fracturing fluid, one or more chemical additive units 22 for supplying gels or agents for adding to the fracturing fluid, and one or more proppant tanks 24 (e.g., sand tanks) for supplying proppants for the fracturing fluid. The example fracturing system 10 shown also includes a hydration unit 26 for mixing water from the water tanks 20 and gels and/or agents from the chemical additive units 22 to form a mixture, for example, gelled water. The example shown also includes a blender 28, which receives the mixture from the hydration unit 26 and proppants via conveyers 30 from the proppant tanks 24. The blender 28 may mix the mixture and the proppants into a slurry to serve as fracturing fluid for the hydraulic fracturing system 10. Once combined, the slurry may be discharged through low-pressure hoses, which convey the slurry into two or more low-pressure lines in a fracturing manifold 32. In the example shown, the low-pressure lines in the fracturing manifold 32 may feed the slurry to the hydraulic fracturing pumps 14 through low-pressure suction hoses as will be understood by those skilled in the art.

The hydraulic fracturing pumps 14, driven by the respective internal GTEs 16, discharge the slurry (e.g., the fracturing fluid including the water, agents, gels, and/or proppants) at high flow rates and/or high pressures through individual high-pressure discharge lines into two or more high-pressure flow lines, sometimes referred to as "missiles," on the fracturing manifold 32. The flow from the high-pressure flow lines is combined at the fracturing manifold 32, and one or more of the high-pressure flow lines provide fluid flow to a manifold assembly 34, sometimes referred to as a "goat head." The manifold assembly 34 delivers the slurry into a wellhead manifold 36. The wellhead manifold 36 may be configured to selectively divert the slurry to, for example, one or more wellheads 38 via operation of one or more valves. Once the fracturing process is ceased or completed, flow returning from the fractured formation discharges into a flowback manifold, and the returned flow may be collected in one or more flowback tanks as will be understood by those skilled in the art.

As schematically depicted in FIG. 1, one or more of the components of the fracturing system 10 may be configured to be portable, so that the hydraulic fracturing system 10 may be transported to a well site, quickly assembled, operated for a relatively short period of time, at least partially disassembled, and transported to another location of another well site for use. For example, the components may be connected to and/or supported on a chassis 40, for example, a trailer and/or a support incorporated into a truck, so that they may be easily transported between well sites. In some embodiments, the prime mover 16, the transmission 18, and/or the hydraulic fracturing pump 14 may be connected to the chassis 40. For example, the chassis 40 may include a platform 42, and the transmission 18 may be connected to the platform 42, and the prime mover 16 may be connected to the transmission 18. In some embodiments, the prime mover 16 may be connected to the transmission 18 without also connecting the prime mover 16 directly to the platform 42, which may result in fewer support structures being needed for supporting the prime mover 16, transmission 18, and/or hydraulic fracturing pump 14 on the chassis 40.

In some embodiments, two or more hydraulic fracturing pumps 14 may be connected to the chassis 40. For example, the chassis 40 may include the prime mover 16 disposed or situated between two hydraulic fracturing pumps 14. In such example, the prime mover 16 may be a dual-shaft electric motor wherein each output shaft of the motor is connected to one of the hydraulic fracturing pumps 14. In one or more embodiments, the chassis 40 may include a plurality of prime movers 16 and hydraulic fracturing pumps 14. For example, the chassis 40 may include a first prime mover 16 mechanically linked to a first hydraulic fracturing pump 14 and a second prime mover 16 mechanically linked to a second hydraulic fracturing pump 14.

As shown in FIG. 1, some embodiments of the hydraulic fracturing system 10 may include one or more fuel supplies 44 for supplying the prime movers 16 and any other fuel-powered components of the hydraulic fracturing system 10, such as auxiliary equipment, with fuel. The fuel supplies 44 may include gaseous fuels, such as compressed natural gas (CNG), natural gas, field gas, pipeline gas, methane, propane, butane, and/or liquid fuels, such as, for example, diesel fuel (e.g., #2 diesel), bio-diesel fuel, bio-fuel, alcohol, gasoline, gasohol, aviation fuel, and other fuels as will be understood by those skilled in the art. Gaseous fuels may be supplied by CNG bulk vessels, such as fuel tanks coupled to trucks, a gas compressor, a liquid natural gas vaporizer, line gas, and/or well-gas produced natural gas. The fuel may be supplied to the hydraulic fracturing unit assemblies 12 by one of more fuel lines supplying the fuel to a fuel manifold and unit fuel lines between the fuel manifold and the hydraulic fracturing units 12. Other types and associated fuel supply sources and arrangements are contemplated as will be understood by those skilled in the art.

As shown in FIG. 1, some embodiments also may include one or more data centers 46 configured to facilitate receipt and transmission of data communications related to operation of one or more of the components of the hydraulic fracturing system 10. Such data communications may be received and/or transmitted via hard-wired communications cables and/or wireless communications, for example, according to known communications protocols. For example, the data centers 46 may contain at least some components of a hydraulic fracturing control assembly, such as a supervisory controller configured to receive signals from components of the hydraulic fracturing system 10 and/or communicate control signals to components of the hydraulic fracturing system 10, for example, to at least partially control operation of one or more components of the hydraulic fracturing system 10, such as, for example, the prime movers 16, the transmissions 18, and/or the hydraulic fracturing pumps 14 of the hydraulic fracturing units 12, the chemical additive units 22, the hydration units 26, the blender 28, the conveyers 30, the fracturing manifold 32, the manifold assembly 34, the wellhead manifold 36, and/or any associated valves, pumps, and/or other components of the hydraulic fracturing system 10.

Figure 2A:
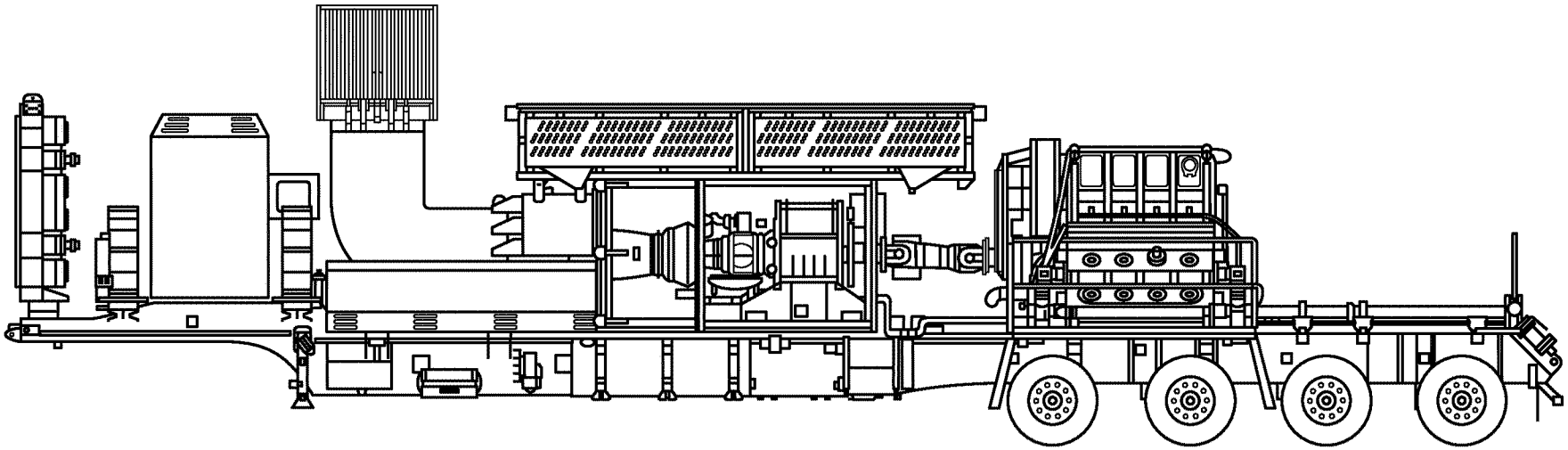
FIG. 2A is a schematic side view of an example hydraulic fracturing unit according to embodiments of the disclosure.
Figure 2B:
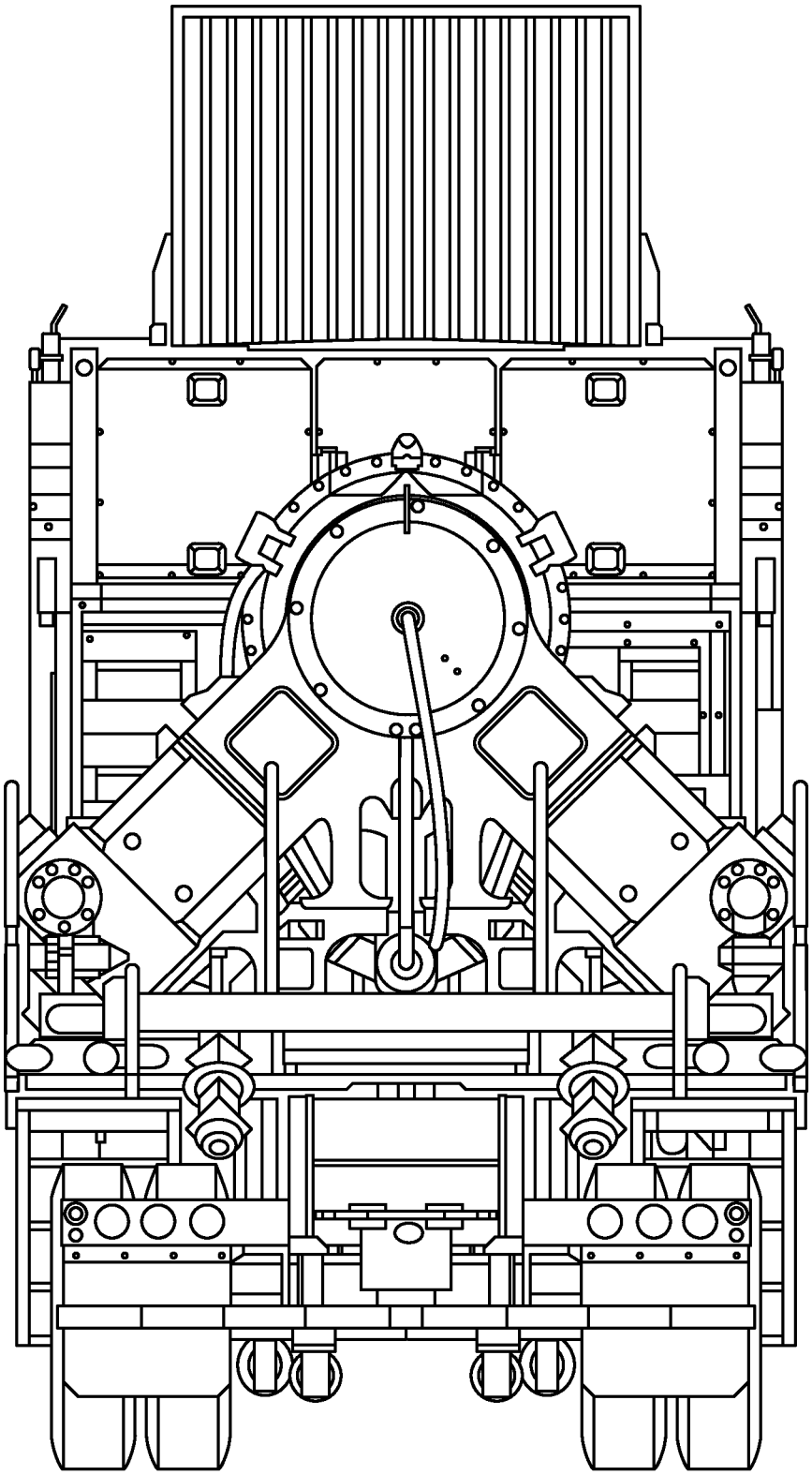
FIG. 2B is a schematic end view of the example hydraulic fracturing unit shown in FIG. 2A according to embodiments of the disclosure.

FIG. 2A is a schematic side view of an example hydraulic fracturing unit 12 according to embodiments of the disclosure, and FIG. 2B is a schematic end view of the example hydraulic fracturing unit 12 shown in FIG. 2A according to embodiments of the disclosure. As shown in FIG. 2A, in some embodiments, the transmission 18 may include a transmission input shaft 48 connected to a prime mover output shaft 50 (e.g., a turbine output shaft), such that the transmission input shaft 48 rotates at the same rotational speed as the prime mover output shaft 50. The transmission 18 may also include a transmission output shaft 52 positioned to be driven by the transmission input shaft 48 at a different rotational speed than the transmission input shaft 48. In some embodiments, the transmission 18 may be a reduction transmission, such as a reduction gearbox, which results in the transmission output shaft 52 having a relatively slower rotational speed than the transmission input shaft 48. The transmission 18 may include a continuously variable transmission, an automatic transmission including one or more planetary gear trains 200 (FIGS. 4A-4F), a transmission shiftable between different ratios of input-to-output, etc., or any other suitable of types of transmissions as will be understood by those skilled in the art.

As shown in FIG. 2A, in some embodiments, the hydraulic fracturing pump 14 may be, for example, a reciprocating fluid pump, as explained herein. In some embodiments, the hydraulic fracturing pump 14 may include a pump drive shaft 54 connected to the transmission output shaft 52, such that the transmission output shaft 52 drives the pump drive shaft 54 at a desired rotational speed. For example, the transmission output shaft 52 may include an output shaft connection flange, and the pump drive shaft 54 may include a drive shaft connection flange, and the output shaft connection flange and the drive shaft connection flange may be coupled to one another, for example, directly connected to one another. In some embodiments, the transmission output shaft 52 and the pump drive shaft 54 may be connected to one another via any known coupling types as will be understood by those skilled in the art (e.g., such as a universal joint and/or a torsional coupling).

As shown in FIG. 2A, in some embodiments, the chassis 40 may be or include a trailer 56 including the platform 42 for supporting components of the hydraulic fracturing unit 12, one or more pairs of wheels 58 facilitating movement of the trailer 56, a pair of retractable supports 60 to support the hydraulic fracturing unit 12 during use, and a tongue 62 including a coupler 64 for connecting the trailer 56 to a truck for transport of the hydraulic fracturing unit 12 between well sites to be incorporated into a hydraulic fracturing system 10 of a well site fracturing operation, as will be understood by those skilled in the art.

As shown in FIGS. 1, 2A, and 2B, some embodiments of the hydraulic fracturing unit 12 may include an enclosure 66 connected to and supported by the chassis 40 according to embodiments of the disclosure. In some embodiments, as shown in FIG. 1, the prime mover 16 may be connected to the transmission 18 via the prime mover output shaft 50 and the transmission input shaft 48, both of which may be substantially contained within the enclosure 66. The prime mover 16 may include an air intake duct 68 and a turbine exhaust duct 70 (e.g., when the prime mover is a GTE) passing through walls of the enclosure 66 and connected to the prime mover 16. The prime mover 16 may be connected to the hydraulic fracturing pump 14 via the transmission 18, with the transmission output shaft 52 connected to the pump drive shaft 54, for example, as explained herein.

As shown in FIGS. 1, 2A, and 2B, some embodiments of the hydraulic fracturing pump 14 may have physical dimensions configured such that the hydraulic fracturing pump 14 does not exceed the space available on the platform 42, for example, while still providing a desired pressure output and/or flow output to assist with performing the fracturing operation as explained herein. For example, referring to FIG. 2A, the hydraulic fracturing pump 14 may have a pump length dimension L substantially parallel to a longitudinal axis X of the platform 42 that facilitates placement and/or connection of the hydraulic fracturing pump 14 on the platform 42, for example, without causing the hydraulic fracturing unit 12 to exceed a length permitted for transportation on public highways, for example, in compliance with government regulations. The pump length dimension L the hydraulic fracturing pump 14 may be greater than 1 meter (m). In one or more embodiments, the pump length dimension L may be from about 0.5 m to about 3 m, from about 0.75 m to about 2.5 m, or from about 1 m to about 2 m. In some embodiments, for example, as shown in FIG. 2B, the hydraulic fracturing pump 14 may have a pump width dimension W substantially perpendicular to a longitudinal axis X of the platform 42 that facilitates placement and/or connection of the hydraulic fracturing pump 14 on the platform 42, for example, without causing the hydraulic fracturing unit 12 to exceed a width permitted for transportation on public highways, for example, in compliance with government regulations. For example, the hydraulic fracturing pump 14 may have a pump width W perpendicular to the longitudinal axis X of the platform, such that the pump width W is less than or equal to the width of the platform WP, for example, as shown in FIG. 2B. In some embodiments, the pump width W may be at least 50%, at least 75%, or at least 90% of the width of the platform WP. For example, a ratio of the pump width W to the width of the platform WP, expressed as W:WP, may be from about 0.8:1, about 0.9:1, about 0.93:1, or about 0.95:1 to about 0.98:1, about 1:1, about 1.05:1, or about 1.1 to 1. As shown in FIGS. 1 and 2B, in some embodiments, as viewed from the rear of the platform 42 and in a direction substantially parallel to the longitudinal axis X of the platform 42, an end of the hydraulic fracturing pump 14 may take on the appearance of an inverted V, as explained in more detail herein.

Figure 3A:
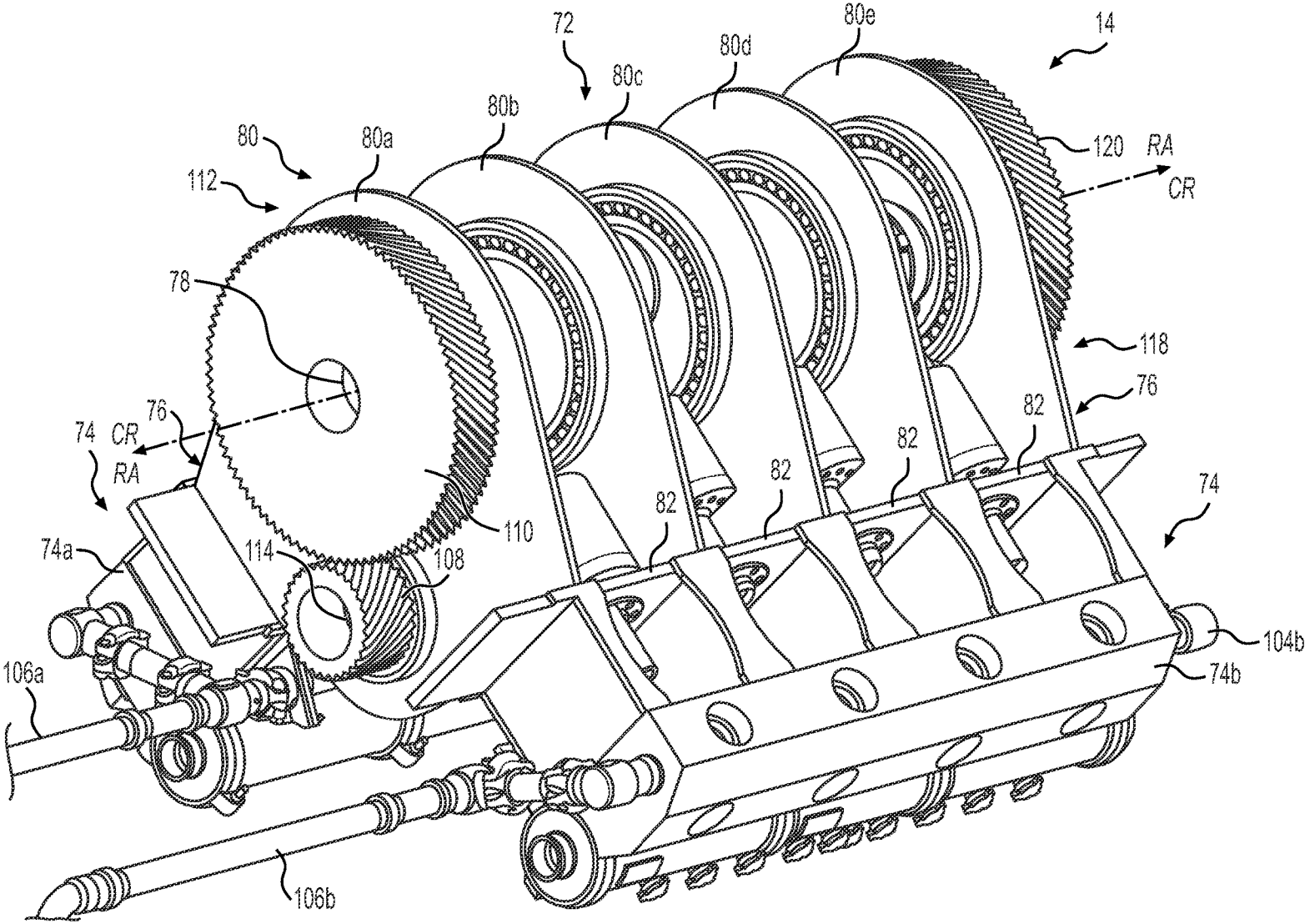
FIG. 3A is a schematic perspective view of an example hydraulic fracturing pump including at least two pinion gears according to embodiments of the disclosure.

FIG. 3A is a schematic perspective view of an example hydraulic fracturing pump 14 including at least two pinion gears according to embodiments of the disclosure. As shown in FIG. 3A, in some embodiments, the hydraulic fracturing pump 14 may include a single power end 72 and respective first and second fluid ends 74*a* and 74*b* connected to the single power end 72. For example, the single power end 72 may include a pump frame 76, the crankshaft 78, and/or the plungers 84 and/or 88. The first fluid end 74*a* and the second fluid end 74*b* may each be connected to the pump frame 76, for example, on opposite lateral sides of the hydraulic fracturing pump 14. In some embodiments, for example, as shown in FIGS. 1, 2A, 2B, and 3A, the first and second fluid ends 74*a* and 74*b* may be connected to the hydraulic fracturing pump 14, and the hydraulic fracturing pump 14 may be connected to the platform 42, such that the first and second fluid ends 74*a* and 74*b* are closer to the platform 42 than the power end 72. For example, the first and second fluid ends 74*a* and 74*b* may be relatively closer to the ground than if the hydraulic fracturing pump 14 was oriented such that the first and second fluid ends 74*a* and 74*b* were farther away from the platform 42 than the power end 72. The example orientation shown may render the fluid ends 74*a* and 74*b* relatively more easily accessible to operators and/or maintenance service personal, for example, during set-up of the hydraulic fracturing unit 12 for a fracturing operation, take-down of the hydraulic fracturing unit 12, for example, once a fracturing operation is completed, and/or during maintenance or service of the hydraulic fracturing unit 12.

Figure 3B:
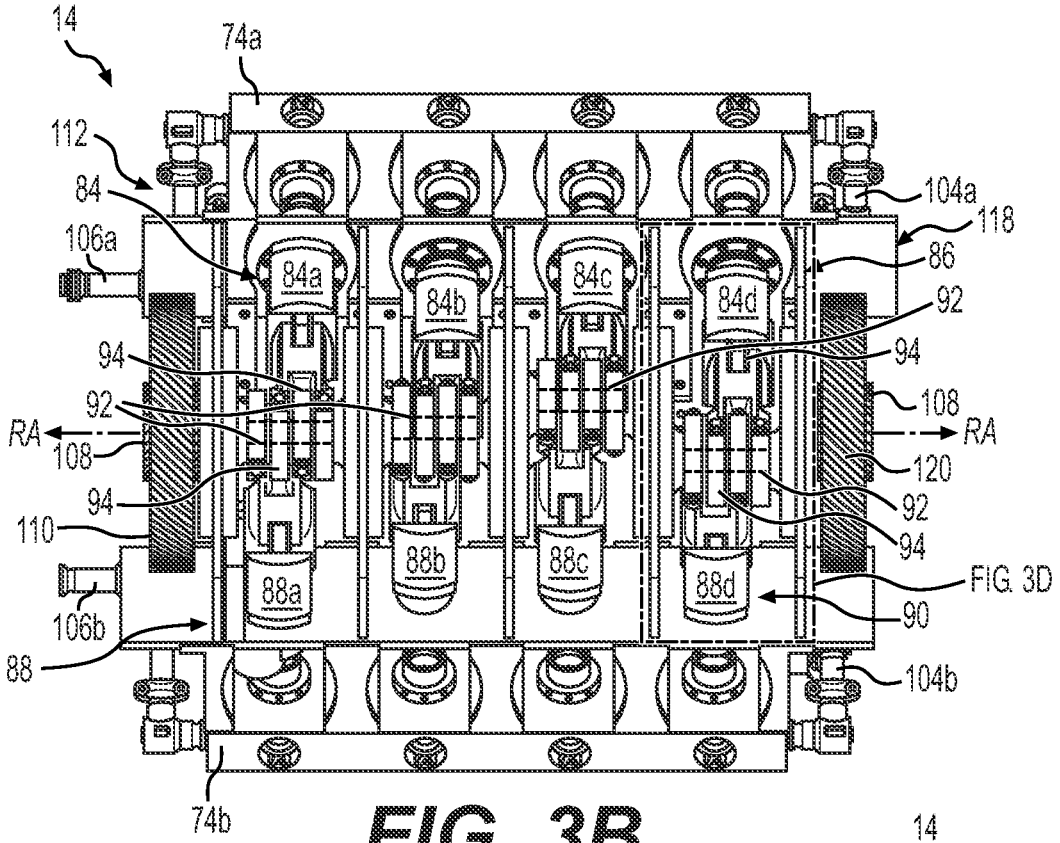
FIG. 3B is a schematic top view of the example hydraulic fracturing pump shown in FIG. 3A according to embodiments of the disclosure.
Figure 3C:
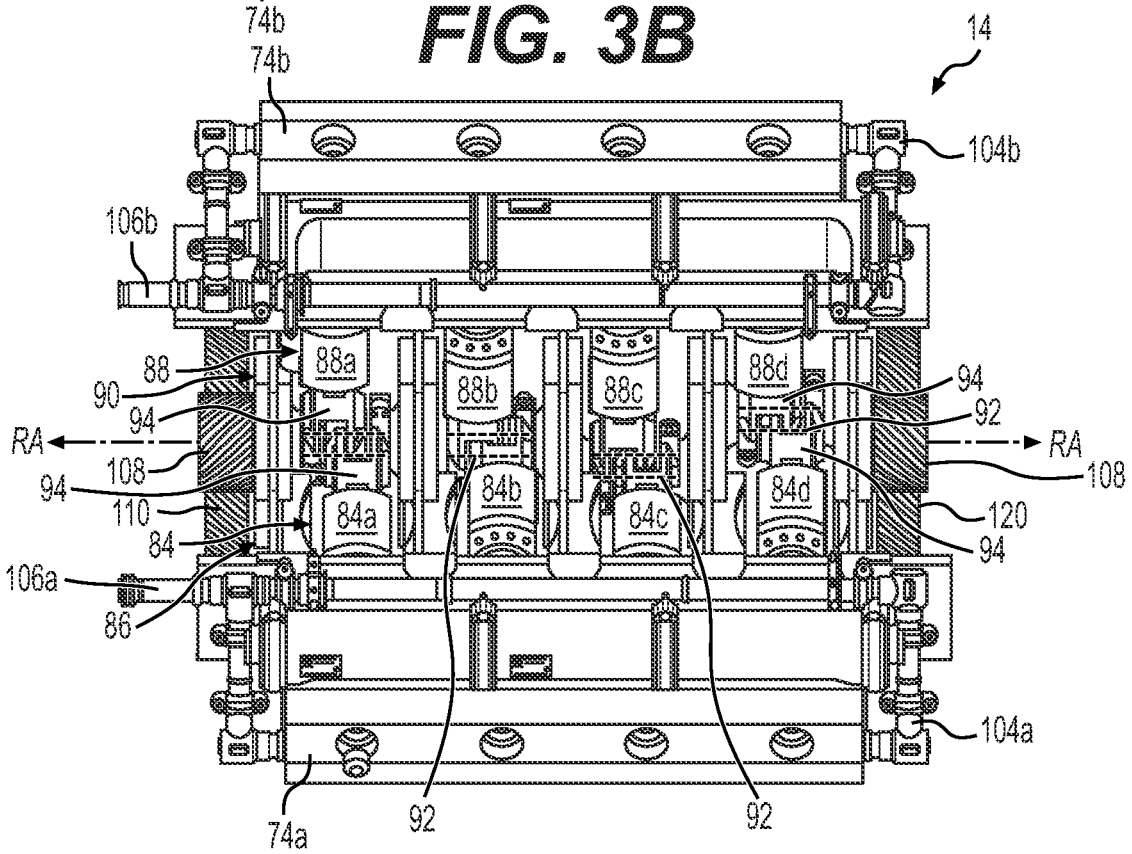
FIG. 3C is a schematic bottom view of the example hydraulic fracturing pump shown in FIG. 3A according to embodiments of the disclosure.
Figure 3D:
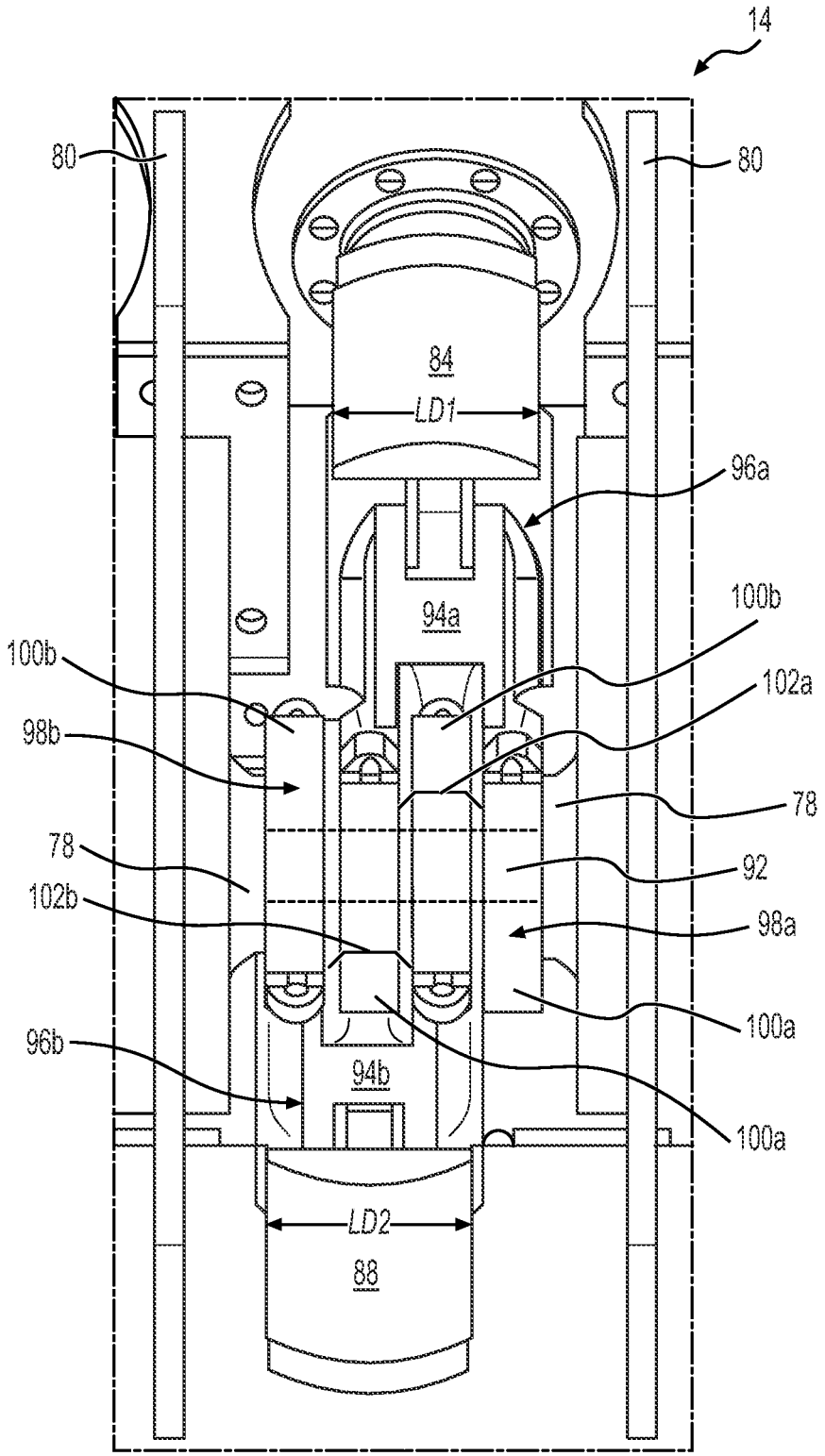
FIG. 3D is a schematic close-up view of an example connector rod and plunger arrangement for the example hydraulic fracturing pump shown in FIG. 3A according to embodiments of the disclosure.
Figure 3E:
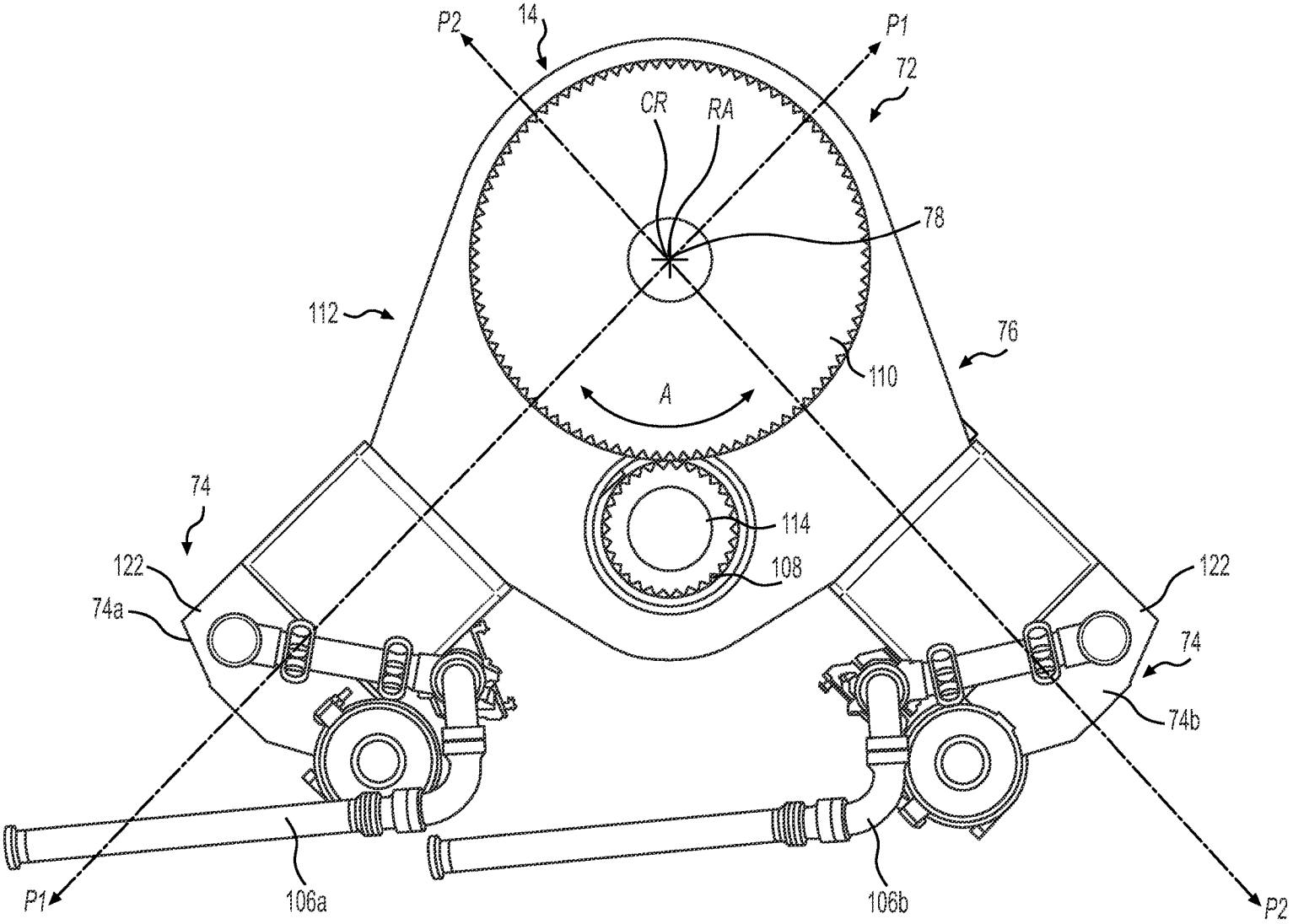
FIG. 3E is a schematic end view of the example hydraulic fracturing pump shown in FIG. 3A according to embodiments of the disclosure.

FIG. 3B is a schematic top view of the example hydraulic fracturing pump 14 shown in FIG. 3A according to embodiments of the disclosure. FIG. 3C is a schematic bottom view of the example hydraulic fracturing pump 14 shown in FIG. 3A according to embodiments of the disclosure. FIG. 3D is a schematic close-up view of an example connector rod and plunger arrangement for the example hydraulic fracturing pump 14 shown in FIG. 3A according to embodiments of the disclosure. FIG. 3E is a schematic end view of the example hydraulic fracturing pump 14 shown in FIG. 3A according to embodiments of the disclosure.

As shown in FIGS. 3A, 3B, 3C, 3D, and 3E in some embodiments, the hydraulic fracturing pump 14 may include the pump frame 76, which may at least partially define a shaft aperture, and a crankshaft 78 extending through the shaft aperture. In some embodiments, the pump frame 76 may include a plurality of pump frame sections 80, and each of the pump frame sections 80 may at least partially define the shaft aperture. For example, as shown in FIG. 3A, the example pump frame 76 includes five pump frame sections 80*a*, 80*b*, 80*c*, 80*d*, and 80*e*. Pump frames 76 having different numbers of pump frame sections 80 are contemplated. For example, the hydraulic fracturing pump 14 may include the pump frame 76 may include any suitable number of pump frame sections 80. In some embodiments, the hydraulic fracturing pump 14 may include from two, three, or four to five, six, eight, ten, or twelve pump frame sections 80. As shown in FIG. 3E, one or more of the pump frame sections 80 may have an inverted V-shaped cross-section as viewed in a direction substantially parallel to a longitudinal axis of the crankshaft CR. In other embodiments (not shown), one or more of the pump frame sections 80 may have an upright V-shaped cross-section as viewed in a direction substantially parallel to a longitudinal axis of the crankshaft CR. In some embodiments, one or more of the pump frame sections 80 may be connected to one another to form the pump frame 76, for example, via frame connectors 82 and/or the first and second fluid ends 74*a* and 74*b*. Though first and second fluid ends 74*a* and 74*b* are shown, the hydraulic fracturing pump 14 may include three or more fluid ends (not shown). In some embodiments, the fracturing pump 14 may include at least three fluid ends and at least three corresponding banks of plungers. For example, one or more pump frame sections may have an inverted Y-shaped cross-section as viewed in a direction substantially parallel to a longitudinal axis of the crankshaft CR, wherein the third fluid end is disposed above the crankshaft 78. In other embodiments, the fracturing pump 14 may include four fluid ends and four corresponding banks of plungers. For example, one or more pump frame sections may have an X-shaped cross-section as viewed in a direction substantially parallel to a longitudinal axis of the crankshaft CR, wherein the third fluid end is disposed above the first fluid end 74*a* and the fourth fluid end is disposed above the second fluid end 74*b*.

As shown in FIGS. 3A, 3B, 3C, 3D, and 3E, in some embodiments, the hydraulic fracturing pump 14 may include a plurality of first plungers 84 connected to the crankshaft 78 and positioned to reciprocate relative to the crankshaft 78 as the crankshaft 78 rotates. For example, as shown in FIGS. 3B and 3C, the hydraulic fracturing pump 14 may include a first bank 86 of four first plungers 84*a*, 84*b*, 84*c*, and 84*d*. In addition, in some embodiments, the hydraulic fracturing pump 14 may include a plurality of second plungers 88 connected to the crankshaft 78 and positioned to reciprocate relative to the crankshaft 78 as the crankshaft 78 rotates. For example, as shown in FIGS. 3B and 3C, the hydraulic fracturing pump 14 may include a second bank 90 of four second plungers 88*a*, 88*b*, 88*c*, and 88*d*. Though four first plungers and four second plungers are shown, the hydraulic fracturing pump 14 may include any suitable number of first and second plungers. In some embodiments, the hydraulic fracturing pump 14 may include from two, three, or four to five, six, eight, ten, or twelve first plungers 84 and from two, three, or four to five, six, eight, ten, or twelve second plungers 88.

Each of the of first plungers 84 may be configured to reciprocate and draw-in fracturing fluid at a first pressure and discharge the fracturing fluid at a second pressure greater than the first pressure. Each of the second plungers 88 may be configured to reciprocate and draw-in fracturing fluid at a third pressure and discharge the fracturing fluid at a fourth pressure greater than the third pressure. For example, the first pressure and/or the third pressure may be substantially equal to a pressure associated with the fracturing fluid being supplied to the hydraulic fracturing pump 14 from the blender 28 (FIG. 1). The second pressure and the fourth pressure may be substantially equivalent to the high pressure of the fracturing fluid being supplied to the wellhead 38 by operation of the prime mover 16, the transmission 18, and the hydraulic fracturing pump 14 of the hydraulic fracturing unit 12. In some embodiments, the first pressure and the third pressure may be substantially the same. In some embodiments, the second pressure and the fourth pressure may be substantially the same. In some embodiments, the first pressure and the third pressure may be different, and/or the second pressure and the fourth pressure may be different.

In some embodiments, for example, as shown in FIG. 3E, each of the first plungers 84 may reciprocate in a first plane P1 and draw-in fracturing fluid at the first pressure and discharge the fracturing fluid at the second pressure, and/or each of the second plungers 88 may reciprocate in a second plane P2 and draw-in fracturing fluid at the third pressure and discharge the fracturing fluid at the fourth pressure. In one or more embodiments, the first plane P1 and the second plane P2 may intersect at the crankshaft axis CR and/or define an offset angle A between the first plane P1 and the second plane P2. For example, the offset angle A may range from zero degree to three hundred and sixty degrees, for example, from about ten degrees to about three hundred degrees, from about thirty degrees to about one two hundred and seventy degrees, or from about forty-five degrees to about one hundred eighty degrees. In some embodiments, the offset angle A between the first plane P1 and the second plane P2 may be a non-zero offset angle. For example, the offset angle A may range from about thirty degrees to about one hundred-eighty degrees, for example, from about ninety degrees to about one hundred-eighty degrees, from about thirty degrees to about one hundred-fifty degrees, from about forty-five degrees to about one hundred thirty-five degrees, from about sixty degrees to about one hundred-twenty degrees, or from about seventy-five degrees to about one hundred-five degrees, for example, about ninety degrees.

In some embodiments, providing the first and second plungers 84 and 88 in different planes may result in increasing the pumping capacity of the hydraulic fracturing pump 14, for example, without substantially increasing the physical dimensions of the hydraulic fracturing pump 14, for example, without substantially increasing the pump length L and/or without substantially increasing the pump width W. In some embodiments, providing the first and second plungers 84 and 88 in different planes may result in relatively reducing the level of shock and/or vibration associated with operation of the hydraulic fracturing pump 14, for example, the level of shock and/or vibration associated with torque shock and/or torque vibration generated during operation of the hydraulic fracturing pump 14, for example, as each of the first plungers 84 and/or each of the second plungers 88 discharges fracturing fluid at the second and fourth pressures, respectively. For example, in some embodiments, the shock and/or torque generated by one or more of the first plungers 84 and/or one or more of the second plungers 88 may substantially offset or cancel one another.

As shown in FIGS. 3B and 3C, in some embodiments, the crankshaft 78 may include a plurality of crankpins 92, and each of the crankpins 92 may be offset from a longitudinal rotation axis RA of the crankshaft 78. In some embodiments, the crankshaft axis CR and the longitudinal rotation axis RA may be substantially co-existent. For example, the crankpins 92 may be spaced from, but parallel to, the longitudinal rotation axis RA, such that as the crankshaft 78 rotates, the first plungers 84 and the second plungers 88 are caused to reciprocate, for example, in respective chambers of the first and second fluid ends 74*a* and 74*b*, for example, a distance equal to two times the offset of the respective crankpin 92 to which the plunger is connected. In some embodiments, one or more of the crankpins 92 may be radially spaced from one another, for example, such that the respective reciprocations of the plungers occur according to a desired timing relative to one another. The crankshaft 78 may include any suitable number of crankpins 92. In some embodiments, the crankshaft 78 may include 1, 2, 3, or 4 to 5, 6, 8, 10, or 12 or more crankpins 92. For example, in the embodiment shown in FIGS. 3B and 3C, the example crankshaft 78 includes four crankpins 92. In some embodiments, each of the crankpins 92 may be radially offset relative to one another by, for example, ninety degrees. This may result in the respective reciprocations of the plungers being spaced from one another. The spacing of the plunger reciprocations may result in at least some force cancellation due to the plungers moving in different directions as more fully described below.

As shown in FIGS. 3B, 3C, and 3D, in some embodiments, the hydraulic fracturing pump 14 may include a plurality of connector rods 94. In some embodiments, the plurality of connector rods 94 may include from 2, 4, or 6 to 8, 10, 12, 16, 20, or 24 or more connector rods 94. For example, each of connector rods 94 may connect one of the first plungers 84 to each of the plurality of crankpins 92 or one of the second plungers 88 to each of the of crankpins 92 (e.g., connector rods 94*a* and 94*b*, respectively), for example, such that each of the crankpins 92 is connected to one of the first plungers 84 and one of the second plungers 88. For example, each of the connector rods 94*a* and 94*b* may include a plunger end 96 connected to either one of the first plungers 84 or one of the second plungers 88 (e.g., plunger ends 96*a* and 96*b*, respectively), and a crank end 98 connected to one of the crankpins 92 (e.g., crank ends 96*a* and 96*b*, respectively). For example, each of the plunger ends 96 may be connected to a respective plunger via a pin that permits the plunger to pivot with respect to the respective connector rod 94 as the plunger reciprocates in a chamber of a respective fluid end, and each of the respective crank ends 98 may be connected to a respective crankpin 92, such that the crankpin 92 is able to rotate freely relative to the respective crank end 98 as the crankshaft 78, driven by the prime mover 16 and/or the transmission 18, rotates. As shown in FIGS. 3B, 3C, and 3D, in some embodiments, the plurality of connector rods 94*a* may have a longitudinal axis offset from a longitudinal axis of connector rods 94*b*. In other embodiments, the plurality of connector rods 94*a* may be axially aligned with the plurality of connector rods 94*b* as more fully discussed below.

In some embodiments, the crankshaft 78 and/or the crankpins 92 may be configured such that different pairs of the first and second plungers 84 and 88 are in different locations along their respective stroke paths as the crankshaft 78 rotates. In some embodiments, the crankshaft 78 and/or the crankpins 92 may be configured such that different pairs of first and second plungers of the first and second banks of plungers and are offset by the crank pins, e.g., in embodiments, the plungers of the first and third pairs of plungers shown in the FIGS. can be offset from each other by the crank pins by about 90 degrees, for example, and can move in different directions, e.g. along an intake stroke direction toward the crankshaft 78 for drawing-in fracturing fluid and a discharge stroke direction away from the crankshaft 78 for discharging fracturing fluid. For example, a first pair of plungers may include a first one of the first plungers 84 (e.g., first plunger 84*a*) and a first one of the second plungers 88 (e.g., second plunger 88*a*), and a second pair of plungers may include a second one of the first plungers 84 (e.g., first plunger 84*b*) and a second one of the second plungers 88 (e.g., second plunger 88*b*), and the crankshaft 78 may be configured such that the first pair of plungers moves in a first direction to discharge at least a portion of the fracturing fluid while the second pair of plungers moves in a second direction to draw-in at least a portion of the fracturing fluid. In some embodiments, each of the pairs of first and second plungers 84 and 88 may be connected to a common crankpin 92 of the crankshaft 78. In some embodiments, different pairs and/or additional pairs of the first and second plungers 84 and 88 may similarly move in different directions. This example movement of plunger pairs in different directions may result in relatively reducing the level of shock and/or vibration associated with operation of the hydraulic fracturing pump 14, for example, the level of shock and/or vibration associated with torque shock and/or torque vibration generated during operation of the hydraulic fracturing pump 14, for example, as each of the first plungers 84 and/or each of the second plungers 88 discharges fracturing fluid at the second and fourth pressures, respectively. For example, in some embodiments, the shock and/or torque generated by one or more of the pairs of first and second plungers 84 and 88 may substantially offset or cancel one another.

As shown in FIG. 3D, in some embodiments, each of the first plungers 84 has a first longitudinal dimension LD1 (e.g., relative to the hydraulic fracturing pump 14, for example, a first diameter), and each of the second plungers 88 has a second longitudinal dimension LD2 (e.g., relative to the hydraulic fracturing pump 14, for example, a second diameter). In some embodiments, for example, as shown, the first longitudinal dimension LD1 is substantially equal to the second longitudinal dimension LD2. In some embodiments, the first plungers 84 and the second plungers 88 are each connected to one of the crankpins 92, such that, for example, a total longitudinal distance occupied by the first plunger 84 and the second plunger 88 is less than a sum of the first longitudinal dimension LD1 and the second longitudinal dimension LD2.

For example, as shown in FIG. 3D, each of the crank ends 98*a* and 98*b* of the respective connector rods 94*a* and 94*b* includes two crank end connectors 100 (e.g., crank end connectors 100*a* and 100*b*, respectively) separated by a crank end space 102 (e.g., crank end spaces 102*a* and 102*b*, respectively). For example, each of a group of first connector rods 94*a* may be connected to one of the first plungers 84, and each of a group of second connector rods 94*b* may be connected to one of the second plungers 88. The respective crank end connector 100*a* of each of the first connector rods 94*a* may be positioned at least partially in a respective crank end space 102*b* of one of the second connector rods 94*b*, and the respective crank end connector 100*b* of each of the second connector rods 94*b* may be positioned at least partially in a crank end space 102*a* of one of the first connector rods 94*a*. This example intermeshing of the connector rods 94*a* and 94*b* connected to the first and second plungers 84 and 88 may result in further reducing the pump length L of at least some embodiments of the hydraulic fracturing pump 14.

As shown in FIGS. 3A, 3B, 3C, and 3E, in some embodiments, the hydraulic fracturing pump 14 may include a first pinion gear 108 engaged with the crankshaft 78, for example, via a first drive gear 110, at a first end 112 of the pump frame 76, and a connector shaft 114 connected to the first pinion gear 108. In some embodiments, the hydraulic fracturing pump 14 also may include a second pinion gear 116 connected to the hydraulic fracturing pump 14 at a second end 118 of the pump frame 76 and connected to the first pinion gear 108 via the connector shaft 114. In some such embodiments, the first pinion gear 108 may drive the connector shaft 114 and the crankshaft 78 at the first end 112 of the pump frame 76. The connector shaft 114 may transfer the torque from the first pinion gear 108 and drive the second pinion gear 116 at the second end 118 of the pump frame 76.

The second pinion gear 116 may drive the crankshaft 78 at the second end 118 of the pump frame 76, for example, via a second drive gear 120. In some such embodiments, because the crankshaft 78 is driven at both ends, the torque tending to twist the crankshaft 78 may be relatively reduced as compared to a crankshaft that is driven at one end. This may result in an ability to drive the crankshaft 78 with relatively more torque and/or power without damaging the crankshaft 78 (e.g., for a crankshaft of a given strength) and/or adversely affecting operation of the hydraulic fracturing pump 14. In some embodiments, the hydraulic fracturing pump 14 may be configured to be driven by one or more prime movers 16 located at opposite ends of the hydraulic fracturing pump 14. For example, the hydraulic fracturing pump 14 may be driven by one or more prime movers 16 from each of both the first end 112 and the second end 118 of the pump frame 76, for example, via the first pinion gear 108 and the second pinion gear 116. For example, a second prime mover may be connected to the hydraulic fracturing pump 14 at an end of the hydraulic fracturing pump 14 opposite a first prime mover 16, for example, via a second transmission, to supply power to the hydraulic fracturing pump 14.

An additional embodiment a hydraulic fracturing pump 14' is illustrated in FIGS. 4A-4F. The hydraulic fracturing pump 14' may have a similar construction the hydraulic pump 14 illustrated in FIGS. 3A-3E, and thus like numerals will be used to refer to similar parts in the present embodiment shown in FIGS. 4A-4F. In this embodiment, the drive assembly of the hydraulic fracturing pump 14' includes a planetary gear drive train 200 that includes at least one planetary gearbox 201, typically located at the first end of the hydraulic fracturing pump 14', though an additional planetary gearbox further can be provided at the second end of the hydraulic fracturing pump for driving the crankshaft from a second end thereof. As with the hydraulic fracturing pump 14 of FIG. 3A, hydraulic fracturing pump 14' will be mounted on the platform 42 and supported on the chassis 40 of the transportable hydraulic fracturing unit 10. The hydraulic fracturing pump further will be configured for pumping one or more fluids, such as fluids for use in hydraulic fracking operations. The hydraulic fracturing pump 14' further generally will be mounted in a substantially centrally aligned position adjacent the rear of the platform 42, such as indicated in FIGS. 2A and 2B.

Figure 4A:
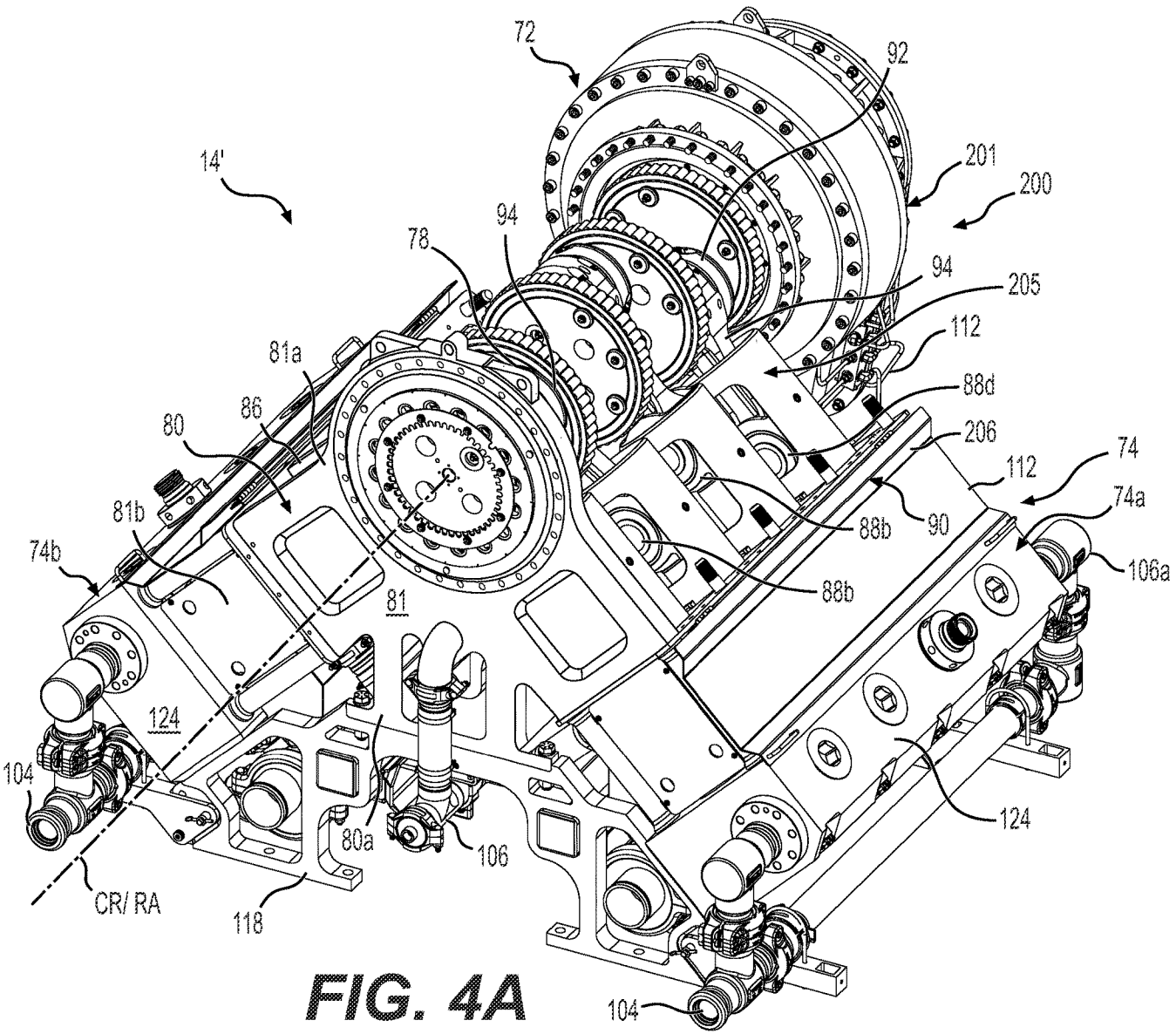
FIG. 4A is a schematic perspective view, with parts removed, of an example hydraulic fracturing pump including a planetary gear train according to embodiments of the disclosure.
Figure 4B:
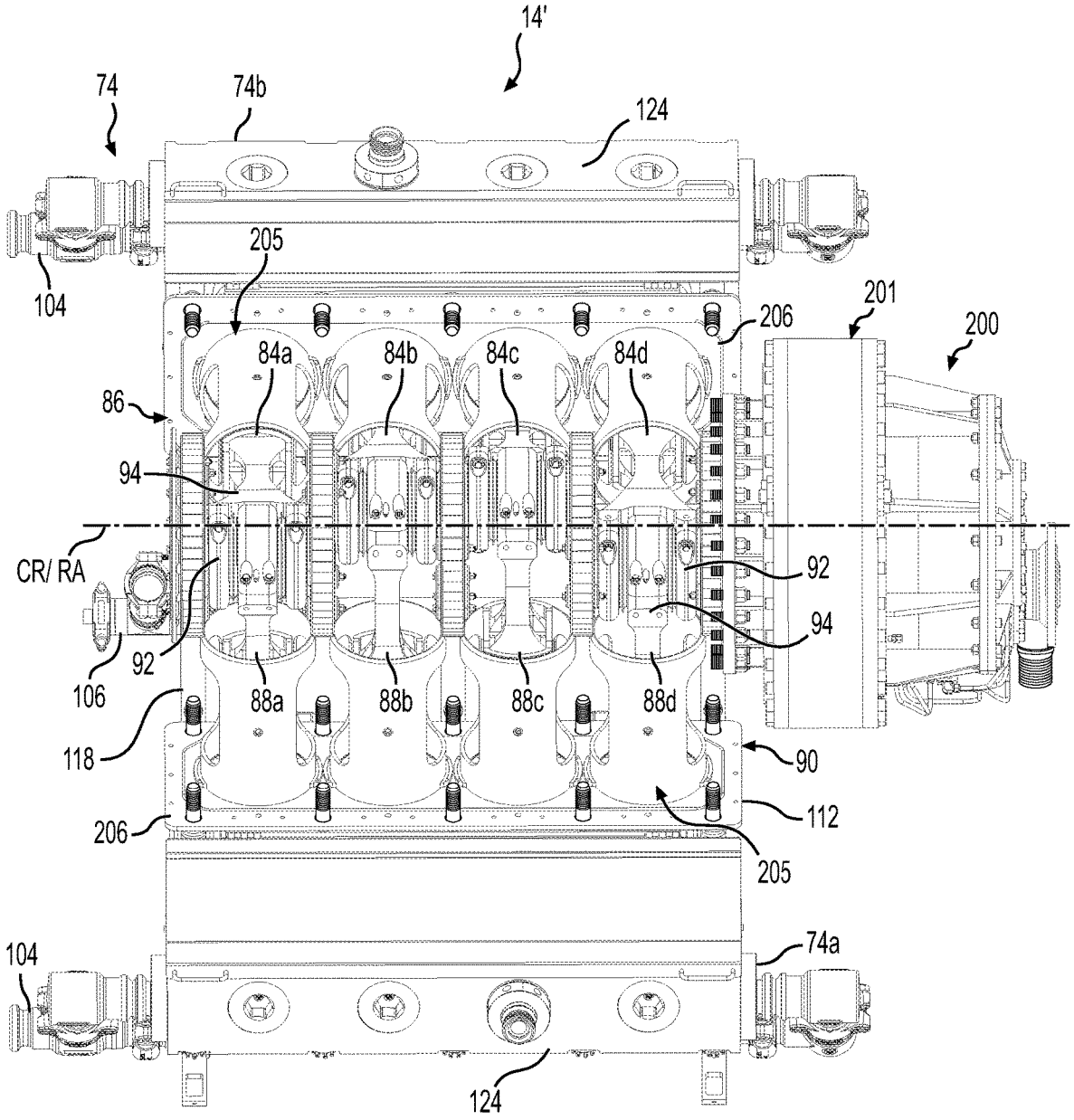
FIG. 4B is a schematic is a schematic top view of the hydraulic fracturing pump of FIG. 4A according to additional embodiments of the disclosure.
Figure 4C:
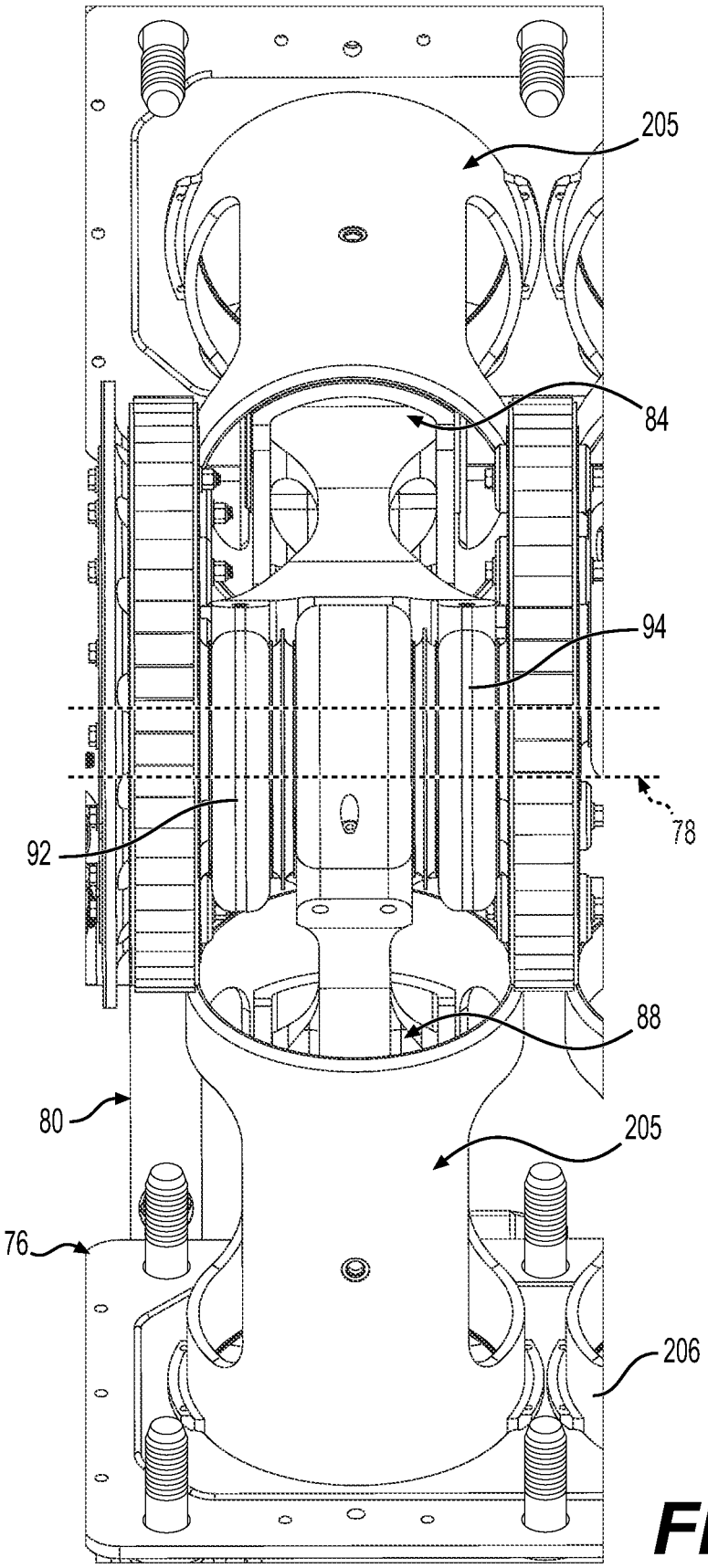
FIG. 4C is a schematic close-up view of an example connection rod and plunger for the example hydraulic fracturing pump shown in FIGS. 4A-4B, according to embodiments of the disclosure
Figure 4D:
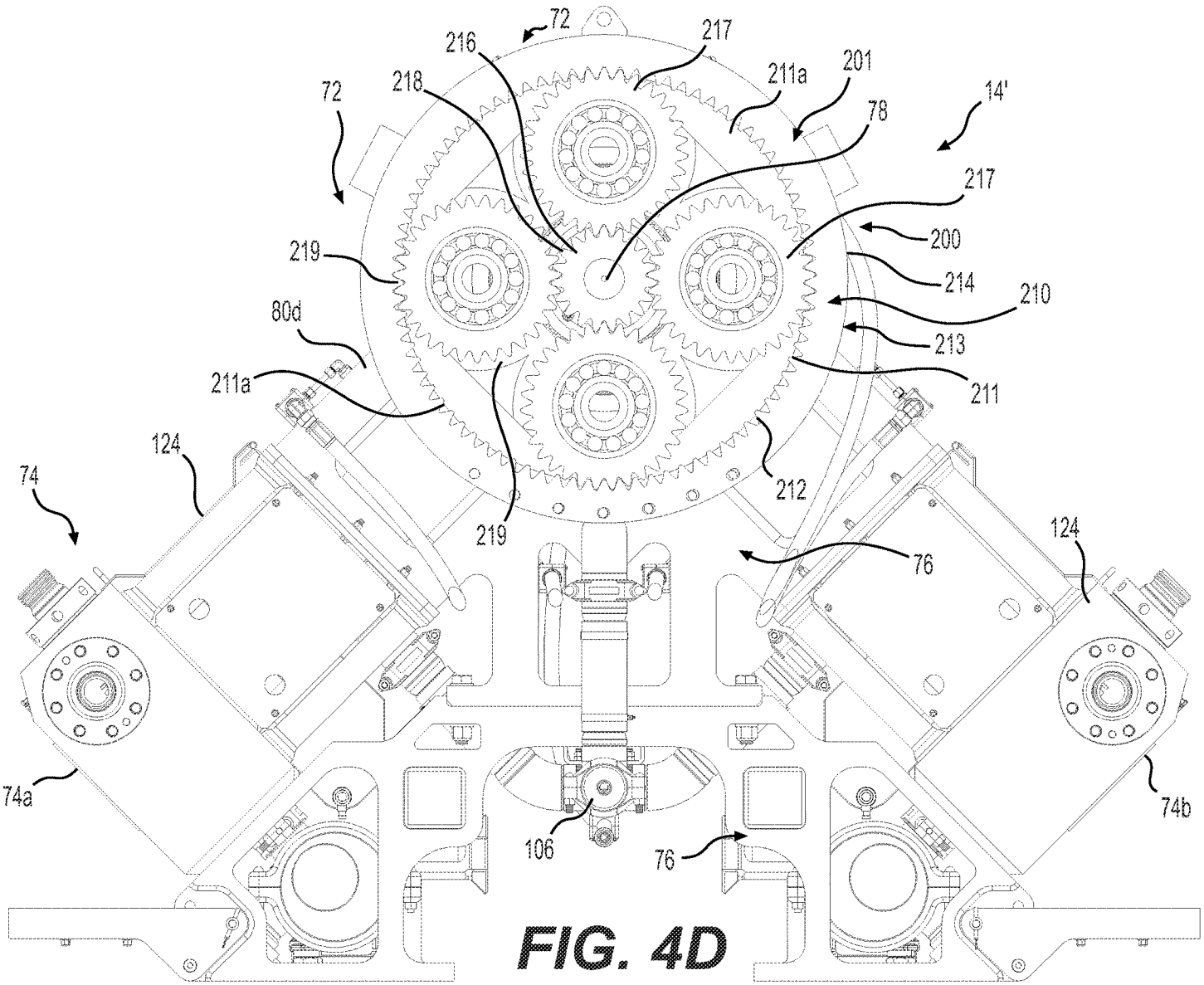
FIG. 4D is a schematic end view taken in partial cross-section along the pump frame and illustrating a planetary gear arrangement of the planetary gear train according to embodiments of the present disclosure.
Figure 4E:
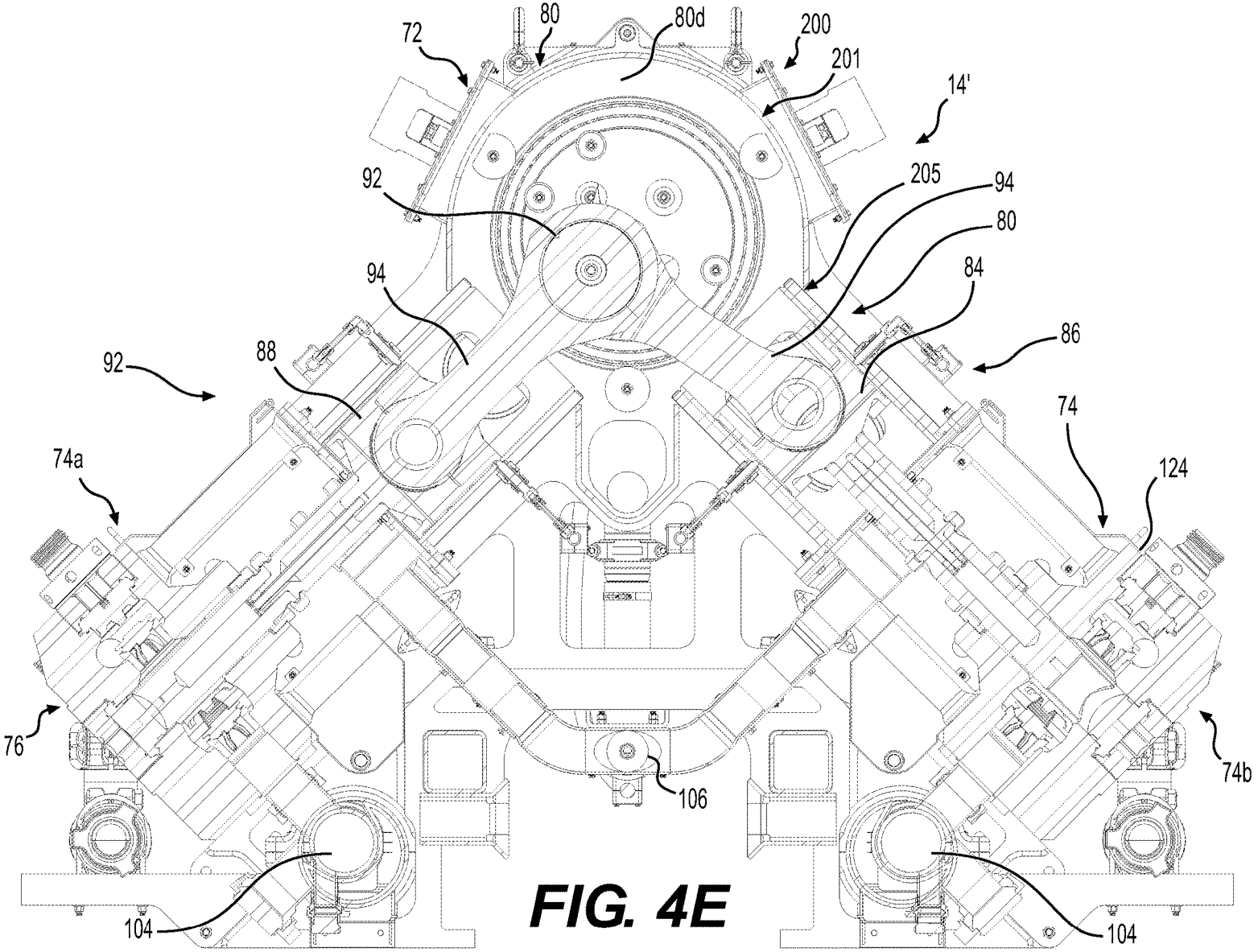
FIG. 4E is a schematic end view, taken in partial cross-section, of a second or fluid inlet end of the example hydraulic fracturing pump of FIG. 4A-4B, illustrating an arrangement of connection rods coupled to a crankshaft according to embodiments of the present disclosure.
Figure 4F:
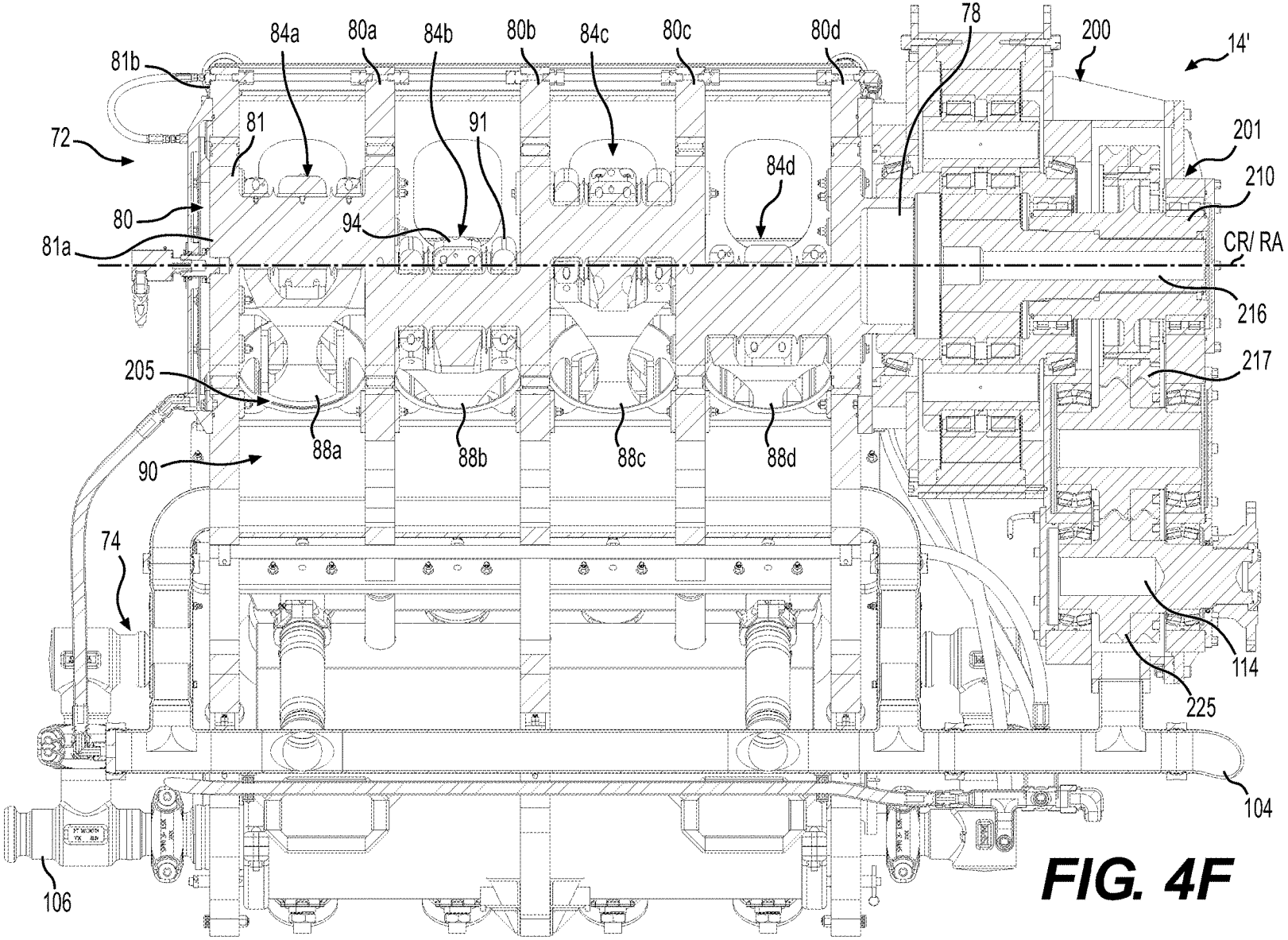
FIG. 4F is a schematic view, taken in partial cross-section, of the example hydraulic fracturing pump of FIGS. 4A-4B according to embodiments of the disclosure.

As illustrated in FIGS. 4A-4B and 4F, the hydraulic fracturing pump 14' generally will include a pump frame 76 with at least one power end or section 72 defined along an upper portion of the pump frame, and one or more fluid sections or ends 74 (e.g. as indicated at 74*a*/74*b*) defined along a lower portion of the pump frame. The pump frame further will include a first or upstream end 112 at which at least one planetary gearbox 201 will be located, and a second or downstream end 118 at which fluid is discharged from the hydraulic fracturing pump 14'.

As further illustrated in FIGS. 4B and 4F, the pump frame further can include a series of pump frame sections 80 (e.g. shown at 80, 80*b*, 80, 80*d* and 80*e* in FIG. 4F) extending between the power and fluid ends 72/74 of the pump frame. Each pump frame section can be connected together to form the pump frame 76, with each pump frame section including a body 81 having an upper end 81*a* that can be formed with a substantially circular configuration, and which can include a bearing assembly, and a lower end 81*b*. The upper ends of each pump frame section further can include an aperture or opening 81*c*, with the openings of the pump frame sections being aligned such that together they define a crankshaft aperture 78*a* along which a crankshaft 78 is extended through the pump frame 76 of the hydraulic fracturing pump 14'.

As illustrated in FIGS. 4A, 4B and 4E, the hydraulic fracturing pump 14' can include a series of plungers 84 and 88, which can be arranged assets or banks of first plungers 84*a*-84*d* and second plungers 88*a*-88*d*, as indicated at 86 and 90 and, arranged along each side of the pump frame. For example, FIGS. 4A and 4B illustrate two banks of plungers arranged on opposite sides of the pump frame 76 and which may be coupled to the crankshaft 78 in an offset arrangement so as to be driven in a reciprocating motion toward and away from/into and out of fluid chambers 124 arranged along the each of the first and second fluid ends of the pump frame, in an alternating motion. For example, as indicated in FIG. 4F, as the plungers 84*a*-84*d* of the first bank 86 of plungers driven along a downward stroke in a first direction toward the first fluid end 74*a*, the plungers 88*a*-88*d* of the second bank 90 of plungers will be retracted from the fluid chamber of the second fluid end.

In addition, the opposed first and second plungers of the first and second banks of plungers can be arranged in pairs or groups of first and second plungers, with the plungers of each pair of plungers offset from the first and second plungers of other ones of the pairs of plungers. For example, as further indicated in FIG. 4F, the plungers of a first pair of plungers can be arranged at an offset with respect to a second and/or third pair of first and second plungers, e.g. at an offset angle of approximately 90 degrees; although in some embodiments, the offset angles between the pairs of first and second plungers can be less or can be greater, e.g. such offset angles can range between about 0 degrees to about 180 degrees.

As illustrated in FIGS. 4A-4B, 4D and 4E, the fluid end or section 74 of the pump frame 76 can include at least first and second fluid ends or sections 74*a*. 74*b* each including a fluid chamber 124 into which the plungers of the first and second banks 86/90 of plungers will be received. As discussed above with respect to the hydraulic fracturing pump 14 of FIGS. 3A-3E, while the hydraulic fracturing pump 14' (FIGS. 4A-4F) is shown with a pair of fluid ends 74*a*/74*b* and two banks of four plungers on each side of the pump frame 76 in FIGS. 4A-4B, it will be understood by those skilled in the art that additional plungers and additional fluid ends or chambers also can be provided. Thus, depending on applications, the pump frame of the hydraulic fracturing pump 14' can be configured (e.g., can be lengthened or extended, or reduced in length as needed) to accommodate any suitable number of plungers as well as more or less numbers of fluid ends and or fluid chambers. By way of example only and not by limitation, in embodiments, the hydraulic fracturing pump 14' can include multiple banks of plungers, each of which may include 1, 2, 3, 4, 5, 6, 8, 10, or 12 plungers arranged on each side of the pump frame; and, in embodiments, the hydraulic fracturing pump 14' could include three or more fluid ends with three or more sets or banks of plungers, each corresponding to one of the fluid ends.

In embodiments, the pump frame sections 80*a*-80*e*, as generally illustrated in FIGS. 4A and 4E, can have a substantially inverted Y-shaped cross-section or configuration, as viewed in a direction substantially parallel to a longitudinal axis CR of the crankshaft. In embodiments, such as where the hydraulic fracturing pump 14' includes three or more fluid ends, the additional fluid ends can be stacked along the sides of the pump frame, e.g. a third fluid end can be disposed above the crankshaft adjacent upper ends of the pump frame sections, which can have a Y-shaped configuration; while in other embodiments where four or more fluid ends are provided, the pump frame sections may have a substantially X-shaped cross section or configuration, as viewed in the direction substantially parallel to the longitudinal axis CR of the crankshaft, the fluid ends or sections can be stacked or disposed with one above another, e.g. a third fluid end could be disposed above the first fluid end, and a fourth fluid end could be disposed above the second fluid end.

As illustrated in FIGS. 4A, 4C and 4E, each of the plungers 84/88 can be received within a sleeve 205 or guide that can be configured to help direct or guide the reciprocating motion of each of the plungers into and out of the chambers 124 of each of their respective or associated first and second fluid ends 74*a*/74*b* of the hydraulic fracturing pump 14'. As indicated in FIG. 4C, the sleeves can be formed with a generally cylindrical configuration that substantially matches the configuration of the plungers, generally being configured to help control/guide the movement of the plungers so as to substantially minimize or reduce transverse movement or vibration of the plungers during their reciprocating motion. The sleeves 205 can be mounted along the pump frame, such as being positioned between each of the pump frame sections as shown in FIGS. 4A and 4C and secured by fasteners along a mounting plate or support 206, and can be arranged at an angle corresponding to the angle of the movement or stroke of their associated plungers.

In embodiments, as indicated in FIGS. 4A, 4C and 4E, each of the plungers further generally will be coupled at an upper end to a connecting rod 94. Each of the connecting rods can include an elongated body having a first end that connects to an upper end of a corresponding one of the plungers 84/88, and a second end that is generally pivotally attached to the crankshaft 78 by a crank pin 92. The crankshaft can have a plurality of crank pins as needed for driving the connector rods and plungers of the hydraulic fracturing pump 14', which crank pins may be offset from the longitudinal rotation axis RA of the crankshaft. As noted with respect to the embodiment of the hydraulic fracturing pump 14 shown in FIGS. 3A-3E, the crankshaft axis CR in the longitudinal rotation axis RA may be substantially aligned or coexistent, with the crank pins 92 being arranged substantially parallel to the longitudinal rotation axis RA.

In embodiments, each of the crank pins connected to alternating ones of the connecting rods and plungers may be radially offset with respect to one another, for example by 90 degrees, although greater or lesser offsets (e.g. between about 0 degrees to about 180 degrees), can be used. As a result, the respective reciprocation of the plungers of the first bank of plungers can be opposite of the reciprocal movement of the plungers of the second bank of first plungers, e.g. as the first plungers are moved in the first direction toward their corresponding fluid end, so as to discharge fluid from the fluid end, the second plungers can be retracted in the second direction away from their corresponding fluid end. This can enable a plunger firing sequence whereby two consecutive plunger groups fire one after the other, e.g. a plunger firing sequence of 1-3-2-4 can be provided. The spacing of the plunger reciprocations thus can potentially result in at least some degree of force cancellation in at least some of the bearings due to a 90-degree phasing of the plungers so as to reduce peak loads acting on at least some of the bearings of the pump frame sections.

As further illustrated in FIGS. 4A and 4E, each of the connector rods 94 can be connected to their corresponding plungers 84/88 by a pivotal connection between the plunger end of each connector rod and its corresponding plunger, such as by pin or similar pivoting connector that permits each plunger to pivot with respect to its corresponding connector rod as the plunger reciprocates into and out of the chamber 124 of its corresponding or associated fluid end 74*a*/74*b*. The crank ends of each of the connector rods 94 further will be connected to their respective crank pins 92 such that each of the crank pins is able to freely rotate relative to the crank end of its associated or corresponding connector rods as the crankshaft is driven (e.g. by the prime mover 16 and/or the transmission 18 shown in FIG. 2A). In addition, each of the connector rods corresponding to each of the plungers of the first and second banks of plungers may be axially aligned so as to move along substantially axially aligned stroke paths as the crankshaft is rotated.

In other embodiments, the crank pins can be arranged along the crankshaft such that different pairs of the plungers of the first and second banks of plungers will be at different locations along their respective stroke paths as the crankshaft rotates; and, as discussed above, further can be moved in different directions, for example and intake or stroke direction towards the crankshaft or drawing in fracturing fluid and a discharge stroke direction away from the crankshaft for discharging the fracturing fluid.

Each of the of first and second plungers 84/88 may be configured to reciprocate in first and second directions to discharge draw-in fracturing fluid at different pressures. For example, the first plungers may be aligned and reciprocate in a first plane to draw-in fracturing fluid at a first pressure and discharge the fracturing fluid at a second pressure that can be greater than the first pressure, while the second plungers 88 may be configured to reciprocate in a second plane to draw-in fracturing fluid at a third pressure and discharge the fracturing fluid at a fourth pressure that can be greater than the third pressure; such as discussed above with respect to FIG. 3E. In embodiments, the first pressure and/or the third pressure may be substantially equal to a pressure associated with the fracturing fluid being supplied to the hydraulic fracturing pump 14 from the blender 28 (FIG. 1); and the second pressure and the fourth pressure may be substantially equivalent to the high pressure of the fracturing fluid being supplied to the wellhead 38 by operation of the prime mover 16, the transmission 18, and the hydraulic fracturing pump 14 of the hydraulic fracturing unit 12. In some embodiments, the first pressure and the third pressure may be substantially the same. In some embodiments, the second pressure and the fourth pressure may be substantially the same. In some embodiments, the first pressure and the third pressure may be different, and/or the second pressure and the fourth pressure may be different.

In addition, reciprocating the first and second plungers 84 and 88 in their respective planes also may result in increasing the pumping capacity of the hydraulic fracturing pump 14' without substantially increasing a pump length L and/or without substantially increasing a pump width W thereof; and further may assist in relatively reducing the level of shock and/or vibration associated with operation of the hydraulic fracturing pump 14, e.g., the level of shock and/or vibration associated with torque shock and/or torque vibration generated during operation of the hydraulic fracturing pump 14', as each of the first plungers 84 and/or each of the second plungers 88 discharges fracturing fluid at different pressures. This further can lead to the shock and/or torque generated by one or more of the first plungers 84 and/or one or more of the second plungers 88 substantially offsetting or canceling one another.

As illustrated in FIG. 4A and in the present embodiment, the drive assembly of the hydraulic fracturing pump 14' can comprise an epicyclic or planetary gear train 200, with at least one planetary gear box 201 located at the first or upstream end 112 of the pump frame 76. The planetary gearbox 201 generally will be coupled to the prime mover 16, such as via the transmission 18 (FIG. 2A) of the hydraulic fracturing unit 10. The planetary gearbox 201 can include a housing or cover that seals and protects drive gears of the planetary gear train, including a first drive gear 210 (FIG. 4F) that is received therein.

The first drive gear can be configured as a ring gear having an inner circumference 211 defining an interior chamber or area, and further can include a first series of gear teeth 212 projecting radially inward, and a second series of gear teeth 213 arranged about an outer circumference 214 of the first drive gear 210. A planetary gear arrangement 215 will be received within the interior of the first drive gear chamber such that the planetary gear arrangement is surrounded by and engages the first drive gear. In an example embodiment as shown in FIG. 4D, the planetary gear arrangement can include a central or sun gear 216 that can engage with or be mounted to a first end of the crankshaft 78, generally being aligned with the longitudinal axis CR of the crankshaft and the rotational axis RA of the crankshaft, and a series of planet gears 217 arranged about the central or sun gear 216. In the embodiment shown in FIG. 4D, a series of four planet gears 217 are provided, though it will be understood by those skilled in the art that other types of planetary gear arrangements also could be used. The sun gear 216 and each of the planet gears 217 can include a series of gear teeth 218/219 formed about the outer circumferences thereof. The gear teeth of the planet gears are configured to engage both the gear teeth 212 of the inner circumference 211 of the first drive gear 210 as well as the gear teeth 218 of the sun gear 216. Each of the planet gears further can be rotatably mounted to a support 219 so as to be held in a substantially fixed orientation, while still being freely rotatable with respect to their support.

During operation of the hydraulic fracturing pump 14', the prime mover of the hydraulic fracturing unit will supply power so as to drive rotation of the sun gear, which in turn drives rotation of the crankshaft from the first end thereof, As the crankshaft is rotated, the first plungers of the first set or bank or plungers and the second set of bank or plungers accordingly will be reciprocated in an alternating fashion in opposite directions toward and away from their chambers of their respective or corresponding fluid ends. For example, one or more of the first plungers of the first set or bank of plungers can be moved in a first or substantially downwardly extending direction discharge stroke so as to discharge at least a portion of fracturing fluid contained within the chamber 124 of the first fluid end 74*a*. The discharge fluid can be directed out of the chamber of the first fluid end and along a first fluid output conduit 106 such as indicated in FIGS. 4A and 4B. At substantially same time, one or more of second plungers of the second bank of plungers can be moved in a second, substantially upward direction along an intake stroke to draw in at least a portion of fracturing fluid into the chamber 124 of the second fluid end 74*b*. The fracturing fluid can be drawn into the chamber 124 via a fluid inlet conduit or pipe 104 that will be connected to a source or supply of the fracturing fluid. In embodiments, different pairs and/or multiple pairs of the first and second plungers may be configured to similarly move in different directions, which may further help reduce a level of shock and/or vibration associated with the operation of the hydraulic fracturing pump 14', such as when each of the first plungers and/or each of the second plungers discharges the fracturing fluid at different pressures.

In addition, rotation of the sun gear also drives rotation of the first drive gear 210 of the planetary gear drive train 200. As the sun gear rotates, the engagement of the teeth of the planet gears with the teeth of the sun gear causes rotation of the planet gears, which further engage the first series of teeth 212 formed about the inner circumference 211 of the first gear so as to translate the rotational motion of the sun gear to the first drive gear and thus drive rotation of the first drive gear 210. As indicated in FIG. 4F, the second series of gear teeth 213 defined about the outer circumference 214 of the first drive gear 210 engage with gear teeth 224 of a first pinion gear 108 arranged along the first end of the pump frame. The first pinion gear 108 further may engage with the first end of a connector shaft 114 that extends through the pump frame at the first end thereof.

As discussed with respect to the embodiment shown in FIGS. 3A-3E, a second end of the connector shaft 114 further can be connected to or can engage with a second pinion gear at the second end of the pump frame 76. The second pinion gear may have a series of gear teeth configured to engage with a second drive gear that can be corrected to or can engage with a second end of the crankshaft. Thus, the crankshaft can be supported and driven from opposite sides of the pump frame.

In embodiments, the planetary gear train 200 can include a second planetary gear box that can be located at the second end of the pump frame for driving the crankshaft from its second end. The second planetary gear box can have a similar construction to the planetary gear box 201 shown in FIG. 4D, with the second drive gear comprising a ring gear having a sun gear and a series of planet gears mounted therein. Alternatively, the second end of the crankshaft can be supported and driven by a drive gear arrangement such as illustrated in FIG. 3A whereby a large second drive gear can be mounted to the second end of the crankshaft and can be rotated by rotation of a smaller second pinion gear located along the lower end of the pump frame and driven by the rotation of the connector shaft by the planetary gear box at the first end of the pump frame.

As shown in FIGS. 3A, 3B, 3C, and 3E, and in FIGS. 4A-4F, in some embodiments, the hydraulic fracturing pump 14/14' may be configured to pump fracturing fluids from two independent fracturing fluid supplies. For example, as shown in FIGS. 3A, 3B, 3C, 3E, and 4F the first bank 86 of first plungers 84 may be supplied by a first input conduit 104*a* for supplying a first fracturing fluid from a first fracturing fluid supply, and a first output conduit 106*a* for outputting the first fracturing fluid at high pressure and/or a high flow rate. The second bank 90 of second plungers 88 may be supplied by a second input conduit 104*b* for supplying a second fracturing fluid from a second fracturing fluid supply, and a second output conduit 106*b* for outputting the second fracturing fluid at high pressure and/or a high flow rate. In some embodiments, the first fracturing fluid may have a first fracturing fluid composition, and the second fracturing fluid may have a second fracturing fluid composition. In some embodiments, the first fracturing fluid composition and the second fracturing fluid composition may be substantially the same.

In some embodiments, the first fracturing fluid composition and the second fracturing fluid composition may be different. For example, the first fracturing fluid composition may include water and proppant having a first size and/or first bulk density, and the second fracturing fluid composition may include water and proppant having a second size and/or second bulk density. For example, the first formation fluid composition may include water and proppant having a size of greater than 100 Mesh, from about 80 Mesh to about 20 Mesh, from about 70 Mesh to about 30 Mesh, from about 20 Mesh to about 40 Mesh, or from about 40 Mesh to about 60 Mesh and the second fracturing fluid composition may include water and proppant having a size of less than 100 Mesh, less than 150 Mesh, from about 150 Mesh to about 500 Mesh, or from about 200 Mesh to about 400 Mesh.

In some embodiments, the first fracturing fluid composition may include water, gels, and/or proppants, and the second fracturing fluid composition may include water and/or other components, but may be substantially devoid of proppants. In such embodiments, the first bank 86 of the first plungers 84 may pump a fracturing fluid including proppants while the second bank 90 of the second plungers 88 pumps water, etc., without proppants. Some such embodiments may result in increasing a service interval for the hydraulic fracturing pump 14, for example, because the plungers pumping water (e.g., without proppants) will be expected to experience relatively less wear (e.g., have a slower wear rate) as compared to plungers that pump a fracturing fluid that includes proppants, for example, because pumping proppants may result in increasing the wear rates of plungers and associated fluid ends.

In some embodiments, the hydraulic fracturing pump 14/14' may be configured to pump fracturing fluids from three or more independent fracturing fluid supplies. For example, the first fracturing fluid may exit the first fluid end 74*a* via the first output conduit 106*a*, the second fracturing fluid may exit the second fluid end 74*b* via the second output conduit 106*b*, a third fracturing fluid may exit a third fluid end via a third output conduit, and optionally a fourth fracturing fluid may exit a fourth fluid end via a fourth output conduit.

In some embodiments, each of the first, second, third, and forth fracturing fluids may have substantially the same compositions. In other embodiments, the compositions of the first, second, third, and forth fracturing fluids may be different. For example, the first fracturing fluid composition may include water and proppant having a first size and/or first bulk density, and the second fracturing fluid composition may include water and proppant having a second size and/or second bulk density, the third fracturing fluid composition may include water and proppant having a third size and/or third bulk density, and the fourth fracturing fluid composition may include water and proppant having a fourth size and/or fourth bulk density. In some embodiments, the proppant having a size of greater than 100 Mesh, from about 80 Mesh to about 20 Mesh, from about 70 Mesh to about 30 Mesh, from about 20 Mesh to about 40 Mesh, or from about 40 Mesh to about 60 Mesh and the second fracturing fluid composition may include water and proppant having a size of less than 100 Mesh, less than 150 Mesh, from about 150 Mesh to about 500 Mesh, or from about 200 Mesh to about 400 Mesh.

In some embodiments, the first fracturing fluid composition may include water, gels, and/or proppants, and the second fracturing fluid composition may include water and/or other components, but may be substantially devoid of proppants. In such embodiments, the first bank 86 of the first plungers 84 may pump a fracturing fluid including proppants while the second bank 90 of the second plungers 88 pumps water, etc., without proppants. Some such embodiments may result in increasing a service interval for the hydraulic fracturing pump 14/14', for example, because the plungers pumping water (e.g., without proppants) will be expected to experience relatively less wear (e.g., have a slower wear rate) as compared to plungers that pump a fracturing fluid that includes proppants, for example, because pumping proppants may result in increasing the wear rates of plungers and associated fluid ends In some embodiments the hydraulic fracturing pump may be in fluid communication with two or more wells. For example, the hydraulic fracturing pump 14 may in fluid communication with 1, 2, 3, 4, or 5 or more wells. In some such embodiments, the first output conduit 106*a* for outputting the first fracturing fluid at a high pressure and/or a high flow rate may be in fluid communication with a first well for receiving the first fracturing fluid at the high pressure and/or the high flow rate and the second output conduit 106*b* for outputting the second fracturing fluid at high pressure and/or a high flow rate may be in fluid communication with a second well for receiving the second fracturing fluid at the high pressure and/or the high flow rate. In some embodiments, the first output conduit 106*a* may be in fluid communication with a first well for receiving the first fracturing fluid, the second output conduit 106*b* may be in fluid communication with a second well for receiving the second fracturing fluid, the third output conduit may be in fluid communication with a third well for receiving the third fracturing fluid, and the fourth output conduit may be in fluid communication with a fourth well for receiving the fourth fracturing fluid.

As shown in FIGS. 3E and 4A, and mentioned previously herein, in some embodiments, the hydraulic fracturing pump 14/14' may include the first fluid end 74*a* connected to the pump frame 76, such that the first plungers 84 draw fracturing fluid into the first fluid end 74*a* at the first pressure and discharge the fracturing fluid from the first fluid end 74*a* at the second pressure. The hydraulic fracturing pump 14 may include the second fluid end 74*b* connected to the pump frame 76, such that the second plungers 88 draw fracturing fluid into the second fluid end 74*b* at the third pressure and discharge the fracturing fluid from the second fluid end 74*b* at the fourth pressure. In some embodiments, one or more of the first plungers 84 or the first fluid end 74*a* may be configured such that as each of the first plungers 84 travels in a first direction, fracturing fluid is drawn into the first fluid end 74*a* and fracturing fluid is discharged from the first fluid end 74*a*, and as each of the first plungers 84 travels in a second direction opposite the first direction, fracturing fluid is drawn into the first fluid end 74*a* and fracturing fluid is discharged from the first fluid end 74*a*. In addition, or alternatively, in some embodiments, one or more of the second plungers 88 or the second fluid end 74*b* may be configured such that as each of the second plungers 88 travels in a third direction, fracturing fluid is drawn into the second fluid end 74*b* and fracturing fluid is discharged from the second fluid end 74*b*, and as each of the second plungers 88 travels in a fourth direction opposite the third direction, fracturing fluid is drawn into the second fluid end 74*b* and fracturing fluid is discharged from the second fluid end 74*b*. Thus, in some embodiments, the hydraulic fracturing pump 14 may be configured to both draw-in and discharge fracturing fluid relative to the fluid end chambers with each stroke of the respective plungers, regardless of the direction of the respective strokes. This, in at least some embodiments, may result in a significant increase in the output capability of the hydraulic fracturing pump 14 relative to, for example, fracturing pumps having plungers that draw-in fluid only when moving in a first direction and discharge fluid only when moving in the opposite direction.

Figure 5A:
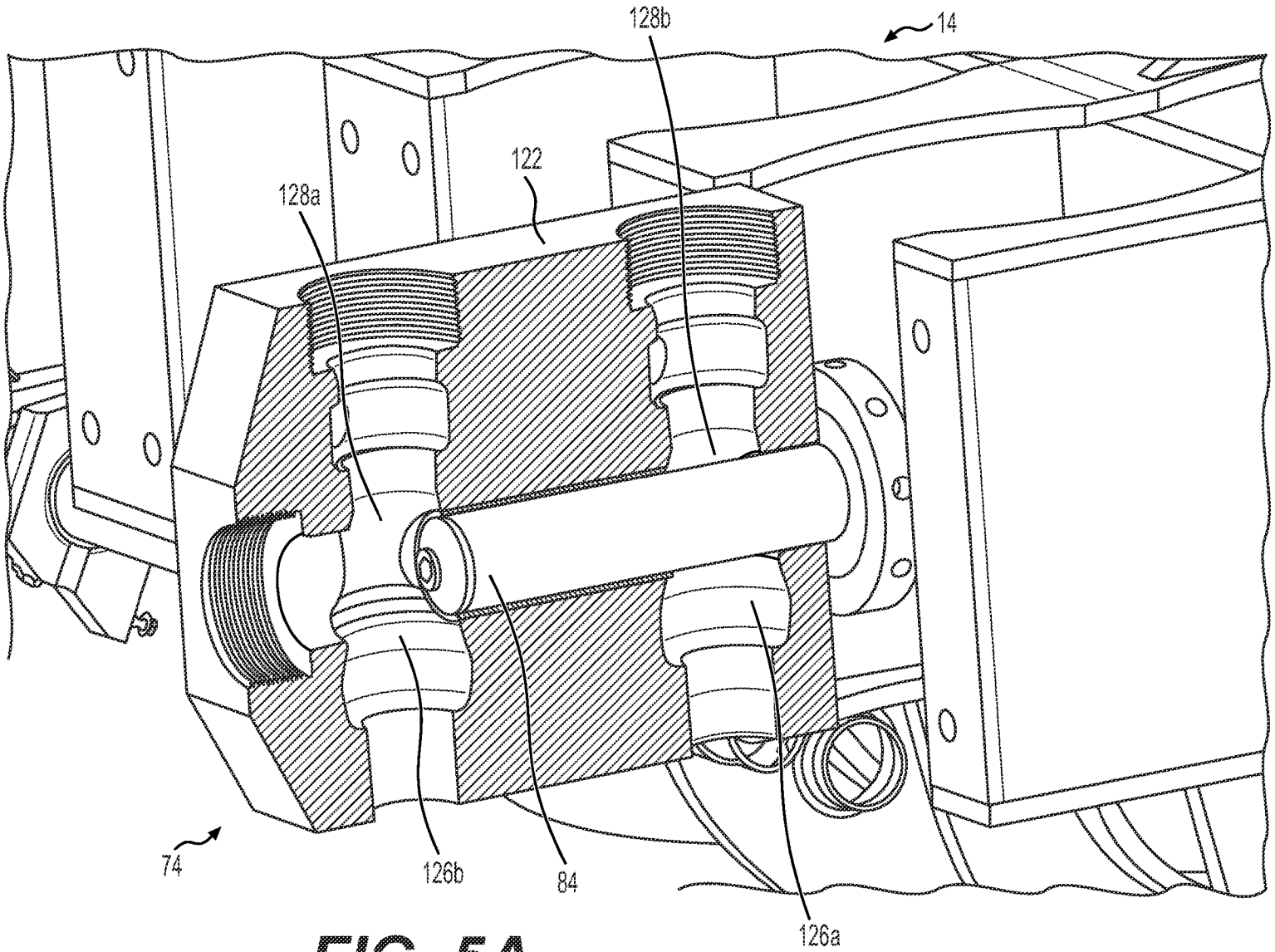
FIG. 5A is a schematic partial perspective view of an example hydraulic fracturing pump, including a partial section view of an example fluid end according to embodiments of the disclosure.

FIG. 5A is a schematic partial perspective view of an example hydraulic fracturing pump (such as hydraulic fracturing pump 14 shown in FIG. 3A, and/or hydraulic fracturing pump 14' shown in FIGS. 4A and 4F), including a partial section view of an example first and/or second fluid end 74*a* and/or 74*b* according to embodiments of the disclosure. In particular, the first and/or second fluid end 74*a* and/or 74*b* depicted in FIG. 5A may be configured to both draw-in and discharge fracturing fluid relative to the fluid end chambers with each stroke of the respective plungers as described herein. As shown, in some embodiments, the first fluid end 74*a* and/or the second fluid end 74*b* may include a fluid end body 122 at least partially defining a chamber 124, a first inlet port 126*a*, a second inlet port 126*b*, a first discharge port 128*a*, and a second discharge port 128*b*. The first and/or second plungers 84 and/or 88 may be configured to reciprocate within the chamber 124 between the first discharge port 128*a* and the second discharge port 128*b* as the crankshaft 78 rotates. For example, as the first and/or second plunger 84 and/or 88 travels in the first direction, fracturing fluid is drawn into the chamber 124 via the first inlet port 126*a* and fracturing fluid is discharged from the chamber 124 via the first discharge port 128*a*, and as the first and/or second plunger 84 and/or 88 travels in the second direction opposite the first direction, fracturing fluid is drawn into the chamber 124 via the second inlet port 126*b* and fracturing fluid is discharged from the chamber 124 via the second discharge port 128*b*. In the example shown, the first inlet port 126*a* and the first discharge port 128*a* are adjacent opposite ends of the chamber 124. Similarly, in the example shown, the second inlet port 126*b* and the second discharge port 128*b* are adjacent opposite ends of the chamber 124.

Figure 5B:
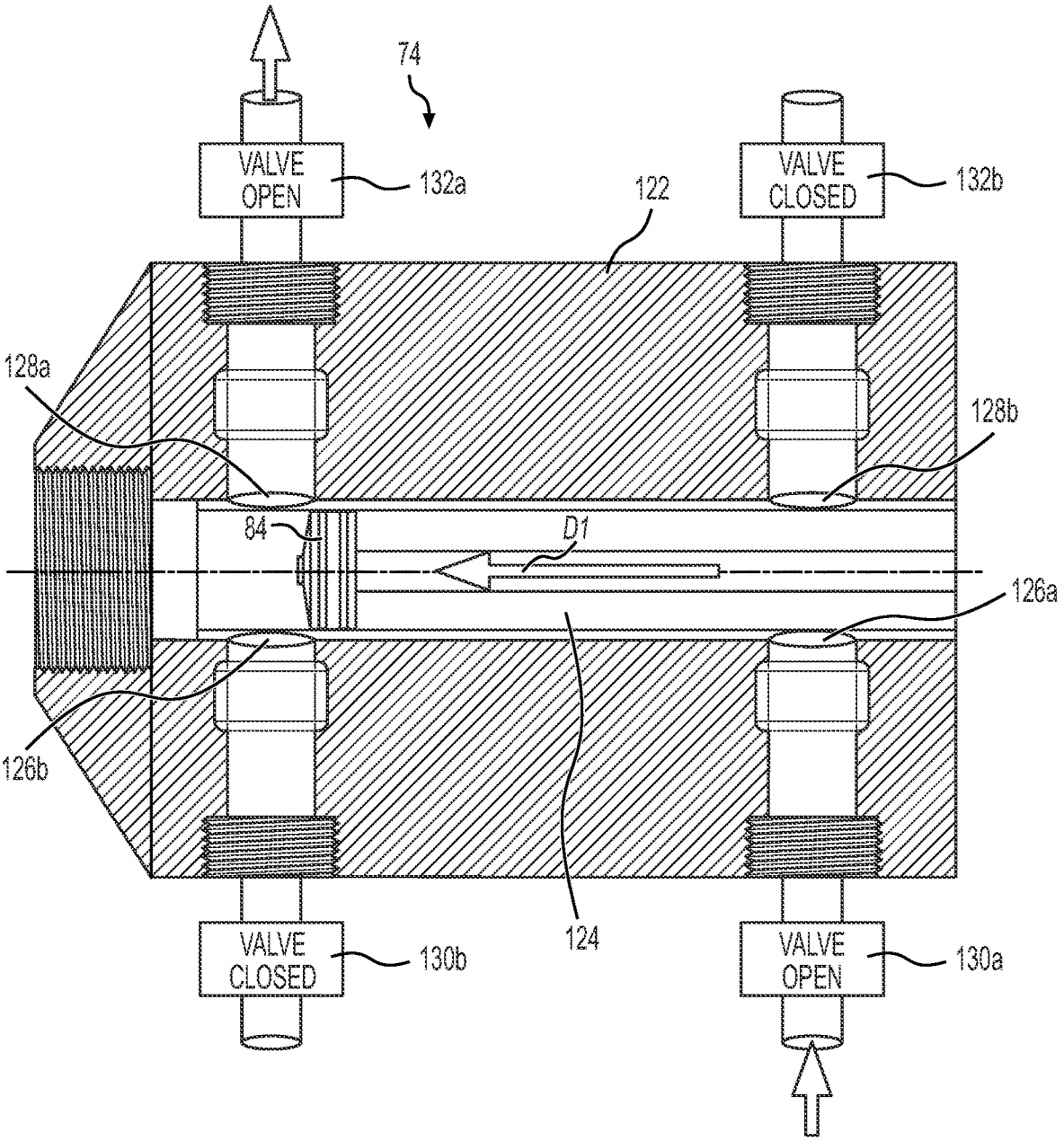
FIG. 5B is a schematic partial side section view of an example fluid end with an example plunger moving in a first direction according to embodiments of the disclosure.
Figure 5C:
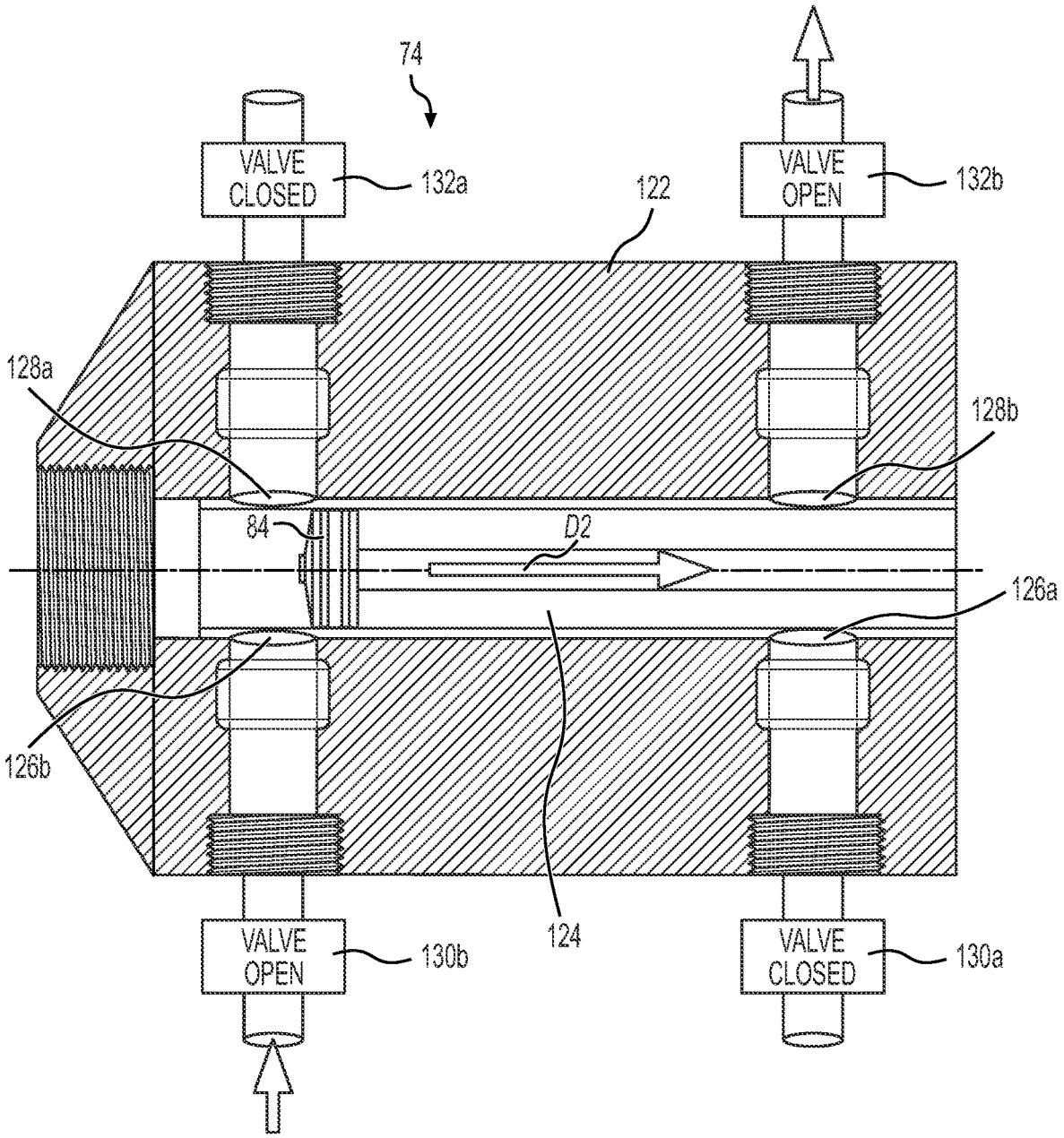
FIG. 5C is a schematic partial side section view of the example fluid end shown in FIGS. 5A-5B with the example plunger moving in a second direction opposite the first direction, according to embodiments of the disclosure.
Figure 5D:
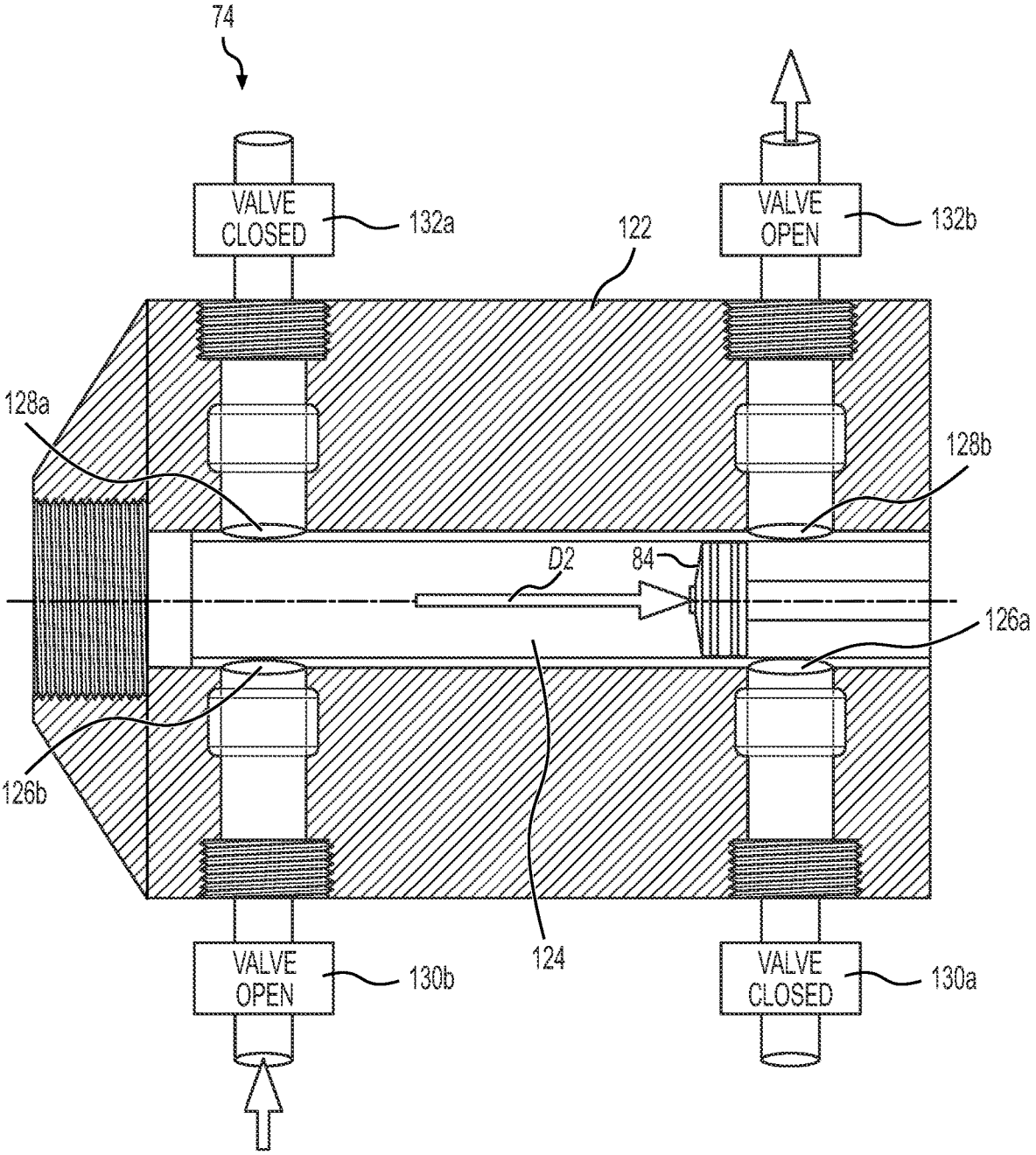
FIG. 5D is a schematic partial side section view of the example fluid end shown in FIGS. 5A-5B with the example plunger continuing to move in the second direction according to embodiments of the disclosure.
Figure 5E:
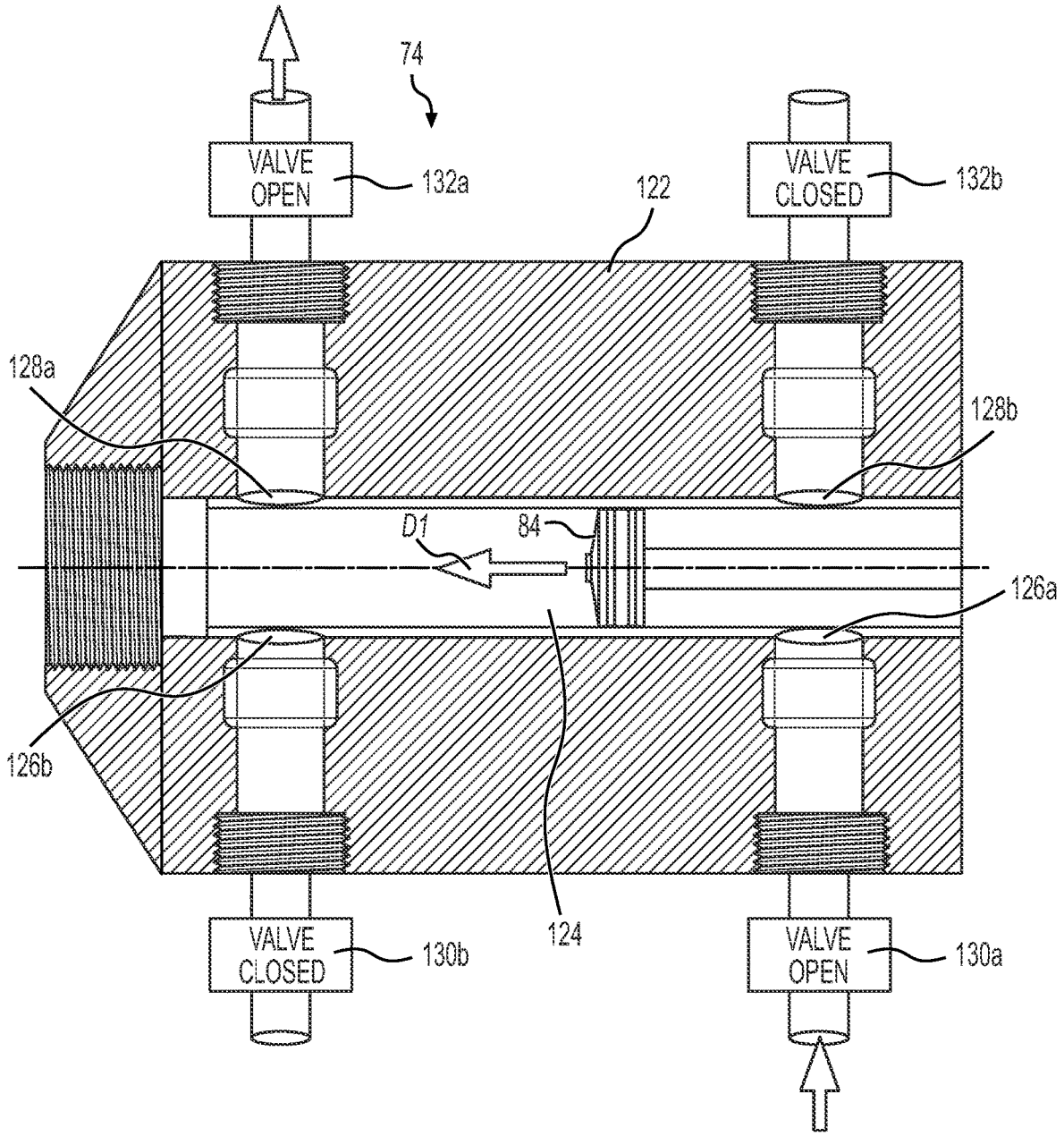
FIG. 5E is a schematic partial side section view of the example fluid end shown in FIGS. 5A-5B with the example plunger reversing directions and moving in the first direction, according to embodiments of the disclosure.

FIG. 5B is a schematic partial side section view of an example fluid end 74 and an example first plunger 84 moving in a first direction D1 according to embodiments of the disclosure. FIG. 5C is a schematic partial side section view of the example fluid end 74 shown in FIG. 5B with the example first plunger 84 moving in a second direction D2 opposite the first direction D1, according to embodiments of the disclosure. FIG. 5D is a schematic partial side section view of the example fluid end 74 shown in FIG. 5B with the example first plunger 84 continuing to move in the second direction D2 according to embodiments of the disclosure. FIG. 5E is a schematic partial side section view of the example fluid end 74 shown in FIG. 5B with the example first plunger 84 reversing directions and moving in the first direction D1, according to embodiments of the disclosure. Although FIGS. 5A through 5D show example fluid ends 74 and a first plunger 84, in some embodiments, the second fluid end 74*b* and the respective second plungers 88 may operate in an at least similar manner.

As shown in FIGS. 5A through 5D, in some embodiments, the hydraulic fracturing pump 14 may include a first inlet valve 130*a* upstream relative to the first inlet port 126*a*, a first discharge valve 132*a* downstream relative to the first discharge port 128*a*, a second inlet valve 130*b* upstream relative to the second inlet port 126*b*, and a second discharge valve 132*b* downstream relative to the second discharge port 128*b*. As shown in FIG. 5B, in some embodiments, as the first plunger 84 travels in the first direction D1, the first inlet valve 130*a* is open, the first discharge valve 132*a* is open, the second inlet valve 130*b* is closed, the second discharge valve is closed 132*b*. The fracturing fluid is drawn into the chamber 124 as the first plunger 84 travels in the first direction D1 via the first inlet valve 130*a* and the first inlet port 126*a*, and fracturing fluid is discharged from the chamber 124 via the first discharge port 128*a* and the first discharge valve 132*a*. As shown in FIG. 5C, as the first plunger 84 completes its stroke in the first direction D1, for example, just before reaching the first discharge port 128*a* and/or the second inlet port 126*b*, and begins to travel in the opposite, second direction D2, the first inlet valve 130*a* closes, the first discharge valve 132*a* closes, the second inlet valve 130*b* opens, and the second discharge valve 132 opens. The fracturing fluid is drawn into the chamber 124 as the first plunger 84 travels in the second direction D2 via the second inlet valve 130*a* and the second inlet port 126*b*, and fracturing fluid is discharged from the chamber 124 via the second discharge port 128*b* and the second discharge valve 132*b*.

FIG. 5D shows the first plunger 84 reaching the end of its stroke in the second direction D2 with the second discharge valve 132*b* still open, the second inlet valve 130*b* still open, the first inlet valve 130*a* still closed, and the first discharge valve 132*a* still closed. As shown in FIG. 5E, the first plunger 84 reverses direction and begins to travel in the first direction D1, the second discharge valve 132*b* and the second inlet valve 130*b* close, and the first inlet valve 130*a* and the first discharge valve 132*a* open, such that the fracturing fluid may be drawn into the chamber 124 via the first inlet port 126*a* and the first inlet valve 130*a*, while fracturing fluid is discharged from the first discharge port 128*a* and first discharge valve 132*a*. In this example manner, the hydraulic fracturing pump 14 may be configured to both draw-in and discharge fracturing fluid relative to the fluid end chambers with each stroke of the respective plungers, regardless of the direction of the respective strokes. This, in at least some embodiments, may result in a significant increase in the output capability of the hydraulic fracturing pump 14 relative to, for example, fracturing pumps having plungers that draw-in fluid only when moving in a first direction and discharge fluid only when moving in the opposite direction.

Figure 6:
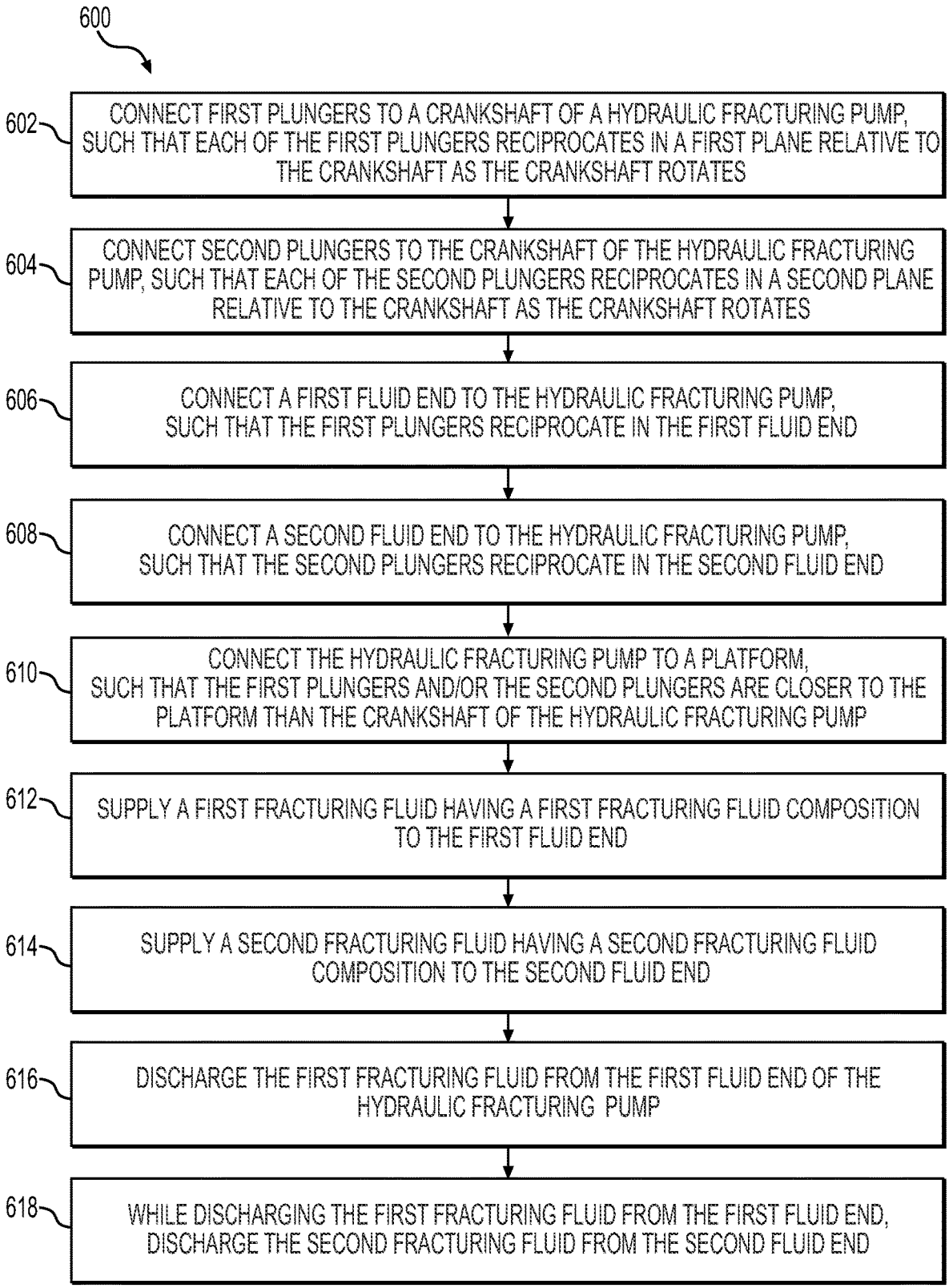
FIG. 6 is a block diagram of an example method to enhance output of a hydraulic fracturing unit associated with a high-pressure fracturing operation according to embodiments of the disclosure.
Figure 7:
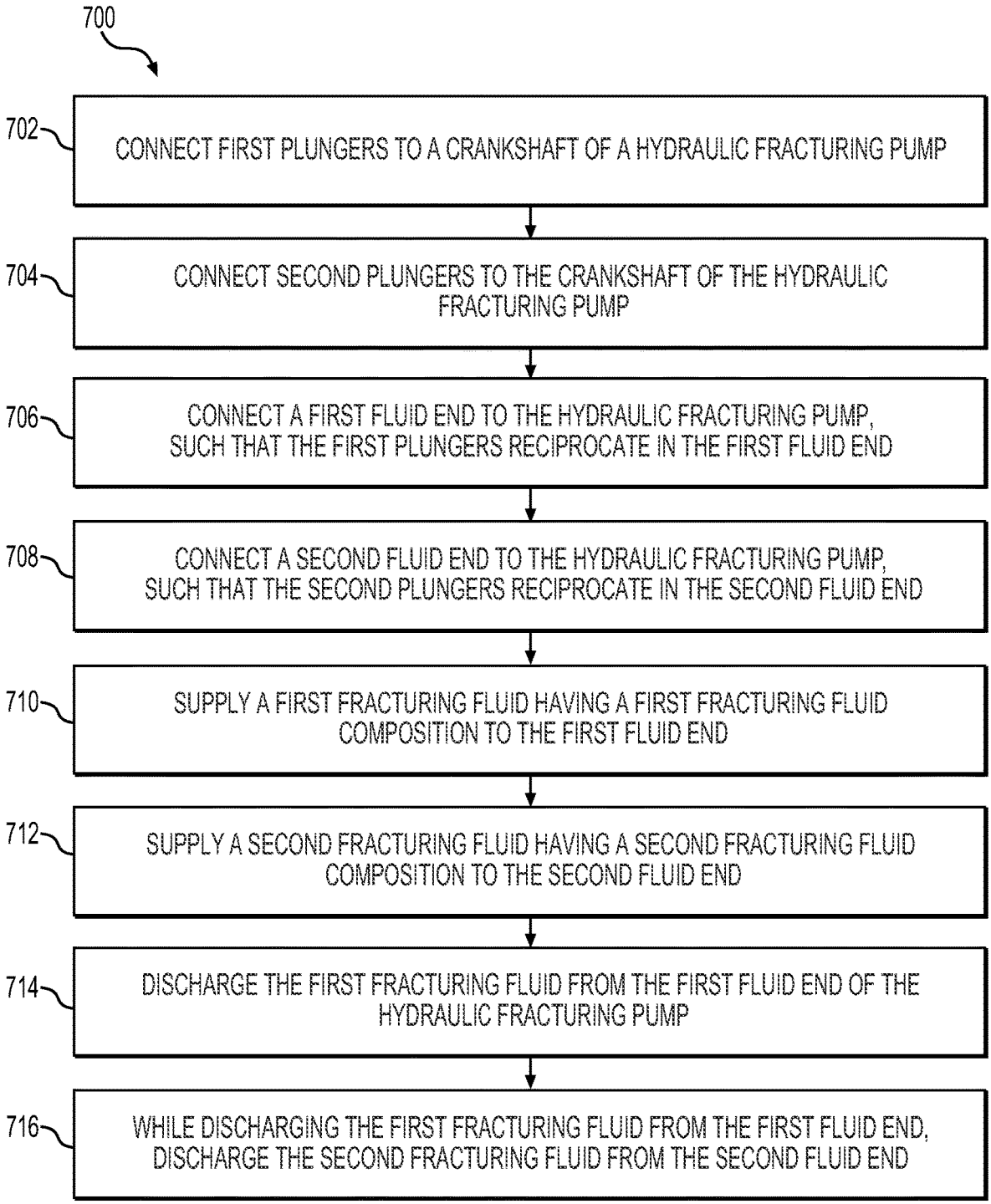
FIG. 7 is a block diagram of an example method to increase a service interval of a hydraulic fracturing pump associated with a high-pressure fracturing operation according to embodiments of the disclosure.
Figure 8:
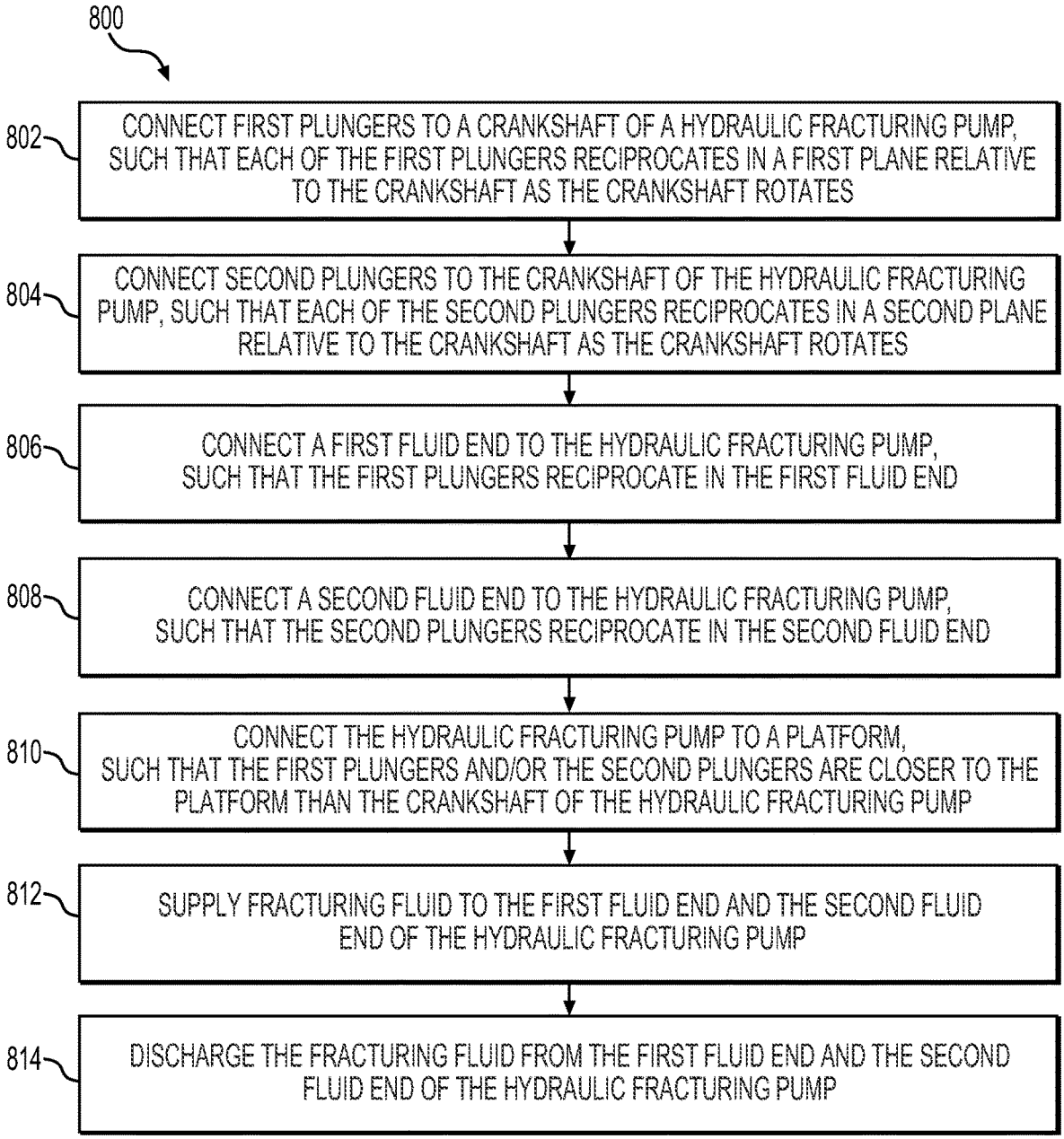
FIG. 8 is a block diagram of an example method to reduce torque shock magnitude generated during operation of a hydraulic fracturing pump associated with a high-pressure fracturing operation according to embodiments of the disclosure.

FIG. 6, FIG. 7, and FIG. 8 show block diagrams of example methods 600, 700, and 800 according to embodiments of the disclosure, illustrated as respective collections of blocks in logical flow graphs, which represent a sequence of operations. FIG. 6 is a block diagram of an example method 600 to enhance output of a hydraulic fracturing unit associated with a high-pressure fracturing operation according to embodiments of the disclosure. FIG. 7 is a block diagram of an example method 700 to increase a service interval of a hydraulic fracturing pump associated with a high-pressure fracturing operation according to embodiments of the disclosure. FIG. 8 is a block diagram of an example method 800 to reduce torque shock magnitude generated during operation of a hydraulic fracturing pump associated with a high-pressure fracturing operation according to embodiments of the disclosure. For each of the respective example methods, the order in which the operations are described is not intended to be construed as a limitation, and any number of the described blocks may be combined in any order and/or in parallel to implement the method.

FIG. 6 is a block diagram of an example method 600 to enhance output of a hydraulic fracturing unit associated with a high-pressure fracturing operation according to embodiments of the disclosure. As shown in FIG. 6, the example method 600, at 602, may include connecting first plungers to a crankshaft of a hydraulic fracturing pump, such that each of the first plungers reciprocates in a first plane relative to the crankshaft as the crankshaft rotates.

At 604, the example method 600 may include connecting second plungers to the crankshaft of the hydraulic fracturing pump, such that each of the second plungers reciprocates in a second plane relative to the crankshaft as the crankshaft rotates. For example, the crankshaft may include a plurality of crankpins each offset from a longitudinal rotation axis of the crankshaft, and connecting the plurality of first plungers to the crankshaft and connecting the plurality of second plungers to the crankshaft may include connecting one of the plurality of first plungers and one of the plurality of second plungers to each of the plurality of crankpins, for example, as described herein. In some embodiments, each of the plurality of first plungers may have a first diameter, and each of the plurality of second plungers has a second diameter. The first and second diameters may the same or different. Connecting one of the plurality of first plungers and one of the plurality of second plungers to each of the plurality of crankpins may include connecting one of the first plungers and one of the second plungers to each of the crankpins, such that a longitudinal distance occupied by the one of the first plungers and the one of the second plungers is less than a sum of the first diameter and the second diameter, for example, as described previously herein. In some embodiments, the crankshaft may define a longitudinal crankshaft axis extending between opposite longitudinal crankshaft ends, and the example method 600 further may include driving the crankshaft via the opposite longitudinal crankshaft ends, for example, as previously described herein.

The example method 600, at 606, may include connecting a first fluid end to the hydraulic fracturing pump, such that the first plungers reciprocate in the first fluid end.

At 608, the example method 600 may include connecting a second fluid end to the hydraulic fracturing pump, such that the second plungers reciprocate in the second fluid end.

The example method 600, at 610, may include connecting the hydraulic fracturing pump to a platform, such that the first plungers and/or the second plungers are closer to the platform than the crankshaft of the hydraulic fracturing pump. In some embodiments, the platform may have a longitudinal platform axis and a width perpendicular to the longitudinal platform axis. The hydraulic fracturing pump may be connected to the platform, such that a longitudinal axis of the crankshaft is parallel to the longitudinal platform axis.

At 612, the example method 600 may include supplying a first fracturing fluid having a first fracturing fluid composition to the first fluid end.

The example method 600, at 614, may include supplying a second fracturing fluid having a second fracturing fluid composition to the second fluid end. The first fracturing fluid composition and the second fracturing fluid composition may be the same or different, for example, as described previously herein.

At 616, the example method 600 may include discharging the first fracturing fluid from the first fluid end of the hydraulic fracturing pump. In some embodiments, this may include causing the first fluid end to discharge fracturing fluid as each of the plurality of first plungers moves in a first direction and discharge fracturing fluid as each of the plurality of first plungers moves in a second direction opposite the first direction, for example, as previously described herein.

At 618, the example method 600 may include, while discharging the first fracturing fluid from the first fluid end, discharging the second fracturing fluid from the second fluid end. In some embodiments, this may include causing the second fluid end to discharge fracturing fluid as each of the plurality of second plungers moves in a third direction and discharge fracturing fluid as each of the plurality of second plungers moves in a fourth direction opposite the third direction, for example, as previously described herein.

FIG. 7 is a block diagram of an example method 700 to increase a service interval of a hydraulic fracturing pump associated with a high-pressure fracturing operation according to embodiments of the disclosure. At 702, the example method 700 may include connecting first plungers to a crankshaft of a hydraulic fracturing pump.

At 704, the example method 700 may include connecting second plungers to the crankshaft of the hydraulic fracturing pump.

The example method 700, at 706 may include connecting a first fluid end to the hydraulic fracturing pump, such that the first plungers reciprocate in the first fluid end.

At 708, the example method 700 may include connecting a second fluid end to the hydraulic fracturing pump, such that the second plungers reciprocate in the second fluid end.

The example method 700, at 710, may include supplying a first fracturing fluid having a first fracturing fluid composition to the first fluid end.

At 712, the example method 700 may include supplying a second fracturing fluid having a second fracturing fluid composition to the second fluid end. In some embodiments of the example method 700, the first fracturing fluid composition and the second fracturing fluid composition may be different. For example, the first fracturing fluid composition may include water, gels, and/or proppants, and the second fracturing fluid composition may include water and/or other components, but may be substantially devoid of proppants. In such embodiments, the first plungers may pump a fracturing fluid including proppants while the second plungers may pump water, etc., without proppants. Some such embodiments may result in increasing a service interval for the hydraulic fracturing pump because the plungers pumping water (e.g., without proppants) will be expected to experience relatively less wear (e.g., have a slower wear rate) as compared to plungers that pump a fracturing fluid that includes proppants, for example, because pumping proppants may result in increasing the wear rates of plungers and associated fluid ends.

The example method 700, at 714, may include discharging the first fracturing fluid from the first fluid end of the hydraulic fracturing pump.

At 716, the example method 700 may include, while discharging the first fracturing fluid from the first fluid end, discharging the second fracturing fluid from the second fluid end.

FIG. 8 is a block diagram of an example method 800 to reduce torque shock magnitude generated during operation of a hydraulic fracturing pump associated with a high-pressure fracturing operation according to embodiments of the disclosure. At 802, the example method 800 may include connecting first plungers to a crankshaft of a hydraulic fracturing pump, such that each of the first plungers reciprocates in a first plane relative to the crankshaft as the crankshaft rotates.

At 804, the example method 800 may include connecting second plungers to the crankshaft of the hydraulic fracturing pump, such that each of the second plungers reciprocates in a second plane relative to the crankshaft as the crankshaft rotates. For example, the crankshaft may include a plurality of crankpins each offset from a longitudinal rotation axis of the crankshaft, and connecting the plurality of first plungers to the crankshaft and connecting the plurality of second plungers to the crankshaft may include connecting one of the plurality of first plungers and one of the plurality of second plungers to each of the plurality of crankpins, for example, as described herein. In some embodiments, the first plane and the second plane may define a non-zero offset angle between the first plane and the second plane, for example, as described previously herein.

The example method 800, at 806, may include connecting a first fluid end to the hydraulic fracturing pump, such that the first plungers reciprocate in the first fluid end.

At 808, the example method 800 may include connecting a second fluid end to the hydraulic fracturing pump, such that the second plungers reciprocate in the second fluid end.

The example method 800, at 810, may include connecting the hydraulic fracturing pump to a platform, such that the first plungers and/or the second plungers are closer to the platform than a crankshaft of the hydraulic fracturing pump.

At 812, the example method 800, may include supplying fracturing fluid to the first fluid end and the second fluid end of the hydraulic fracturing pump.

The example method 800, at 814, may include discharging the fracturing fluid from the first fluid end and the second fluid end of the hydraulic fracturing pump. In some embodiments, this may include causing the first fluid end to discharge fracturing fluid as each of the plurality of first plungers moves in a first direction and discharge fracturing fluid as each of the plurality of first plungers moves in a second direction opposite the first direction, for example, as previously described herein. In some embodiments, this also may include causing the second fluid end to discharge fracturing fluid as each of the plurality of second plungers moves in a third direction and discharge fracturing fluid as each of the plurality of second plungers moves in a fourth direction opposite the third direction, for example, as previously described herein.

In addition to the embodiments described above, embodiments of the present disclosure further relate to one or more of the following Examples, which can include various embodiments method steps features or elements and/or combinations of features steps or elements as disclosed herein. The following disclosed Examples further are not to be taken as limiting the scope of the present disclosure and any of the embodiments.

Example 1. A hydraulic fracturing pump to enhance flow of fracturing fluid into a wellhead during a high-pressure fracturing operation, the hydraulic fracturing pump including: a pump frame at least partially defining a shaft aperture;

a crankshaft extending through the shaft aperture;

a plurality of first plungers connected to the crankshaft and positioned to reciprocate relative to the crankshaft as the crankshaft rotates, each of the plurality of first plungers reciprocating in a first plane and drawing in fracturing fluid at a first pressure and discharging the fracturing fluid at a second pressure greater than the first pressure; and a plurality of second plungers connected to the crankshaft and positioned to reciprocate relative to the crankshaft as the crankshaft rotates, each of the plurality of second plungers reciprocating in a second plane and drawing in fracturing fluid at a third pressure and discharging the fracturing fluid at a fourth pressure greater than the third pressure, the first plane and the second plane defining a non-zero offset angle between the first plane and the second plane.

The hydraulic fracturing pump of Example 1, wherein the non-zero offset angle ranges from ninety degrees to one hundred-eighty degrees.

A second example embodiment may include the hydraulic fracturing pump of Example 1, wherein the crankshaft includes a plurality of crankpins, each of the plurality of crankpins being offset from a longitudinal rotation axis of the crankshaft, and each of the plurality of crankpins being connected to one of the plurality of first plungers and one of the plurality of second plungers.

A third example embodiment may include the hydraulic fracturing pump of Example 1, wherein: a first pair of plungers includes a first one of the plurality of first plungers and a first one of the plurality of second plungers, and a second pair of plungers includes a second one of the plurality of first plungers and a second one of the plurality of second plungers; and the crankshaft is configured such that the first pair of plungers moves in a first direction to discharge the fracturing fluid while the second pair of plungers moves in a second direction to draw-in the fracturing fluid.

A fourth example embodiment may include the hydraulic fracturing pump of Example 1, further includes a plurality of connector rods, each of the connector rods connecting one of one of the plurality first plungers to each of the plurality of crankpins or one of the plurality of second plungers to each of the plurality of crankpins.

A fifth example embodiment may include the hydraulic fracturing pump of Example 1, wherein each of the plurality of connector rods includes: a plunger end connected to one of one of the plurality first plungers or one of the plurality of second plungers; and a crank end connected to one of the plurality of crankpins, each of the crank ends including two crank end connectors separated by a crank end space.

A sixth example embodiment may include the hydraulic fracturing pump of Example 1, wherein the plurality of connector rods includes: a plurality of first connector rods, each of the plurality of first connector rods being connected to one of the plurality of first plungers; and a plurality of second connector rods, each of the plurality of second connector rods being connected to one of the plurality of second plungers, wherein a crank end connector of each of the plurality of first connector rods is positioned at least partially in a crank end space of one of the plurality of second connector rods, and a crank end connector of each of the plurality of second connector rods is positioned at least partially in a crank end space of one of the plurality of first connector rods.

A seventh example embodiment may include the hydraulic fracturing pump of the Example 1, wherein the plurality of first plungers is positioned to pump a first fracturing fluid including a first fracturing fluid composition while the plurality of second plungers pumps a second fracturing fluid including a second fracturing fluid composition different than the first fracturing fluid composition.

A eighth example embodiment may include the hydraulic fracturing pump of Example 1, wherein the first fracturing fluid composition includes proppants, and the second fracturing fluid composition includes water and is devoid of proppants.

A ninth example embodiment may include the hydraulic fracturing pump of Example 1, wherein the hydraulic fracturing pump is configured to be driven by one or more prime movers at opposite ends of the hydraulic fracturing pump.

A tenth example embodiment may include the hydraulic fracturing pump of Example 1, further including: a first pinion gear engaged with the crankshaft at a first end of the pump frame; a connector shaft connected to the first pinion gear; and a second pinion gear connected to the hydraulic fracturing pump at a second end of the pump frame and connected to the first pinion gear via the connector shaft, such that the first pinion gear drives the connector shaft and the crankshaft at the first end of the pump frame, the connector shaft drives the second pinion gear at the second end of the pump frame, and the second pinion gear drives the crankshaft at the second end of the pump frame.

An eleventh example embodiment may include the hydraulic fracturing pump of Example 1, further including: a first fluid end connected to the pump frame such that the plurality of first plungers draw fracturing fluid into the first fluid end at the first pressure and discharge the fracturing fluid from the first fluid end at the second pressure; and a second fluid end connected to the pump frame such that the plurality of second plungers draw fracturing fluid into the second fluid end at the third pressure and discharge the fracturing fluid from the second fluid end at the fourth pressure greater than the third pressure.

A twelth example embodiment may include the hydraulic fracturing pump of Example 1, wherein one or more of: one or more of the plurality of first plungers or the first fluid end are configured such that as each of the plurality of first plungers travels in a first direction, fracturing fluid is drawn into the first fluid end and fracturing fluid is discharged from the first fluid end, and as each of the plurality of first plungers travels in a second direction opposite the first direction, fracturing fluid is drawn into the first fluid end and fracturing fluid is discharged from the first fluid end; or one or more of the plurality of second plungers or the second fluid end are configured such that as each of the plurality of second plungers travels in a third direction, fracturing fluid is drawn into the second fluid end and fracturing fluid is discharged from the second fluid end, and as each of the plurality of second plungers travels in a fourth direction opposite the third direction, fracturing fluid is drawn into the second fluid end and fracturing fluid is discharged from the second fluid end.

A thirteenth example embodiment may include the hydraulic fracturing pump of Example one or more of: the plurality of first plungers reciprocate in a first direction away from the crankshaft and a second direction opposite the first direction and toward the crankshaft, the first direction and the second direction lying in the first plane, the first direction having a downward component and an outward component, and the second direction having an upward component and an inward component; or the plurality of second plungers reciprocate in a third direction away from the crankshaft and a fourth direction opposite the third direction and toward the crankshaft, the third direction and the fourth direction lying in the second plane, the third direction having a downward component and an outward component, and the fourth direction having an upward component and an inward component.

A fourteenth example embodiment may include The hydraulic fracturing pump of Example 1, wherein the plurality of first plungers includes at least three plungers, and the plurality of second plungers includes at least three plungers.

A fifteenth example embodiment may include he hydraulic fracturing pump of Example 1, wherein the pump frame includes a plurality of pump frame sections, each of the plurality of pump frame sections at least partially defining the shaft aperture.

A sixteenth example embodiment may include the hydraulic fracturing pump of Example 1, wherein at least one of the plurality of pump frame sections has an inverted V-shaped cross-section as viewed in a direction substantially parallel to a longitudinal axis of the crankshaft.

Example 2. A hydraulic fracturing pump to enhance flow of fracturing fluid into a wellhead during a high-pressure fracturing operation, the hydraulic fracturing pump including: a pump frame at least partially defining a shaft aperture; a crankshaft extending through the shaft aperture, the crankshaft including a plurality of crankpins, each of the crankpins being offset from a longitudinal rotation axis of the crankshaft; a plurality of first plungers, each of the plurality of first plungers being connected to the crankshaft via a respective crankpin of the plurality of crankpins and being positioned to reciprocate relative to the crankshaft as the crankshaft rotates; and a plurality of second plungers, each of the plurality of second plungers being connected to the crankshaft via a respective crankpin of the plurality of crankpins and being positioned to reciprocate relative to the crankshaft as the crankshaft rotates, each of the plurality of crankpins being connected to one of the plurality of first plungers and one of the plurality of second plungers.

The hydraulic fracturing pump of Example 2, further including a plurality of connector rods, each of the connector rods connecting one of one of the plurality first plungers to each of the plurality of crankpins or one of the plurality of second plungers to each of the plurality of crankpins.

A second example embodiment may include the hydraulic fracturing pump of Example 2, wherein each of the plurality of connector rods includes: a plunger end connected to one of one of the plurality first plungers or one of the plurality of second plungers; and a crank end connected to one of the plurality of crankpins, each of the crank ends including two crank end connectors separated by a crank end space.

A third example embodiment may include the hydraulic fracturing pump of Example 2 the plurality of connector rods includes: a plurality of first connector rods, each of the plurality of first connector rods being connected to one of the plurality of first plungers; and a plurality of second connector rods, each of the plurality of second connector rods being connected to one of the plurality of second plungers, wherein a crank end connector of each of the plurality of first connector rods is positioned at least partially in a crank end space of one of the plurality of second connector rods and a crank end connector of each of the plurality of second connector rods is positioned at least partially in a crank end space of one of the plurality of first connector rods.

A fourth example embodiment may include the hydraulic fracturing pump of Example 2 a first pair of plungers includes a first one of the plurality of first plungers and a first one of the plurality of second plungers, and a second pair of plungers includes a second one of the plurality of first plungers and a second one of the plurality of second plungers; and the crankshaft is configured such that the first pair of plungers moves in a first direction to discharge the fracturing fluid while the second pair of plungers moves in a second direction to draw-in the fracturing fluid.

A fifth example embodiment may include the hydraulic fracturing pump of Example 2, wherein each of the plurality of first plungers reciprocates in a first plane, and each of the plurality of second plungers reciprocates in a second plane, the first plane and the second plane defining a non-zero offset angle between the first plane and the second plane.

A sixth example embodiment may include the hydraulic fracturing pump of Example 2, wherein the plurality of first plungers is positioned to pump a first fracturing fluid including a first fracturing fluid composition while the plurality of second plungers to pumps a second fracturing fluid including a second fracturing fluid composition different than the first fracturing fluid composition, and wherein the first fracturing fluid composition includes proppants, and the second fracturing fluid composition includes water and is devoid of proppants.

A seventh example embodiment may include the hydraulic fracturing pump of Example 2, further including: a first fluid end connected to the pump frame such that the plurality of first plungers draw fracturing fluid into the first fluid end at a first pressure and discharge the fracturing fluid from the first fluid end at a second pressure greater than the first pressure; and a second fluid end connected to the pump frame such that the plurality of second plungers draw fracturing fluid into the second fluid end at a third pressure and discharge the fracturing fluid from the second fluid end at a fourth pressure greater than the third pressure.

An eighth example embodiment may include the hydraulic fracturing pump of Example 2, wherein one or more of: one or more of the plurality of first plungers or the first fluid end are configured such that as each of the plurality of first plungers travels in a first direction, fracturing fluid is drawn into the first fluid end and fracturing fluid is discharged from the first fluid end, and as each of the plurality of first plungers travels in a second direction opposite the first direction, fracturing fluid is drawn into the first fluid end and fracturing fluid is discharged from the first fluid end; or one or more of the plurality of second plungers or the second fluid end are configured such that as each of the plurality of second plungers travels in a third direction, fracturing fluid is drawn into the second fluid end and fracturing fluid is discharged from the second fluid end, and as each of the plurality of second plungers travels in a fourth direction opposite the third direction, fracturing fluid is drawn into the second fluid end and fracturing fluid is discharged from the second fluid end.

A nineth example embodiment may include the hydraulic fracturing pump of Example 2 further including: a first pinion gear engaged with the crankshaft at a first end of the pump frame; a connector shaft connected to the first pinion gear; and a second pinion gear connected to the hydraulic fracturing pump at a second end of the pump frame and connected to the first pinion gear via the connector shaft, such that the first pinion gear drives the connector shaft and the crankshaft at the first end of the pump frame, the connector shaft drives the second pinion gear at the second end of the pump frame, and the second pinion gear drives the crankshaft at the second end of the pump frame.

A tenth example embodiment may include the hydraulic fracturing pump of Example 2, wherein the pump frame includes a plurality of pump frame sections, each of the plurality of pump frame sections at least partially defining the shaft aperture.

An eleventh example embodiment may include the hydraulic fracturing pump of Example 2, wherein at least one of the plurality of pump frame sections has an inverted V-shaped cross-section as viewed in a direction substantially parallel to a longitudinal axis of the crankshaft.

Example 3. A hydraulic fracturing pump to enhance flow of fracturing fluid into a wellhead during a high-pressure fracturing operation, the hydraulic fracturing pump including: a pump frame at least partially defining a shaft aperture; a crankshaft extending through the shaft aperture; a plurality of first plungers, each of the plurality of first plungers being connected to the crankshaft and positioned to reciprocate relative to the crankshaft as the crankshaft rotates; and a plurality of second plungers, each of the plurality of second plungers being connected to the crankshaft and being positioned to reciprocate relative to the crankshaft as the crankshaft rotates, the plurality of first plungers being positioned to pump a first fracturing fluid including a first fracturing fluid composition while the plurality of second plungers pump a second fracturing fluid includes a second fracturing fluid composition different from the first fracturing fluid composition.

A second example embodiment may include the hydraulic fracturing pump of Example 3, wherein the first fracturing fluid composition includes proppants, and the second fracturing fluid composition includes water and is devoid of proppants.

A third example embodiment may include the hydraulic fracturing pump of Example 3, wherein each of the plurality of first plungers reciprocates in a first plane, and each of the plurality of second plungers reciprocates in a second plane, the first plane and the second plane defining a non-zero offset angle between the first plane and the second plane.

A fourth example embodiment may include the hydraulic fracturing pump of Example 3, wherein the crankshaft includes a plurality of crankpins, each of the plurality of crankpins being offset from a longitudinal rotation axis of the crankshaft, and each of the plurality of crankpins being connected to one of the plurality of first plungers and one of the plurality of second plungers.

A fifth example embodiment may include the hydraulic fracturing pump of Example 3, wherein: a first pair of plungers includes a first one of the plurality of first plungers and a first one of the plurality of second plungers, and a second pair of plungers includes a second one of the plurality of first plungers and a second one of the plurality of second plungers; and the crankshaft is configured such that the first pair of plungers moves in a first direction to discharge the fracturing fluid while the second pair of plungers moves in a second direction to draw-in the fracturing fluid.

A sixth example embodiment may include the hydraulic fracturing pump of Example 3, further including a plurality of connector rods, each of the connector rods connecting one of one of the plurality first plungers to each of the plurality of crankpins or one of the plurality of second plungers to each of the plurality of crankpins.

A seventh example embodiment may include the hydraulic fracturing pump of Example 3, further including: a first fluid end connected to the pump frame such that the plurality of first plungers draw fracturing fluid into the first fluid end at a first pressure and discharge the fracturing fluid from the first fluid end at a second pressure greater than the first pressure; and a second fluid end connected to the pump frame such that the plurality of second plungers draw fracturing fluid into the second fluid end at a third pressure and discharge the fracturing fluid from the second fluid end at a fourth pressure greater than the third pressure.

An eighth example embodiment may include he hydraulic fracturing pump of Example 3, wherein one or more of: one or more of the plurality of first plungers or the first fluid end are configured such that as each of the plurality of first plungers travels in a first direction, fracturing fluid is drawn into the first fluid end and fracturing fluid is discharged from the first fluid end, and as each of the plurality of first plungers travels in a second direction opposite the first direction, fracturing fluid is drawn into the first fluid end and fracturing fluid is discharged from the first fluid end; or one or more of the plurality of second plungers or the second fluid end are configured such that as each of the plurality of second plungers travels in a third direction, fracturing fluid is drawn into the second fluid end and fracturing fluid is discharged from the second fluid end, and as each of the plurality of second plungers travels in a fourth direction opposite the third direction, fracturing fluid is drawn into the second fluid end and fracturing fluid is discharged from the second fluid end.

A nineth example embodiment may include the hydraulic fracturing pump of Example 3, further including: a first pinion gear engaged with the crankshaft at a first end of the pump frame; a connector shaft connected to the first pinion gear; and a second pinion gear connected to the hydraulic fracturing pump at a second end of the pump frame and connected to the first pinion gear via the connector shaft, such that the first pinion gear drives the connector shaft and the crankshaft at the first end of the pump frame, the connector shaft drives the second pinion gear at the second end of the pump frame, and the second pinion gear drives the crankshaft at the second end of the pump frame.

A tenth example embodiment may include the hydraulic fracturing pump of Example 3, wherein the pump frame includes a plurality of pump frame sections, each of the plurality of pump frame sections at least partially defining the shaft aperture.

An eleventh example embodiment may include the hydraulic fracturing pump of Example 3, wherein at least one of the plurality of pump frame sections has an inverted V-shaped cross-section as viewed in a direction substantially parallel to a longitudinal axis of the crankshaft.

Example 4. A hydraulic fracturing pump to enhance flow of fracturing fluid into a wellhead during a high-pressure fracturing operation, the hydraulic fracturing pump including: a pump frame at least partially defining a shaft aperture; a crankshaft extending through the shaft aperture; a plurality of first plungers, each of the plurality of first plungers being connected to the crankshaft and positioned to reciprocate relative to the crankshaft as the crankshaft rotates; and a plurality of second plungers, each of the plurality of second plungers being connected to the crankshaft and being positioned to reciprocate relative to the crankshaft as the crankshaft rotates; a first fluid end connected to the pump frame such that the plurality of first plungers draw fracturing fluid into the first fluid end at a first pressure and discharge the fracturing fluid from the first fluid end at a second pressure greater than the first pressure; and a second fluid end connected to the pump frame such that the plurality of second plungers draw fracturing fluid into the second fluid end at a third pressure and discharge the fracturing fluid from the second fluid end at a fourth pressure greater than the third pressure.

A second example embodiment may include the hydraulic fracturing pump of Example 4, wherein one or more of: one or more of the plurality of first plungers or the first fluid end are configured such that as each of the plurality of first plungers travels in a first direction, fracturing fluid is drawn into the first fluid end and fracturing fluid is discharged from the first fluid end, and as each of the plurality of first plungers travels in a second direction opposite the first direction, fracturing fluid is drawn into the first fluid end and fracturing fluid is discharged from the first fluid end; or one or more of the plurality of second plungers or the second fluid end are configured such that as each of the plurality of second plungers travels in a third direction, fracturing fluid is drawn into the second fluid end and fracturing fluid is discharged from the second fluid end, and as each of the plurality of second plungers travels in a fourth direction opposite the third direction, fracturing fluid is drawn into the second fluid end and fracturing fluid is discharged from the second fluid end.

A third example embodiment may include the hydraulic fracturing pump of Example 4, wherein each of the plurality of first plungers reciprocates in a first plane, and each of the plurality of second plungers reciprocates in a second plane, the first plane and the second plane defining a non-zero offset angle between the first plane and the second plane.

A fourth example embodiment may include the hydraulic fracturing pump of Example 4, wherein the crankshaft includes a plurality of crankpins, each of the plurality of crankpins being offset from a longitudinal rotation axis of the crankshaft, and each of the plurality of crankpins being connected to one of the plurality of first plungers and one of the plurality of second plungers.

A fifth example embodiment may include the hydraulic fracturing pump of Example 4, wherein:

a first pair of plungers includes a first one of the plurality of first plungers and a first one of the plurality of second plungers, and a second pair of plungers includes a second one of the plurality of first plungers and a second one of the plurality of second plungers; and the crankshaft is configured such that the first pair of plungers moves in a first direction to discharge the fracturing fluid while the second pair of plungers moves in a second direction to draw-in the fracturing fluid.

A sixth example embodiment may include the hydraulic fracturing pump of Example 4, further including a plurality of connector rods, each of the connector rods connecting one of one of the plurality first plungers to each of the plurality of crankpins or one of the plurality of second plungers to each of the plurality of crankpins.

A seventh example embodiment may include the hydraulic fracturing pump of Example 4, wherein the plurality of first plungers is positioned to pump a first fracturing fluid including a first fracturing fluid composition while the plurality of second plungers to pumps a second fracturing fluid including a second fracturing fluid composition different than the first fracturing fluid composition, and wherein the first fracturing fluid composition includes proppants, and the second fracturing fluid composition includes water and is devoid of proppants.

An eighth example embodiment may include the hydraulic fracturing pump of Example 4, further including: a first pinion gear engaged with the crankshaft at a first end of the pump frame; a connector shaft connected to the first pinion gear; and a second pinion gear connected to the hydraulic fracturing pump at a second end of the pump frame and connected to the first pinion gear via the connector shaft, such that the first pinion gear drives the connector shaft and the crankshaft at the first end of the pump frame, the connector shaft drives the second pinion gear at the second end of the pump frame, and the second pinion gear drives the crankshaft at the second end of the pump frame.

A nineth example embodiment may include he hydraulic fracturing pump of Example 4, wherein the pump frame includes a plurality of pump frame sections, each of the plurality of pump frame sections at least partially defining the shaft aperture.

A tenth example embodiment may include the hydraulic fracturing pump of Example 4, wherein at least one of the plurality of pump frame sections has an inverted V-shaped cross-section as viewed in a direction substantially parallel to a longitudinal axis of the crankshaft.

Example 5. A hydraulic fracturing pump to enhance flow of fracturing fluid into a wellhead during a high-pressure fracturing operation is provided, the hydraulic fracturing pump including: a pump frame at least partially defining a shaft aperture;

a crankshaft extending through the shaft aperture;

a plunger connected to the crankshaft and positioned to reciprocate relative to the crankshaft as the crankshaft rotates; and a fluid end connected to the pump frame, one or more of the fluid end or the plunger being positioned such that as the plunger travels in a first direction, fracturing fluid is drawn into the fluid end and fracturing fluid is discharged from the fluid end, and as the plunger travels in a second direction opposite the first direction, fracturing fluid is drawn into the fluid end and fracturing fluid is discharged from the fluid end.

A second example embodiment may include the hydraulic fracturing pump of Example 5, wherein:

the fluid end includes a fluid end body at least partially defining a chamber, a first inlet port, a second inlet port, a first discharge port, and a second discharge port; and the plunger reciprocates within the chamber between the first discharge port and the second discharge port as the crankshaft rotates.

A second example embodiment may include the hydraulic fracturing pump of Example 5, wherein:

as the plunger travels in the first direction, fracturing fluid is drawn into the chamber via the first inlet port and fracturing fluid is discharged from the chamber via the first discharge port; and as the plunger travels in the second direction, fracturing fluid is drawn into the chamber via the second inlet port and fracturing fluid is discharged from the chamber via the second discharge port.

A third example embodiment may include the hydraulic fracturing pump of Example 5 wherein: the first inlet port and the first discharge port are adjacent opposite ends of the chamber; and the second inlet port and the second discharge port are adjacent opposite ends of the chamber.

A fourth example embodiment may include the hydraulic fracturing pump of Example 5, further including: a first inlet valve upstream relative to the first inlet port; a first discharge valve downstream relative to the first discharge port; a second inlet valve upstream relative to the second inlet port; and a second discharge valve downstream relative to the second discharge port.

A fifth example embodiment may include the hydraulic fracturing pump of Example 5 of, wherein:

A third example embodiment may include the hydraulic fracturing pump of Example 5wherein: the first inlet port and the first discharge port are adjacent opposite ends of the chamber; and the second inlet port and the second discharge port are adjacent opposite ends of the chamber.

A fourth example embodiment may include the hydraulic fracturing pump of Example 5, further including: a first inlet valve upstream relative to the first inlet port; a first discharge valve downstream relative to the first discharge port; a second inlet valve upstream relative to the second inlet port; and a second discharge valve downstream relative to the second discharge port.

A fifth example embodiment may include the hydraulic fracturing pump of Example 5of , wherein:

as the plunger travels in the first direction, the first inlet valve is open, the first discharge valve is open, the second inlet valve is closed, the second discharge valve is closed, fracturing fluid is drawn into the chamber via the first inlet valve and the first inlet port, and fracturing fluid is discharged from the chamber via the first discharge port and the first discharge valve; and as the plunger travels in the second direction, the first inlet valve is closed, the first discharge valve is closed, the second inlet valve is open, the second discharge valve is open, fracturing fluid is drawn into the chamber via the second inlet valve and the second inlet port, and fracturing fluid is discharged from the chamber via the second discharge port and the second discharge valve.

A sixth example embodiment may include the hydraulic fracturing pump of Example 5, wherein: the plunger includes a plurality of plungers, each of the plurality of plungers being connected to the crankshaft and positioned to reciprocate relative to the crankshaft as the crankshaft rotates; the fluid end at least partially defines a plurality of chambers, a plurality of first inlet ports, a plurality of second inlet ports, a plurality of first discharge ports, and a plurality of second discharge ports; and each of the plurality of plungers reciprocates within a respective chamber between a respective first discharge port and a respective second discharge port as the crankshaft rotates.

A seventh example embodiment may include the hydraulic fracturing pump of Example 5, wherein the plurality of plungers includes: a plurality of first plungers, each of the plurality of first plungers being connected to the crankshaft and positioned to reciprocate relative to the crankshaft as the crankshaft rotates, each of the plurality of first plungers reciprocating in a first plane and drawing in fracturing fluid at a first pressure and discharging the fracturing fluid at a second pressure greater than the first pressure; and a plurality of second plungers, each of the plurality of second plungers being connected to the crankshaft and being positioned to reciprocate relative to the crankshaft as the crankshaft rotates, each of the plurality of second plungers reciprocating in a second plane and drawing in fracturing fluid at a third pressure and discharging the fracturing fluid at a fourth pressure greater than the third pressure, the first plane and the second plane defining a non-zero offset angle between the first plane and the second plane.

Example 6. A hydraulic fracturing pump to enhance flow of fracturing fluid into a wellhead during a high-pressure fracturing operation, the hydraulic fracturing pump including: a pump frame at least partially defining a shaft aperture;

a crankshaft extending through the shaft aperture;

a plunger connected to the crankshaft and positioned to reciprocate relative to the crankshaft as the crankshaft rotates;

a first pinion gear engaged with the crankshaft at a first end of the pump frame;

a connector shaft connected to the first pinion gear; and a second pinion gear connected to the hydraulic fracturing pump at a second end of the pump frame and connected to the first pinion gear via the connector shaft, such that the first pinion gear drives the connector shaft and the crankshaft at the first end of the pump frame, the connector shaft drives the second pinion gear at the second end of the pump frame, and the second pinion gear drives the crankshaft at the second end of the pump frame.

Example 7. A hydraulic fracturing pump to enhance flow of fracturing fluid into a wellhead during a high-pressure fracturing operation, the hydraulic fracturing pump including: a pump frame including a plurality of pump frame sections, one or more of the plurality of pump frame sections at least partially defining a shaft aperture;

a crankshaft extending through the shaft aperture, one or more of the plurality of pump frame sections having an inverted V-shaped cross-section as viewed in a direction substantially parallel to a longitudinal axis of the crankshaft; and a plunger connected to the crankshaft and positioned to reciprocate relative to the crankshaft as the crankshaft rotates.

Example 8. A hydraulic fracturing unit to enhance flow of fracturing fluid into a wellhead during a high-pressure fracturing operation, the hydraulic fracturing unit including: a platform having a longitudinal platform axis and a width perpendicular to the longitudinal platform axis; a prime mover supported by the platform, the prime mover including an output shaft; a transmission including an input shaft and a transmission output shaft, the transmission supported by the platform and connected to the output shaft of the prime mover via the input shaft; a hydraulic fracturing pump supported by the platform at a longitudinal position opposite the prime mover relative to the transmission, the hydraulic fracturing pump including: a pump frame at least partially defining a shaft aperture; a crankshaft extending through the shaft aperture, the crankshaft having a longitudinal axis of rotation substantially parallel to the longitudinal platform axis; a plurality of first plungers connected to the crankshaft and positioned to reciprocate relative to the crankshaft as the crankshaft rotates, each of the plurality of first plungers reciprocating in a first plane and drawing in fracturing fluid at a first pressure and discharging the fracturing fluid at a second pressure greater than the first pressure; and a plurality of second plungers connected to the crankshaft and positioned to reciprocate relative to the crankshaft as the crankshaft rotates, each of the plurality of second plungers reciprocating in a second plane and drawing in fracturing fluid at a third pressure and discharging the fracturing fluid at a fourth pressure greater than the third pressure, the first plane and the second plane defining a non-zero offset angle between the first plane and the second plane.

A second example embodiment may include the hydraulic fracturing unit of Example 8, wherein the offset angle ranges from ninety degrees to one hundred-eighty degrees.

A third example embodiment may include the hydraulic fracturing unit of Example 8, wherein one or more of the plurality of first plungers or the plurality of second plungers are between the crankshaft and the platform.

A fourth example embodiment may include the hydraulic fracturing unit of Example 8, further including: a first fluid end connected to the hydraulic fracturing pump such that the plurality of first plungers draw fracturing fluid into the first fluid end at the first pressure and discharge the fracturing fluid from the first fluid end at the second pressure; and a second fluid end connected to the hydraulic fracturing pump such that the plurality of second plungers draw fracturing fluid into the second fluid end at the third pressure and discharge the fracturing fluid from the second fluid end at the fourth pressure, the first fluid end and the second fluid end being closer to the platform than the crankshaft.

A fifth example embodiment may include the hydraulic fracturing unit of Example 8, wherein the hydraulic fracturing pump has a pump width perpendicular to the longitudinal axis of rotation of the crankshaft and is supported by the platform such that the pump width is less than or equal to the width of the platform.

A sixth example embodiment may include the hydraulic fracturing unit of Example 8, wherein the plurality of first plungers includes four or more plungers, and the plurality of second plungers includes four or more plungers.

A seventh example embodiment may include the hydraulic fracturing unit of Example 8, wherein the pump frame includes a plurality of pump frame sections, one or more of the plurality of pump frame sections at least partially defining the shaft aperture, and wherein one or more of the plurality of pump frame sections has an inverted V-shaped cross-section as viewed in a direction substantially parallel to longitudinal axis of rotation of the crankshaft.

A eigth example embodiment may include the hydraulic fracturing unit of Example 8, wherein the crankshaft includes a plurality of crankpins, each of the plurality of crankpins being offset from the longitudinal rotation axis of the crankshaft, and each of the plurality of crankpins being connected to one of the plurality of first plungers and one of the plurality of second plungers.

A nonth example embodiment may include the hydraulic fracturing unit of Example 8, wherein the plurality of crankpins includes four or more crankpins, the plurality of first plungers includes four or more plungers, and the plurality of second plungers includes four or more plungers.

A tenth example embodiment may include the hydraulic fracturing unit of Example 8, further including a plurality of connector rods, each of the connector rods connecting one of one of the plurality first plungers to each of the plurality of crankpins or one of the plurality of second plungers to each of the plurality of crankpins, each of the plurality of connector rods including: a plurality of first connector rods, each of the plurality of first connector rods being connected to one of the plurality of first plungers; and a plurality of second connector rods, each of the plurality of second connector rods being connected to one of the plurality of second plungers, a portion of each of the plurality of first connector rods longitudinally intermeshing with a portion of each of the plurality of second connector rods.

An eleventh example embodiment may include the hydraulic fracturing unit of Example 8, wherein the prime mover is a first prime mover located at a first end of the hydraulic fracturing pump, and the hydraulic fracturing unit further includes a second prime mover located at a second end of the hydraulic fracturing pump opposite the first end of the hydraulic fracturing pump, the second prime mover being connected to the hydraulic fracturing pump to supply power to the hydraulic fracturing pump.

Example 9. A method to enhance output of a hydraulic fracturing unit associated with a high-pressure fracturing operation, the method including: connecting a plurality of first plungers to a crankshaft of a hydraulic fracturing pump, each of the plurality of first plungers positioned to reciprocate relative to the crankshaft as the crankshaft rotates and each of the plurality of first plungers reciprocating in a first plane and drawing in fracturing fluid at a first pressure and discharging the fracturing fluid at a second pressure greater than the first pressure; and connecting a plurality of second plungers to the crankshaft of the hydraulic fracturing pump, each of the plurality of second plungers positioned to reciprocate relative to the crankshaft as the crankshaft rotates and each of the plurality of second plungers reciprocating in a second plane and drawing in fracturing fluid at a third pressure and discharging the fracturing fluid at a fourth pressure greater than the third pressure, the first plane and the second plane defining a non-zero offset angle between the first plane and the second plane.

A second example embodiment may include the method of Example 9, wherein: the crankshaft includes a plurality of crankpins each offset from a longitudinal rotation axis of the crankshaft; and connecting the plurality of first plungers to the crankshaft and connecting the plurality of second plungers to the crankshaft includes connecting one of the plurality of first plungers and one of the plurality of second plungers to each of the plurality of crankpins.

A third example embodiment may include the method of Example 9, wherein each of the plurality of first plungers has a first diameter and each of the plurality of second plungers has a second diameter, and connecting one of the plurality of first plungers and one of the plurality of second plungers to each of the plurality of crankpins includes connecting the one of the plurality of first plungers and the one of the plurality of second plungers to each of the plurality of crankpins such that a longitudinal distance occupied by the one of the plurality of first plungers and the one of the plurality of second plungers is less than a sum of the first diameter and the second diameter.

A fourth example embodiment may include the method of Example 9, wherein the hydraulic fracturing unit includes a platform having a longitudinal platform axis and a width perpendicular to the longitudinal platform axis, and wherein the method further including connecting the hydraulic fracturing pump to the platform, such that a longitudinal axis of the crankshaft is parallel to the longitudinal platform axis.

A fifth example embodiment may include the method of Example 9, wherein connecting the hydraulic fracturing pump to the platform includes connecting the hydraulic fracturing pump to the platform, such that one or more of the plurality of first plungers or the plurality of second plungers are closer to the platform than the crankshaft.

A sixth example embodiment may include the method of Example 9, further

- includes connecting a first fluid end to the hydraulic fracturing pump, such that the plurality of first plungers reciprocate in the first fluid end; and
- connecting a second fluid end to the hydraulic fracturing pump, such that the plurality of second plungers reciprocate in the second fluid end.

A seventh example embodiment may include the method of Example 9, further

- includes supplying a first fracturing fluid having a first fracturing fluid composition to the first fluid end; and
- supplying a second fracturing fluid having a second fracturing fluid composition to the second fluid end, the second fracturing fluid composition being different than the first fracturing fluid composition.

An eighth example embodiment may include the method of Example 9, further including one or more of:

- causing the first fluid end to discharge fracturing fluid as each of the plurality of first plungers moves in a first direction and discharge fracturing fluid as each of the plurality of first plungers moves in a second direction opposite the first direction; or
- causing the second fluid end to discharge fracturing fluid as each of the plurality of second plungers moves in a third direction and discharge fracturing fluid as each of the plurality of second plungers moves in a fourth direction opposite the third direction.

A ninth example embodiment may include the method of Example 9, wherein the crankshaft defines a longitudinal crankshaft axis extending between opposite longitudinal crankshaft ends, and the method further includes driving the crankshaft via the opposite longitudinal crankshaft ends.

Example 10. A method to increase a service interval of a hydraulic fracturing pump associated with a high-pressure fracturing operation, the method includes: pumping a first fracturing fluid including a first fracturing fluid composition via a plurality of first plungers of a hydraulic fracturing pump; and while pumping the first fracturing fluid, pumping a second fracturing fluid including a second fracturing fluid composition via a plurality of second plungers of the hydraulic fracturing pump, the first fracturing fluid composition being different than the second fracturing fluid composition.

A second example embodiment may include the method of Example 10, wherein pumping the first fracturing fluid and pumping the second fracturing fluid include driving opposite ends of a crankshaft of the hydraulic fracturing pump.

A third example embodiment may include the method of Example 9, wherein the first fracturing fluid composition includes proppants, and the second fracturing fluid composition includes water and is devoid of proppants.

Example 11. A method to reduce torque shock magnitude generated during operation of a hydraulic fracturing pump associated with a high-pressure fracturing operation, the method including: connecting a plurality of first plungers to a crankshaft of the hydraulic fracturing pump, each of the plurality of first plungers positioned to reciprocate relative to the crankshaft as the crankshaft rotates and each of the plurality of first plungers reciprocating in a first plane and drawing in fracturing fluid at a first pressure and discharging the fracturing fluid at a second pressure greater than the first pressure; and connecting a plurality of second plungers to the crankshaft of the hydraulic fracturing pump, each of the plurality of second plungers positioned to reciprocate relative to the crankshaft as the crankshaft rotates and each of the plurality of second plungers reciprocating in a second plane and drawing in fracturing fluid at a third pressure and discharging the fracturing fluid at a fourth pressure greater than the third pressure, the first plane and the second plane defining a non-zero offset angle between the first plane and the second plane.

The hydraulic fracturing pumps such as disclosed in the example embodiments set forth in the present disclosure can provide a substantially non-consecutive firing sequence between at least two or more pairs or groups of first and second plungers arranged on opposite sides of the pump frame. For example, a plunger firing sequence of 4 plunger pairs that are offset by about forty-five to about ninety degrees can be provided wherein engaging or firing of the plunger pairs or groups can be executed in a 1-3-2-4 sequence. While the two consecutive plunger pairs (e.g. plunger pairs 3 and 2) firing one after the other can result in a higher than maximum connector rod load through half the duration of one crankshaft revolution, the generally overall non-consecutive engagement of firing of the plunger pairs provides at least some degree of force cancellation in the bearings of the frame sections due to the 90-degree phasing of the crank pin pairs such that peak loads acting on the other bearings generally will not reach full connector rod loads.

In addition, the total fluid output of hydraulic fracturing pumps such as disclosed in various embodiments of the present disclosure, including 8 plungers are able to provide increased fluid flow output over 4-plunger pumps having approximately twice the stroke length of the 8-plunger pump configurations illustrated in at least some of the embodiments of hydraulic fracturing pumps disclosed herein, while being implemented in a compact design with a lower size, weight and mechanical feasibility than 4-pump configurations, e.g. a smaller size and weight 10" stroke a 8-plunger pumps such as disclosed in embodiments of this disclosure can perform as a 20" stroke 4-plunger pump.

Having now described some illustrative embodiments of the disclosure, it should be apparent to those skilled in the art that the foregoing is merely illustrative and not limiting, having been presented by way of example only. Numerous modifications and other embodiments are within the scope of one of ordinary skill in the art and are contemplated as falling within the scope of the disclosure. In particular, although many of the examples presented herein involve specific combinations of method acts or system elements, it should be understood that those acts and those elements may be combined in other ways to accomplish the same objectives. Those skilled in the art should appreciate that the parameters and configurations described herein are exemplary and that actual parameters and/or configurations will depend on the specific application in which the systems, methods, and/or aspects or techniques of the disclosure are used. Those skilled in the art should also recognize or be able to ascertain, using no more than routine experimentation, equivalents to the specific embodiments of the disclosure. It is, therefore, to be understood that the embodiments described herein are presented by way of example only and that, within the scope of any appended claims and equivalents thereto, the disclosure may be practiced other than as specifically described.

This application is a divisional of U.S. Non-Provisional application Ser. No. 17/664,578, filed May 23, 2022, titled "HYDRAULIC FRACTURING PUMPS TO ENHANCE FLOW OF FRACTURING FLUID INTO WELLHEADS AND RELATED METHODS," which claims the benefit of and priority to U.S. Provisional Application No. 63/202,031, filed May 24, 2021, titled "HYDRAULIC FRACTURING PUMPS TO ENHANCE FLOW OF FRACTURING FLUID INTO WELLHEADS AND RELATED METHODS," the entire disclosures of which are incorporated herein by reference.

Furthermore, the scope of the present disclosure shall be construed to cover various modifications, combinations, additions, alterations, etc., above and to the above-described embodiments, which shall be considered to be within the scope of this disclosure. Accordingly, various features and characteristics as discussed herein may be selectively interchanged and applied to other illustrated and non-illustrated embodiment, and numerous variations, modifications, and additions further may be made thereto without departing from the spirit and scope of the present disclosure as set forth in the appended claims.

What is claimed is:

1. A method of operating a hydraulic fracturing pump associated with a high-pressure fracturing operation, the method comprising:

rotating a crankshaft of a hydraulic fracturing pump, the crankshaft connected to a plurality of plunger pairs arranged adjacent one another along a longitudinal axis of the crankshaft, thereby to engage the plurality of plunger pairs in a non-consecutive sequence along the longitudinal axis;

pumping a first fracturing fluid having a first fracturing fluid composition via a plurality of first plungers of the plurality of plunger pairs; and pumping a second fracturing fluid having a second fracturing fluid composition via a plurality of second plungers of the plurality of plunger pairs, the first fracturing fluid composition being different than the second fracturing fluid composition.

2. The method of claim 1, wherein rotating the crankshaft, thereby to engage the plurality of plunger pairs in the non-consecutive sequence causes at least partial force cancellation of forces generated by the plurality of plunger pairs.

3. The method of claim 1, wherein rotating the crankshaft comprises driving opposite ends of the crankshaft from corresponding opposite ends of the hydraulic fracturing pump.

4. The method of claim 3, wherein the hydraulic fracturing pump comprises a drive assembly including the crankshaft and at least one planetary gearbox arranged at an end of the corresponding opposite ends of the hydraulic fracturing pump, and wherein driving the opposite ends of the crankshaft includes:

rotating a sun gear of the planetary gearbox coupled to a first one of the opposite ends of the crankshaft, the rotation of the sun gear being translated to a ring gear by a plurality of planetary gears arranged between the sun gear and the ring gear;

driving a first pinion gear with the rotation of the ring gear, the first pinion gear engaged with a connector shaft at a first end thereof; and driving a second pinion gear engaged with the connector shaft at a second end thereof, the second pinion gear configured to engage with and drive rotation of the crankshaft from a second one of the opposite ends of the crankshaft.

5. The method of claim 1, wherein pumping the first fracturing fluid comprises reciprocating the plurality of first plungers in a first plane and pumping the second fracturing fluid comprises reciprocating the plurality of second plungers in a second plane, the first plane and the second plane extending radially outward from the longitudinal axis, the first plane and the second plane being circumferentially offset from one another about the longitudinal axis to define a region therebetween along a minor arc length about the longitudinal axis, and wherein a connector shaft of the hydraulic fracturing pump is parallel to the longitudinal axis and positioned within the region.

6. The method of claim 1, wherein the plurality of first plungers and the plurality of second plungers are arranged in an inverted V-shape.

7. The method of claim 1, wherein:

a plurality of first connector rods is connected to the plurality of first plungers, each first connector rod of the plurality of first connector rods comprising a respective pair of first crank end connectors, a plurality of second connector rods is connected to the plurality of second plungers, each second connector rod of the plurality of second connector rods comprising a respective pair of second crank end connectors, and the respective pair of first crank end connectors is intermeshed with the respective pair of second crank end connectors.

8. The method of claim 1, wherein pumping the first fracturing fluid comprises reciprocating each first plunger of the plurality of first plungers in a first direction and a second direction within a first fluid end of the hydraulic fracturing pump, wherein the first direction is opposite the second direction, such that:

movement of each first plunger of the plurality of first plungers in the first direction causes the first fracturing fluid to be both drawn into the first fluid end and discharged from the first fluid end; and movement of each first plunger of the plurality of first plungers in the second direction causes the first fracturing fluid to be both drawn into the first fluid end and discharged from the first fluid end.

9. The method of claim 8, wherein pumping the second fracturing fluid comprises reciprocating each second plunger of the plurality of second plungers in a third direction and a fourth direction within a second fluid end of the hydraulic fracturing pump, wherein the third direction is opposite the fourth direction, such that:

movement of each second plunger of the plurality of second plungers in the third direction causes the second fracturing fluid to be both drawn into the second fluid end and discharged from the second fluid end; and movement of each second plunger of the plurality of second plungers in the fourth direction causes the second fracturing fluid to be both drawn into the second fluid end and discharged from the second fluid end.

10. A method of operating a hydraulic fracturing pump associated with a high-pressure fracturing operation, the method comprising:

rotating a crankshaft of a hydraulic fracturing pump by driving opposite ends of the crankshaft from corresponding opposite ends of the hydraulic fracturing pump, the crankshaft connected to a plurality of plunger pairs arranged consecutively relative to a longitudinal axis of the crankshaft, thereby to engage the plurality of plunger pairs in a non-consecutive sequence along the longitudinal axis;

pumping a first fracturing fluid having a first fracturing fluid composition via a corresponding first plunger of each of the plurality of plunger pairs; and while pumping the first fracturing fluid, pumping a second fracturing fluid having a second fracturing fluid composition via a corresponding second plunger of each of the plurality of plunger pairs, the first fracturing fluid composition being different than the second fracturing fluid composition.

11. The method of claim 10, wherein the plurality of plunger pairs includes a first plunger pair, a second plunger pair, a third plunger pair, and a fourth plunger pair arranged consecutively relative to the longitudinal axis of the crankshaft, and wherein the non-consecutive sequence includes reciprocating the first plunger pair, then the third plunger pair, then the second plunger pair, and then the fourth plunger pair.

12. The method of claim 10, wherein the hydraulic fracturing pump comprises a drive assembly including the crankshaft and at least one planetary gearbox arranged at an end of the corresponding opposite ends of the hydraulic fracturing pump, and driving the opposite ends of the crankshaft includes:

rotating a sun gear of the planetary gearbox coupled to a first one of the opposite ends of the crankshaft, the rotation of the sun gear being translated to a ring gear by a plurality of planetary gears arranged between the sun gear and the ring gear;

driving a first pinion gear with the rotation of the ring gear, the first pinion gear engaged with a connector shaft at a first end thereof, the connector shaft positioned substantially parallel to the longitudinal axis of the crankshaft and circumferentially positioned between a first plane in which the corresponding first plunger of each of the plurality of plunger pairs reciprocates and a second plane in which the corresponding second plunger of each of the plurality of plunger pairs reciprocates, wherein the first plane and the second plane are angularly offset by a non-zero angle about the longitudinal axis; and driving a second pinion gear engaged with the connector shaft at a second end thereof, the second pinion gear configured to engage with and drive rotation of the crankshaft from a second one of the opposite ends of the crankshaft.

13. A method of operating a hydraulic fracturing pump associated with a high-pressure fracturing operation, the method comprising:

rotating a crankshaft of a hydraulic fracturing pump, the hydraulic fracturing pump comprising a drive assembly with at least one planetary gearbox arranged at an end of the hydraulic fracturing pump, and the crankshaft connected to a plurality of plunger pairs arranged consecutively relative to a longitudinal axis of the crankshaft, thereby to engage the plurality of plunger pairs in a non-consecutive sequence along the longitudinal axis;

pumping a first fracturing fluid having a first fracturing fluid composition via a plurality of first plungers of the plurality of plunger pairs; and pumping a second fracturing fluid having a second fracturing fluid composition via a plurality of second plungers of the plurality of plunger pairs, the first fracturing fluid composition being different than the second fracturing fluid composition.

14. The method of claim 13, wherein the plurality of plunger pairs includes a first plunger pair, a second plunger pair, a third plunger pair, and a fourth plunger pair arranged consecutively relative to the longitudinal axis, and wherein the non-consecutive sequence includes reciprocating the first plunger pair, then the third plunger pair, then the second plunger pair, and then the fourth plunger pair to cause at least partial force cancellation of forces generated by the plurality of plunger pairs.

15. The method of claim 14, wherein rotating the crankshaft comprises driving opposite ends of the crankshaft from corresponding opposite ends of the hydraulic fracturing pump.

16. The method of claim 15, wherein driving the opposite ends of the crankshaft further includes:

rotating a sun gear of the planetary gearbox coupled to a first one of the opposite ends of the crankshaft, the rotation of the sun gear being translated to a ring gear by a plurality of planetary gears arranged between the sun gear and the ring gear;

driving a first pinion gear with the rotation of the ring gear, the first pinion gear engaged with a connector shaft at a first end thereof; and driving a second pinion gear engaged with the connector shaft at a second end thereof, the second pinion gear configured to engage with and drive rotation of the crankshaft from a second one of the opposite ends of the crankshaft.

17. A method of operating a hydraulic fracturing pump associated with a high-pressure fracturing operation, the method comprising:

rotating a crankshaft of a hydraulic fracturing pump, the hydraulic fracturing pump comprising a drive assembly including the crankshaft and at least one planetary gearbox arranged at an end of the hydraulic fracturing pump, such that rotating the crankshaft drives the crankshaft to cause movement of the at least one planetary gearbox, and the crankshaft connected to a plurality of plunger pairs including a first plunger pair, a second plunger pair, a third plunger pair, and a fourth plunger pair arranged consecutively relative to a longitudinal axis of the crankshaft, thereby to engage the plurality of plunger pairs in a non-consecutive sequence including reciprocating the first plunger pair, then the third plunger pair, then the second plunger pair, and then the fourth plunger pair;

pumping a first fracturing fluid having a first fracturing fluid composition via a plurality of first plungers of the plurality of plunger pairs; and pumping a second fracturing fluid having a second fracturing fluid composition via a plurality of second plungers of the plurality of plunger pairs, the first fracturing fluid composition being different than the second fracturing fluid composition.

18. The method of claim 17, wherein driving the crankshaft further includes:

rotating a sun gear of the planetary gearbox coupled to a first one of opposite ends of the crankshaft, the rotation of the sun gear being translated to a ring gear by a plurality of planetary gears arranged between the sun gear and the ring gear;

driving a first pinion gear with the rotation of the ring gear, the first pinion gear engaged with a connector shaft at a first end thereof; and driving a second pinion gear engaged with the connector shaft at a second end thereof, the second pinion gear configured to engage with and drive rotation of the crankshaft from a second one of the opposite ends of the crankshaft.

19. The method of claim 17, wherein engaging the plurality of plunger pairs in the non-consecutive sequence causes at least partial force cancellation of forces generated by the plurality of plunger pairs.

20. The method of claim 17, wherein pumping the first fracturing fluid comprises reciprocating the plurality of first plungers in a first plane, and wherein pumping the second fracturing fluid comprises reciprocating the plurality of second plungers in a second plane, the first plane and the second plane being angularly offset by a non-zero angle about the longitudinal axis, and wherein a connector shaft of the hydraulic fracturing pump is positioned substantially parallel to the longitudinal axis and positioned circumferentially between the first plane and the second plane, and wherein:

rotating the crankshaft comprises driving opposite ends of the crankshaft from corresponding opposite ends of the hydraulic fracturing pump, via at least one pinion gear connected to the connector shaft.

* * * * *